US009755314B2

(12) United States Patent
Puente Baliarda et al.

(10) Patent No.: US 9,755,314 B2
(45) **Date of Patent: *Sep. 5, 2017**

(54) LOADED ANTENNA

(75) Inventors: Caries Puente Baliarda, Barcelona (ES); Jordi Soler Castany, Barcelona (ES)

(73) Assignee: Fractus S.A., Barcelona (ES)

( * ) Notice: Subject to any disclaimer, the term of this patent is extended or adjusted under 35 U.S.C. 154(b) by 290 days.

This patent is subject to a terminal disclaimer.

(21) Appl. No.: 13/047,205

(22) Filed: Mar. 14, 2011

(65) Prior Publication Data

US 2012/0154231 A1 Jun. 21, 2012

Related U.S. Application Data

(63) Continuation of application No. 12/429,360, filed on Apr. 24, 2009, which is a continuation of application No. 11/824,823, filed on Jul. 3, 2007, now Pat. No. 7,541,997, which is a continuation of application No. 10/822,933, filed on Apr. 13, 2004, now Pat. No. 7,312,762, which is a continuation of application No. PCT/EP01/11914, filed on Oct. 16, 2001.

(51) Int. Cl.

| | |
|---|---|
| ***H01Q 9/40*** | (2006.01) |
| ***H01Q 1/36*** | (2006.01) |
| ***H01Q 9/42*** | (2006.01) |

(52) U.S. Cl.

CPC ..... *H01Q 9/40* (2013.01); *H01Q 1/36* (2013.01); *H01Q 9/42* (2013.01)

(58) Field of Classification Search

USPC ..... 343/700 MS, 702, 749, 846

See application file for complete search history.

(56) References Cited

U.S. PATENT DOCUMENTS

| | | | |
|---|---|---|---|
| 3,079,602 | A | 2/1963 | Du Hamel et al. |
| 3,521,284 | A | 7/1970 | Shelton et al. |
| 3,599,214 | A | 8/1971 | Altmayer |
| 3,622,890 | A | 11/1971 | Fujimoto |
| 3,683,376 | A | 8/1972 | Pronovost |
| 3,689,929 | A | 9/1972 | Moody |
| 3,818,490 | A | 6/1974 | Leahy |

(Continued)

FOREIGN PATENT DOCUMENTS

| | | |
|---|---|---|
| CN | 2224466 | 4/1996 |
| DE | 3337941 | 5/1985 |

(Continued)

OTHER PUBLICATIONS

Mittra , R. Response to the office action dated Jun. 6, 2011 of U.S. Pat. No. 7,312,762 and control Nos. 95/001461-95/00587-95/000599. Sterne, Kessler, Goldstein & Fox. dated Sep. 7, 2011.

(Continued)

*Primary Examiner* — Dameon E Levi

(74) *Attorney, Agent, or Firm* — Edell, Shapiro & Finnan LLC

(57) ABSTRACT

A novel loaded antenna is defined in the present invention. The radiating element of the loaded antenna consists of two different parts: a conducting surface and a loading structure. By means of this configuration, the antenna provides a small and multiband performance, and hence it features a similar behavior through different frequency bands.

62 Claims, 16 Drawing Sheets

(56) References Cited

U.S. PATENT DOCUMENTS 3,967,276 A 6/1976 Goubau
3,969,730 A 7/1976 Fuchser
4,024,542 A 5/1977 Ikawa et al.
4,038,662 A 7/1977 Turner
4,072,951 A 2/1978 Kaloi
4,131,893 A 12/1978 Munson et al.
4,141,016 A 2/1979 Nelson
4,318,109 A 3/1982 Weathers
4,356,492 A 10/1982 Kaloi
4,471,358 A 9/1984 Glasser
4,471,493 A 9/1984 Schober
4,504,834 A 3/1985 Garay et al.
4,509,056 A 4/1985 Ploussios
4,536,725 A 8/1985 Hübler
4,543,581 A 9/1985 Nemet
4,571,595 A 2/1986 Phillips et al.
4,584,709 A 4/1986 Kneisel et al.
4,590,614 A 5/1986 Erat
4,608,572 A 8/1986 Blakney et al.
4,623,894 A 11/1986 Lee et al.
4,673,948 A 6/1987 Kuo
4,730,195 A 3/1988 Phillips et al.
4,827,271 A 5/1989 Berneking et al.
4,839,660 A 6/1989 Hadzoglou
4,843,468 A 6/1989 Drewery
4,847,629 A 7/1989 Shimazaki
4,849,766 A 7/1989 Inaba et al.
4,857,939 A 8/1989 Shimazaki
4,860,019 A 8/1989 Jiang et al.
4,890,114 A 12/1989 Egashira
4,894,663 A 1/1990 Urbish et al.
4,907,011 A 3/1990 Kuo
4,912,481 A 3/1990 Mace et al.
4,975,711 A 12/1990 Lee
5,014,346 A 5/1991 Phillips et al.
5,030,963 A 7/1991 Tadama
5,075,691 A 12/1991 Garay et al.
5,138,328 A 8/1992 Zibrik et al.
5,168,472 A 12/1992 Lockwood
5,172,084 A 12/1992 Fiedziuszko et al.
5,200,756 A 4/1993 Feller
5,214,434 A 5/1993 Hsu
5,218,370 A 6/1993 Blaese
5,227,804 A 7/1993 Oda
5,227,808 A 7/1993 Davis
5,245,350 A 9/1993 Sroka
5,248,988 A 9/1993 Makino
5,255,002 A 10/1993 Day
5,257,032 A 10/1993 Diamond et al.
5,307,075 A 4/1994 Huynh
5,347,291 A 9/1994 Moore
5,355,144 A 10/1994 Walton et al.
5,355,318 A 10/1994 Dionnet et al.
5,363,114 A 11/1994 Shoemaker
5,373,300 A 12/1994 Jenness et al.
5,402,134 A 3/1995 Miller et al.
5,410,322 A 4/1995 Sonoda
5,420,599 A 5/1995 Erkocevic
5,422,651 A 6/1995 Chang
5,451,965 A 9/1995 Matsumoto
5,451,968 A 9/1995 Emery
5,453,751 A 9/1995 Tsukamoto et al.
5,453,752 A 9/1995 Wang et al.
5,457,469 A 10/1995 Diamond et al.
5,471,224 A 11/1995 Barkeshli
5,493,702 A 2/1996 Crowley et al.
5,495,261 A 2/1996 Baker et al.
5,534,877 A 7/1996 Sorbello et al.
5,537,367 A 7/1996 Lockwood et al.
5,557,293 A 9/1996 McCoy et al.
5,608,417 A 3/1997 De Vall
5,684,672 A 11/1997 Karidis et al.
5,712,640 A 1/1998 Andou et al.
5,767,811 A 6/1998 Mandai et al.
5,798,688 A 8/1998 Schofield
5,809,433 A 9/1998 Thompson et al.
5,821,907 A 10/1998 Zhu et al.
5,841,403 A 11/1998 West
5,847,682 A 12/1998 Ke
5,870,066 A 2/1999 Asakura et al.
5,872,546 A 2/1999 Ihara et al.
5,898,404 A 4/1999 Jou
5,903,240 A 5/1999 Kawahata et al.
5,918,183 A 6/1999 Janky et al.
5,926,139 A * 7/1999 Korisch ..... 343/702
5,926,141 A 7/1999 Lindenmeier et al.
5,929,825 A 7/1999 Niu et al.
5,936,587 A 8/1999 Gudilev et al.
5,943,020 A 8/1999 Liebendoerfer et al.
5,943,025 A * 8/1999 Benham et al. ..... 343/795
5,966,098 A 10/1999 Qi et al.
5,973,651 A 10/1999 Suesada et al.
5,986,609 A 11/1999 Spall
5,986,610 A 11/1999 Miron
5,990,838 A 11/1999 Burns et al.
5,995,052 A 11/1999 Sadler et al.
6,002,367 A 12/1999 Engblom et al.
6,011,518 A 1/2000 Yamagishi et al.
6,011,699 A 1/2000 Murray et al.
6,028,568 A 2/2000 Asakura et al.
6,031,499 A 2/2000 Dichter
6,031,505 A 2/2000 Qi et al.
6,037,907 A 3/2000 Ha et al.
6,078,294 A 6/2000 Mitarai
6,087,990 A 7/2000 Thill et al.
6,091,365 A 7/2000 Nerderyd et al.
6,094,179 A 7/2000 Davidson
6,097,339 A 8/2000 Filipovic et al.
6,097,345 A 8/2000 Walton
6,104,349 A * 8/2000 Cohen ..... 343/702
6,111,545 A 8/2000 Saari
6,122,533 A 9/2000 Zhang et al.
6,127,977 A 10/2000 Cohen
6,130,651 A 10/2000 Yanagisawa et al.
6,131,042 A 10/2000 Lee et al.
6,140,966 A 10/2000 Pankinaho
6,140,969 A 10/2000 Lindenmeier et al.
6,140,975 A 10/2000 Cohen
6,141,540 A 10/2000 Richards et al.
6,147,655 A 11/2000 Roesner
6,160,513 A 12/2000 Davidson
6,166,694 A 12/2000 Ying
6,172,618 B1 1/2001 Hakozaki et al.
6,181,281 B1 1/2001 Desclos et al.
6,195,048 B1 2/2001 Chiba et al.
6,198,442 B1 3/2001 Rutkowski et al.
6,201,501 B1 3/2001 Arkko et al.
6,204,826 B1 3/2001 Rutkowski et al.
6,211,824 B1 4/2001 Holden et al.
6,211,826 B1 4/2001 Aoki
6,215,474 B1 4/2001 Shah
6,218,992 B1 4/2001 Sadler et al.
6,236,366 B1 5/2001 Yamamoto et al.
6,236,372 B1 5/2001 Lindenmeier et al.
6,239,765 B1 5/2001 Johnson et al.
6,243,592 B1 6/2001 Nakada et al.
6,259,407 B1 7/2001 Tran
6,266,023 B1 7/2001 Nagy et al.
6,266,538 B1 7/2001 Waldron
6,268,831 B1 7/2001 Sanford
6,268,836 B1 7/2001 Faulkner et al.
6,281,846 B1 8/2001 Puente et al.
6,288,680 B1 9/2001 Tsuru et al.
6,300,914 B1 10/2001 Yang
6,307,511 B1 10/2001 Ying et al.
6,317,084 B1 11/2001 Chen et al.
6,329,951 B1 12/2001 Wen et al.
6,329,954 B1 12/2001 Fuchs et al.
6,329,962 B2 12/2001 Ying
6,337,663 B1 1/2002 Chi-Ming
6,337,667 B1 1/2002 Ayala et al.
6,343,208 B1 1/2002 Ying
6,352,434 B1 3/2002 Emmert
6,353,443 B1 3/2002 Ying

(56) References Cited

U.S. PATENT DOCUMENTS

| | | | |
|---|---|---|---|
| 6,359,589 | B1 | 3/2002 | Bae |
| 6,362,790 | B1 | 3/2002 | Proctor, Jr. et al. |
| 6,366,243 | B1 | 4/2002 | Isohätälä et al. |
| 6,367,939 | B1 | 4/2002 | Carter et al. |
| 6,384,790 | B2 | 5/2002 | Dishart et al. |
| 6,392,610 | B1 | 5/2002 | Braun et al. |
| 6,407,710 | B2 | 6/2002 | Keilen et al. |
| 6,408,190 | B1 | 6/2002 | Ying |
| 6,417,810 | B1 | 7/2002 | Huels et al. |
| 6,417,816 | B2 | 7/2002 | Sadler et al. |
| 6,431,712 | B1 | 8/2002 | Turnbull |
| 6,445,352 | B1 | 9/2002 | Cohen |
| 6,452,549 | B1 | 9/2002 | Lo |
| 6,452,553 | B1 | 9/2002 | Cohen |
| 6,452,556 | B1 | 9/2002 | Ha et al. |
| 6,459,413 | B1 | 10/2002 | Tseng et al. |
| 6,476,766 | B1 | 11/2002 | Cohen |
| 6,476,769 | B1 | 11/2002 | Lehtola |
| 6,483,462 | B2 | 11/2002 | Weinberger |
| 6,525,691 | B2 | 2/2003 | Varadan et al. |
| 6,535,175 | B2 | 3/2003 | Brady et al. |
| 6,549,789 | B1 | 4/2003 | Kfoury |
| 6,552,690 | B2 | 4/2003 | Veerasamy |
| 6,614,400 | B2 | 9/2003 | Egorov |
| 6,657,593 | B2 | 12/2003 | Nagumo et al. |
| 6,664,930 | B2 | 12/2003 | Wen et al. |
| 6,680,705 | B2 | 1/2004 | Tan et al. |
| 6,693,604 | B2 | 2/2004 | Washiro et al. |
| 6,717,551 | B1 | 4/2004 | Desclos et al. |
| 6,756,946 | B1 | 6/2004 | Deng et al. |
| 6,781,548 | B2 | 8/2004 | Wen et al. |
| 6,831,606 | B2 | 12/2004 | Sajadinia |
| 6,839,040 | B2 | 1/2005 | Huber et al. |
| 6,853,352 | B2 | 2/2005 | Nevermann et al. |
| 6,864,854 | B2 | 3/2005 | Day et al. |
| 6,903,688 | B2 | 6/2005 | Edvarsson |
| 7,015,868 | B2 | 3/2006 | Puente et al. |
| 7,019,695 | B2 | 3/2006 | Cohen |
| 7,123,208 | B2 | 10/2006 | Puente et al. |
| 7,148,850 | B2 | 12/2006 | Puente et al. |
| 7,202,822 | B2 | 4/2007 | Baliarda et al. |
| 7,312,762 | B2 | 12/2007 | Puente et al. |
| 7,394,432 | B2 | 7/2008 | Baliarda et al. |
| 7,397,431 | B2 | 7/2008 | Baliarda et al. |
| 7,511,675 | B2 | 3/2009 | Puente et al. |
| 7,528,782 | B2 | 5/2009 | Baliarda et al. |
| 7,541,997 | B2 | 6/2009 | Puente et al. |
| 7,312,762 | C1 | 11/2012 | Baliarda |
| 2001/0044320 | A1 | 11/2001 | Ono et al. |
| 2001/0050636 | A1 | 12/2001 | Weinberger |
| 2002/0000940 | A1 | 1/2002 | Moren et al. |
| 2002/0000942 | A1 | 1/2002 | Duroux |
| 2002/0036594 | A1 | 3/2002 | Gyenes |
| 2002/0063658 | A1 | 5/2002 | Washiro et al. |
| 2002/0105468 | A1 | 8/2002 | Tessier et al. |
| 2002/0109633 | A1 | 8/2002 | Ow |
| 2002/0126054 | A1 | 9/2002 | Fuerst et al. |
| 2002/0126055 | A1 | 9/2002 | Lindenmeier et al. |
| 2002/0140615 | A1 | 10/2002 | Carles et al. |
| 2002/0175866 | A1 | 11/2002 | Gram |
| 2002/0190904 | A1 | 12/2002 | Cohen |
| 2004/0056804 | A1 | 3/2004 | Kadambi et al. |
| 2004/0095281 | A1 | 5/2004 | Poilasne et al. |
| 2004/0119644 | A1 | 6/2004 | Puente |

FOREIGN PATENT DOCUMENTS

| | | |
|---|---|---|
| EP | 0096847 | 12/1983 |
| EP | 0297813 | 1/1989 |
| EP | 0358090 | 3/1990 |
| EP | 0543645 | 5/1993 |
| EP | 0571124 | 11/1993 |
| EP | 0590671 | 4/1994 |
| EP | 0688040 | 12/1995 |
| EP | 0749176 | 12/1996 |
| EP | 0765001 | 3/1997 |
| EP | 0766343 | 4/1997 |
| EP | 0814536 | 12/1997 |
| EP | 0843905 | 5/1998 |
| EP | 0871238 | 10/1998 |
| EP | 0892459 | 1/1999 |
| EP | 0942488 | 2/1999 |
| EP | 0902472 | 3/1999 |
| EP | 0929121 | 7/1999 |
| EP | 0932219 | 7/1999 |
| EP | 0938158 | 8/1999 |
| EP | 0969375 | 1/2000 |
| EP | 0986130 | 3/2000 |
| EP | 0997974 | 5/2000 |
| EP | 1018777 | 7/2000 |
| EP | 1018779 | 7/2000 |
| EP | 1071161 | 1/2001 |
| EP | 1079462 | 2/2001 |
| EP | 1083624 | 3/2001 |
| EP | 1094545 | 4/2001 |
| EP | 1096602 | 5/2001 |
| EP | 1148581 | 10/2001 |
| EP | 1198027 | 4/2002 |
| EP | 1237224 | 9/2002 |
| EP | 1267438 | 12/2002 |
| ES | 2112163 | 3/1998 |
| ES | 2142280 | 5/2000 |
| ES | 2168199 | 6/2002 |
| FR | 2543744 | 10/1984 |
| FR | 2704359 | 11/1994 |
| GB | 2215136 | 9/1989 |
| GB | 2317994 | 4/1998 |
| GB | 2330951 | 5/1999 |
| GB | 2355116 | 4/2001 |
| JP | 55147806 | 11/1980 |
| JP | 5129816 | 1/1991 |
| JP | 05007109 | 1/1993 |
| JP | 5267916 | 10/1993 |
| JP | 5-308223 | 11/1993 |
| JP | 05347507 | 12/1993 |
| JP | 06-085530 | 3/1994 |
| JP | 6204908 | 7/1994 |
| JP | 6252629 | 9/1994 |
| JP | 1997-246852 | 9/1997 |
| JP | 10-163748 | 6/1998 |
| JP | 10209744 | 8/1998 |
| JP | 10/303637 | 11/1998 |
| JP | 11-004113 | 1/1999 |
| JP | 11-027042 | 1/1999 |
| JP | 11136015 | 5/1999 |
| JP | 11-220319 | 8/1999 |
| WO | 88/09065 | 11/1988 |
| WO | 95/11530 | 4/1995 |
| WO | 96/27219 | 9/1996 |
| WO | 96/29755 | 9/1996 |
| WO | 96/38881 | 12/1996 |
| WO | 97/06578 | 2/1997 |
| WO | 97/11507 | 3/1997 |
| WO | 97/32355 | 9/1997 |
| WO | 97/33338 | 9/1997 |
| WO | 97/35360 | 9/1997 |
| WO | 97/47054 | 12/1997 |
| WO | 98/05088 | 2/1998 |
| WO | 98/12771 | 3/1998 |
| WO | 98/20578 | 5/1998 |
| WO | 98/31067 | 7/1998 |
| WO | 98/36469 | 8/1998 |
| WO | 99/03166 | 1/1999 |
| WO | 99/03167 | 1/1999 |
| WO | 99/25042 | 5/1999 |
| WO | 99/27608 | 6/1999 |
| WO | 99/56345 | 11/1999 |
| WO | 99/65102 | 12/1999 |
| WO | 00/01028 | 1/2000 |
| WO | 00/03453 | 1/2000 |
| WO | 00/22695 | 4/2000 |
| WO | 00/36700 | 6/2000 |
| WO | 00/49680 | 8/2000 |
| WO | 00/52784 | 9/2000 |

(56) References Cited

FOREIGN PATENT DOCUMENTS

| | | |
|---|---|---|
| WO | 00/52787 | 9/2000 |
| WO | 01/03238 | 1/2001 |
| WO | 01/08257 | 2/2001 |
| WO | 01/13464 | 2/2001 |
| WO | 01/17063 | 3/2001 |
| WO | 01/17064 | 3/2001 |
| WO | 01/22528 | 3/2001 |
| WO | 01/24314 | 4/2001 |
| WO | 01/26182 | 4/2001 |
| WO | 01/28035 | 4/2001 |
| WO | 01/31739 | 5/2001 |
| WO | 01/33665 | 5/2001 |
| WO | 01/35491 | 5/2001 |
| WO | 01/37369 | 5/2001 |
| WO | 01/37370 | 5/2001 |
| WO | 0131747 | 5/2001 |
| WO | 01/41252 | 6/2001 |
| WO | 01/48861 | 7/2001 |
| WO | 01/54225 | 7/2001 |
| WO | 01/56111 | 8/2001 |
| WO | 01/73890 | 10/2001 |
| WO | 01/78192 | 10/2001 |
| WO | 01/82410 | 11/2001 |
| WO | 02/35646 | 5/2002 |
| WO | 02/35652 | 5/2002 |
| WO | 02/091518 | 11/2002 |
| WO | 02/096166 | 11/2002 |
| WO | 03/034544 | 4/2003 |
| WO | 03034538 | 4/2003 |
| WO | 2004/027922 | 4/2004 |

OTHER PUBLICATIONS

Greene , R. Response to first office action dated May 13, 2011 for U.S. Pat. No. 7,397,431—U.S. Appl. Nos. 95/001,482 , 95/000,586 , 95/001,497. Sterne Kessler. dated Aug. 15, 2011.

Third party requester's comments to patent ownwer's dated Sep. 7, 2011 response to first office action. Defendants, Mar. 7, 2012.

Menefee, J. A. Action closing prosecution for the U.S. Pat. No. 7,312,762—U.S. Appl. Nos. 95/00587 , 95/001,461. USPTO, dated Mar. 27, 2012.

Menefee, J. A. corrected action closing prosecution for the U.S. Pat. No. 7,312,762—U.S. Appl. Nos. 95/00587 , 95/00,1461. USPTO, dated Apr. 3, 2012.

Adcock , M. D. New type feed for high speed conical scanning. Symposium on the USAF Antenna Research and Development Program, 2nd. Aug. 11, 1952.

Addison , P. S. Fractal and Chaos an illustrated course—Full. Institute of Physics Publising Bristol and Philadelphia. Jan. 1, 1997.

Addison , P. S. Fractals and chaos—An illustrated course. Institute of Physics Publishing. Jan. 1, 1997.

Ali , M. ; Hayes , G. J. et al. A triple band internal antenna for mobile handheld terminals. Antennas and Propagation Society International Symposium, 2002. IEEE. Jun. 16, 2002.

Anguera , J, ; Puente , C. ; Borja , C. ; Romeu , J. Miniature wideband stacked microstrip patch antenna based on the sierpinski fractal geometry. Antennas and Propagation Society International Symposium, 2000. IEEE. Jul. 1, 2000.

Azadegan , R. ; Sarabandi , K. Design of miniaturized slot antennas. IEEE Antennas and Propagation Society International Symposium. Jul. 8, 2001.

Bach Andersen , J. et al. On closely coupled dipoles in a random field. Antennas and Wireless Propagation Letters, IEEE. Dec. 1, 2006.

Balanis , Constantine A. Antenna theory—Analysis and Design—Chapter 9 and Chapter 14. Hamilton Printing. Jan. 1, 1982.

Balanis , Constantine A. Antenna Theory—Analysis and design—Chapter 10. Hamilton Printing. Jan. 1, 1982.

Balanis , Constantine A. Antenna Theory—Analysis and design—Chapter 14. Hamilton Printing. Jan. 1, 1982.

Balanis, Constantine A. Antenna theory—Analysis and design—Chapter 2—Fundamental parameters of antennas. John Wiley & Sons. Jan. 1, 1982.

Barrick , W. A helical resonator antenna diplexer. Symposium on the USAF antenna research and development program, 10th. Oct. 3, 1960.

Batson , D. D. et al. VHF unfurlable turnstile antennas. Symposium USAF antenna research and development program, 19th. Oct. 14, 1969.

Berizzi , F. Fractal analysis of the signal scattered from the sea surface. Antennas and Propagation, IEEE Transactions on. Feb. 1, 1999.

Best , Steven R. The fractal loop antenna: a comparison of fractal and non-fractal geometries. Antennas and Propagation Society International Symposium, 2001. IEEE. Jan. 1, 2001.

Besthorn. 1.0 to 21.0 GHz Log-periodic dipole antenna. Symposium on the USAF Antenna Research and Development Program, 18th. Oct. 15, 1968.

*Bhavsar , Samir A. Fractus S.A.* v. *Samsung Electronics Co., Ltd. et al.*, 6:09-cv-00203 and *Fractus S.A.* v. *LG Electronics Mobilecomm U.S.A., Inc. et al.*, 6-09-cv-00205 disclosure of material information to the USPTO. Baker Botts LLP. Oct. 28, 2009.

Blackband , W. T. The handbook of antenna design—Chapter 18—Coaxial transmisison lines and components. Rudge , A. W. et al. Peter Peregrinus. Jan. 1, 1986.

Blackband , W. T. The handbook of antenna design—Chapter 18—Coaxial transmission lines and components. Rudge , A. W. et al—IEE Eletromagnetic Waves Series; Peter Peregrinus Ltd. Jan. 1, 1986.

Bokhari , S. A. ; Zürcher, J.-F. ; Mosig , Juan R. et al. A small microstrip patch antenna with a convenient tuning option. Antennas and Propagation, IEEE Transactions on. Nov. 1, 1996.

Borja , C. Antenas fractales microstrip. Universitat Politècnica de Catalunya. Jul. 1, 1997.

Borja , C. High directivity fractal boundary microstrip patch antenna. Electronic Letters. Apr. 27, 2000.

Borja , C. MSPK product. Fractus—Telefonica. Jan. 1, 1998.

Borja , C. Panel 01. Fractus—Telefonica. Jan. 1, 1998.

Borja , C. ; Puente , C. Iterative network models to predict the performance of Sierpinski fractal antennas and networks. Antennas and Propagation Society International Symposium, 1999. IEEE. Jul. 11, 1999.

Borowski , E. J. Dictionary of Mathematics. Collins—Case 6:09-cv-00203-LED-JDL. Jan. 1, 1989.

Boshoff, H. A fast box counting algorithm for determining the fractal dimension of sampled continuous functions. IEEE. Jan. 1, 1992.

Brown, A. A high-performance integrated K-band diplexer. Transactions on Microwave Theory and Techniques. Aug. 8, 1999.

Buczkowski , Stéphane ; Kyriacos , Soula ; Nekka , Fahima ; Cartilier , Louis. The modified box-countig method: analysis of some characteristic paramenters. Pattern Recognition. Apr. 20, 1998.

Burnett , G. F. Antenna installations on super constellation airbone early warning and control aircraft. Symposium on the USAF antenna research and development program, 4th. Oct. 17, 1954.

Bushman , F.W. The boeing B-52 all flush antenna system. Symposium on the USAF Antenna Reseach and Development Program, 5th. Oct. 16, 1955.

Campi , M. Design of microstrip linear array antennas. Antenna Applications Symposium. Aug. 8, 1981.

Campos, O. Study of multiband and miniature fractal antennas. Universitat Politècnica de Catalunya. Jan. 1, 1998.

Carpintero , F. Reply to the Written Opinion for the PCT patent application ES99/00296 dated Nov. 15, 2001—Declaration of J. Baxter—Exhibit FFF—Herrero & Asociados. dated Nov. 15, 2001.

Carpintero , F. Response to Office Action for EP patent application 00909089 dated Feb. 7, 2003. Herrero y Asociados. dated Aug. 14, 2003.

Carpintero , F. Written submissions for EP application 00909089. Herrero y Asociados. dated Dec. 15, 2004.

(56) References Cited

OTHER PUBLICATIONS

Carpintero, F. Statement setting out the Grounds of appeal for the EP patent application 05012854. Herrero y Asociados. dated Nov. 3, 2008.
Carver , K. R. et al. Microstrip antenna technology. Antennas and Propagation, IEEE Transactions on. Jan. 1, 1981.
Carver , K. R. et al. Microstrip antenna technology in "Microstrip antennas" to D.M. Pozar; IEEE Antennas and Propagation Society. Jan. 1, 1995.
Caswell , W. E. Invisible errors in dimensions calculations: geometric and systematic effects. Dimensions and Entropies in Chaotic Systems. Jan. 1, 1986.
Cetiner , B. A. et al. Reconfigurable miniature multielement antenna for wireless networking. IEEE Radio and Wireless Conference (RAWCON), Boston, Massachusetts, 2001. Aug. 19, 2001.
Chen , H. Dual frequency microstrip antenna with embedded reactive loading. Microwave and Optical Technology Letters. Nov. 5, 1999.
Chen , M.H. A compact EHF/SHF dual frequency antenna. IEEE International Symposium on Antennas and Propagation. May 7, 1990.
Chen , S. et al. On the calculation of Fractal features from images. IEEE Transactions on Pattern Analysis and Machine Intelligence. Oct. 1, 1993.
Chen , Wen-Shyang. Square-ring microstrip antenna with a cross strip for compact circular polarization operation. Antennas and Propagation, IEEE Transactions on. Oct. 1, 1999.
Chen , Z. N. Broadband probe-fed L-shaped plate antenna—Exhibit ZZ—Microwave and Optical Technology Letters. Aug. 5, 2000.
Chiba , N. et al. Dual frequency planar antenna for handsets. Electronic Letters. Dec. 10, 1998.
Cohen , N. Fractal element antennas. Journal of Electronic Defense. Jul. 1, 1997.
Cohen, N. Fractal antenna applications in wireless telecommunications. IEEE Electronic Industries Forum of New England. Professional Program Proceedings Boston. May 6, 1997.
Cohen, N. NEC4 analysis of a fractalized monofiliar helix in an axial mode ACES Conference Procedings. Apr. 1, 1998.
Cohn , S. B. Flush airborne radar antennas. Symposium on the USAF antenna research and development program, 3rd. Oct. 18, 1953.
Collier , C. P. Geometry for teachers. Waveland Press, Inc. Jan. 1, 1984.
Collier , D. ; Shnitkin , H. The monopole as a wideband array antenna element. Antenna Applications Symposium. Sep. 22, 1993.
Counter , V. A. Flush, re-entrant, impedance phased, circularly polarized cavity antenna for missiles. Symposium on the USAF antenna research and development program, 2nd. Oct. 19, 1952.
Counter , V. A. ; Margerum , D. L. Flush dielectric disc antenna for radar. Symposium on the USAF antenna research and development program, 2nd. Oct. 19, 1952.
Cristal , E. G. et al. Hairpin-line and hybrid hairpin-line / Half-wave parallel-coupled-line filers. Microwave Theory and Techniques, IEEE Transactions on. Nov. 1, 1972.
Daniel , A. E. ; Kumar , G. Rectangular microstrip antennas with stub along the non-radiating edge for dual band operation. IEEE Antennas and Propagation Society International Symposium Digest. Jun. 18, 1995.
Deng , Sheng-Ming. A t-strip loaded rectangular microstrip patch antenna for dual-frequency operation. Antennas and Propagation Society International Symposium, 1999. IEEE. Jul. 1, 1999.
Deschamps , G. Microstrip Microwave Antenna. Symposium on the USAF Antenna Research and Development Program. Oct. 18, 1953.
Dickstein , Harold D. Antenna system for a ground passive electronic reconnaissance facility. Symposium on the USAF Antenna Research and Development Program. Oct. 20, 1958.
Dou , W. Small broadband stacked planar monopole. Wiley InterScience. Nov. 20, 2000.
Drozd , J. M. et al. A capacitively loaded half-wavelength tapped-stub resonator. Microwave Theory and Techniques, IEEE Transactions on. Jul. 1, 1997.
Du Plessis , M. ; Cloete , J. H. Tuning stubs for microstrip patch antennas AP-S. Digest Antennas and Propagation Society International Symposium. Jun. 28, 1993.
Dubost , G. Wideband flat dipole and short-circuit microstrip patch elements and arrays. In Handbook of microstrip antennas—Chapter 7 Peter Peregrinus Ltd. James , J. R. ; Hall , P. S. (ed.). Jan. 1, 1989.
DuHamel , R. H. Broadband logarithmically periodic antenna structures. IRE International Convention Record. Mar. 14, 1957.
DuHamel , R. H. ; Scherer , J. P. Antenna engineering handbook—Chapter 14—Frequency-Independent Antennas. Johnson , R. McGraw-Hill (3rd. edition). Jan. 1, 1993.
Dyson , J. D. The equiangular spiral antenna. Antennas and Propagation, IRE Transactions on. Apr. 1, 1959.
Dyson , J. D. The non-planar equiangular spiral antenna. Symposium on the USAF Antenna Research and Development Program. Oct. 20, 1958.
Ellis , A. R. Airborne UHF antenna pattern improvements. Symposium on the USAF antenna research and development program, 3rd. Oct. 18, 1953.
Esteban , J. ; Rebollar , J. M. Design and optimization of a compact Ka-Band antenna diplexer AP-S. Digest Antennas and Propagation Society International Symposium. Jun. 18, 1995.
Falconer , K. Fractal geometry_Full. John Wiley Sons—2nd ed. Jan. 1, 2003.
Fanjul , J. International Preliminary Examination Report for application No. PCT/ES99/00296. EPO. dated Dec. 19, 2001.
Fayyaz , N. ; Safavi-Naeini , S. Bandwidth enhancement of a rectangular patch antenna by integrated reactive loading. Antennas and Propagation Society International Symposium, 1998. IEEE. Jun. 21, 1998.
Fayyaz , N. ; Shin , E. ; Safavi-Naeini , S. A novel dual band patch antenna for GSM band. Antennas and Propagation for Wireless Communications, 1998. 1998 IEEE—APS Conference on. Nov. 1, 1998.
Feder, J. Fractals Plenum Press. Jan. 1, 1988.
Felgel, F. W. Office Action for European patent application 00909089 dated Feb. 7, 2003. European Patent Office EPO. dated Feb. 7, 2003.
Felgel-Farnholz , W. D. International preliminary examination report of PCT/EP00/00411 dated Aug. 29, 2002—Notification concerning documents transmitted European Patent Office ( EPO ) dated Aug. 29, 2002.
Felgel-Farnholz , W. D. Invitation to restrict or to pay additional fees for the PCT patent EP00/00411 dated Mar. 5, 2002. International Preliminary Examination Authority—European Patent Office. dated Mar. 5, 2002.
Feng , J. Fractional box-counting approach to fractal dimension estimation. Pattern Recognition, 1996., Proceedings of the 13th International Conference on. Jan. 1, 1996.
Fenwick , R. C. A new class of electrically small antennas. Antennas and Propagation, IEEE Transactions on. May 1, 1965.
Ferris , J. E. A status report of an Azimuth and elevation direction finder. Symposium on the USAF Antenna Research and Development Program. Oct. 15, 1968.
Fleishmann , M. ; Tildesley , DJ ; Balls , RC Fractals in the natural sciences. Royal Society of London. Jan. 1, 1999.
Flom , M. Letter to FCC—Application form 731 and Engineering Test Report by Nokia Mobile Phones for FCC ID: LJPNPW-1NB M. Flom Associates—MFA. Mar. 12, 2001.
Flom , M. Letter to FCC—Communication of replacing employee. M. Flom Associates. May 23, 2000.
Flom , M. Letter to FCC—Nokia SAR Information. M. Flom Associates—MFA. May 19, 2000.
Flom , M. Letter to modify the Emission Designator. M. Flom Associates—MFA. Mar. 30, 2001.
Force, R. et al. Synthesis of multilayer walls for radomes of aerospace vehicles. Symposium on the USAF Antenna Research and Development Program. Nov. 14, 1967.

(56) References Cited

OTHER PUBLICATIONS

Foroutan-pour , K. ; Dutilleul , P. ; Smith , D.L. Advances in the implementation of the box-counting method of fractal dimension estimation. Applied Mathematics and Computation ; Elsevier. May 1, 1999.
Fractus. Response to Office Action for CN patent application 00818542 dated Nov. 5, 2004. China Council for the Promotion of International Trade Patent and Trademark Office. dated Mar. 31, 2005.
Garg , R. et al. Microstrip antenna design handbook. Artech House. Jan. 1, 2001.
Gilbert , R. ; Pirrung , A. ; Kopf , D. et al. Structurally-integrated optically-reconfigurable antenna array. Antenna Applications Symposium. Sep. 20, 1995.
Gillespie , E. S. Glide slope antenna in the nose radome of the F-104 A and B. Symposium on the USAF antenna research and development program, 7th. Oct. 21, 1957.
Gough , C. E. ; Porch , A. ; Lancaster , M. J. et al. High Tc coplanar resonators for microwave applications and scientific studies. Physica. Aug. 1, 1997.
Graf, R. Modern dictionary of electronics. Butterworth-Heinemann (6th Ed.). Jan. 1, 1984.
Graff , B. Form 731 Corrections: GMLNSW-4DX. M. Flom Associates—MFA. Apr. 24, 2000.
Graff , W. Letter to FCC—Test Report GMLNSW-4DX. M. Flom Associates—MFA. Mar. 17, 2000.
Gray, D. ; Lu , J. W. ; Thiel , D. V. Electronically steerable Yagi-Uda microstrip patch antenna array. IEEE Transactions on antennas and propagation. May 1, 1998.
Greiser , J. W. and Brown , G. S. A 500:1 scale model of warla : A wide aperture radio location array. Symposium on the USAF Antenna Research and Development Program, 13th. Oct. 14, 1963.
Guo , Y. X. ; Luk , K. F. Lee ; Chow , Y. L. Double U-slot rectangular patch antenna. Electronic Letters. Sep. 17, 1998.
Gupta , K. C. ; Benalla , A. Microstrip antenna design. Artech House. Jan. 1, 1988.
Gupta , K.C. Broadband techniques for microstrip patch antennas—a review. Antenna Applications Sysmposium. Sep. 21, 1988.
Hagström , P. Novel ceramic antenna filters for GSM / DECT and GSM / PCN network terminals. The 8th IEEE International Symposium on Personal, Indoor and Mobile Radio Communications, 1997. 'Waves of the Year 2000'. PIMRC '97. Sep. 1, 1997.
Zhang , S. Huff , G. ; Bernhard , T. Antenna efficiency and gain of two new compact microstrip antennas. Antenna Applications symposium, 2001. Sep. 19, 2001.
Halloran , T. W. A dual channel VHF telemetry antenna system for re-entry vehicle applications. Symposium on the USAF Antenna Research and Development Program, 11th. Oct. 16, 1961.
Hansen , R. C. Fundamental limitations in antennas. IEEE Proceedings. Feb. 1, 1981.
Hara Prasad , R. V. Microstrip fractal patch antenna for multiband communication. IEEE Electromagnetic Letters. Jul. 6, 2000.
Henderson West , B. The Prentice-Hall encyclopedia of mathematics. Prentice-Hall. Jan. 1, 1982.
Hikita , M. ; Shibagaki , N. ; Asal , K. et al. New miniature saw antenna duplexer used in GHz-band digital mobile cellular radios. IEEE Ultrasonics Symposium. Nov. 7, 1995.
Hikita , M. et al. Miniature SAW antenna duplexer for 800-Mhz portable telephone used in cellular radio systems. Microwave Theory and Techniques, IEEE Transactions on. Jun. 1, 1988.
Hill , J. E. ; Bass , J. F. An integrated strip-transmission-line antenna system for J-band. Symposium on the USAF Antenna Research and Development Program, 23th. Oct. 10, 1973.
Ho , Tan. Office Action of U.S. Appl. No. 11/124,768 dated Aug. 23, 2006. USPTO. dated Aug. 23, 2006.
Hofer , D. A. ; Kesler , Dr. O. B. ; Loyet , L. L. A compact multi-polarized broadband antenna. Proceedings of the 1989 antenna applications symposium. Sep. 20, 1989.
Hohlfeld , R. G. ; Cohen N. Self-similarity and the geometric requirements for frequency independence in antennae. Fractals. Jan. 17, 1999.
Holtum , A. G. A dual frequency dual polarized microwave antenna. Symposium on the USAF Antenna Research and Development Program, 16. Oct. 11, 1966.
Holzschuh , D. L. Hardened antennas for atlas and titan missile site communications. Symposium on the USAF Antenna Research and Development Program, 13th. Oct. 14, 1963.
Hong , J. S. ; Lancaster , J. Recent advances in microstrip filters for communications and other applications. IEE Colloquium on Advances in Passive Microwave Components (Digest No. 1997/154). May 22, 1997.
Hong , J. S. ; Lancaster , M. J. Compact microwave elliptic function filter using novel microstrip meander open-loop resonator.s Electronic Letters. Mar. 14, 1996.
Howe , M. Declaration of Micah Howe in support of Fractus SA opposition to defendants' motion for summary judgement of invalidity based on indefiniteness and lack of written description for certain terms Heim , Payne and Chorus LLP. Aug. 16, 2010.
Huynh , T. ; Lee , K. F. Single-layer single-patch wideband microstrip antenna. Electronic Letters. Aug. 3, 1995.
Hyneman , R. F. ; Mayes , P. E. ; Becker , R. C. Homing antennas for aircraft ( 450-2500 MC ). Symposium on the USAF antenna research and development program, 5th. Oct. 16, 1955.
Ikata , O. ; Satoh , Y. ; Uchishiba , H. et al. Development of small antenna duplexer using saw filters for handheld phones. IEEE Ultrasonics Symposium. Oct. 31, 1993.
Ingerson , P. G. ; Mayes , P. E. Asymmetrical feeders for log-periodic antennas. Symposium on the USAF antenna research and development program, 17th. Nov. 14, 1967.
Isbell , D. E. Multiple terminal log-periodic antennas. Symposium on the USAF antenna research and development program, 8th. Oct. 20, 1958.
Isbell , D. E. Non-planar logarithmically periodic antenna structures. Symposium on the USAF antenna research and development program, 7th. Oct. 21, 1957.
Ishikawa , Y. ; Hattori , J. ; Andoh , M. et al. 800 MHz High Power Bandpass Filter Using TM Dual Mode Dielectric Resonators. European Microwave Conference , 21th. Sep. 9, 1991.
Jaggard , D. Diffraction by Bandlimited Fractal Screens. Optical Society AM. Jun. 1, 1987.
Jaggard , D. L. Fractal electrodynamics and modeling. Directions in electromagnetic wave modeling. Jan. 1, 1991.
Jaggard , D. L. Rebuttal expert report of Dr. Dwight L. Jaggard (redacted version). Fractus. Feb. 16, 2011.
Johnson , R. C. Antenna engineering handbook—Table of contents. McGraw-Hill. Jan. 1, 1993.
Jones , H. S. Conformal and Small antenna designs. Proceedings of the Antennas Applications Symposium. Aug. 1, 1981.
Kandoian , Armig G. Three new antenna types and their applications. Proceedings of the IRE. Waves and electrons. Feb. 1, 1946.
Kobayashi , K. Estimation of 3D fractal dimension of real electrical tree patterns. Proceedings of the 4th International Conference on Properties and Applications of Dielectric Materials. Jul. 1, 1994.
Kraus , John D. Antennas. McGraw-Hill Book Company. Jan. 1, 1988.
Kraus , John D. Antennas—Chapter 2. McGraw-Hill Book Company. Jan. 1, 1988.
Kritikos , H.N. ; Jaggard , D.L. Recent advances in electromagnetic theory—Chapter 6. On fractal electrodynamics Springer—Verlag. Oct. 1, 1990.
Kuhlman , E. A. A directional flush mounted UHF communications antenna for high performance jet aircraft for the 225-400 MC frequency range. Symposium on the USAF Antenna Research and Development Program, 5th. Oct. 1, 1955.
Kumar , G. ; Gupta , K. Nonradiating edges and four edges gap-coupled multiple resonator broadband microstrip antennas. Antennas and Propagation, IEEE Transactions on. Feb. 1, 1985.
Kumar , G. ; Gupta , K. Directly coupled multiple resonator wide-band microstrip antennas. IEEE Transactions on Antennas and Propagation. Jun. 6, 1985.

(56) References Cited

OTHER PUBLICATIONS

Kuo , Sam. Frequency-independent log-periodic antenna arrays with increased directivity and gain. Symposium on USAF Antenna Research and Development, 21th Annual. Oct. 12, 1971.
Kurpis , G. P. The New IEEE standard dictionary of electrical and electronics terms. IEEE Standards. Jan. 1, 1993.
Kutter , R. E. Fractal antenna design. University of Dayton. Jan. 1, 1996.
Kyriacos , S. ; Buczkowski , S. et al. A modified box-counting method. Fractals—World Scientific Publishing Company. Jan. 1, 1994.
Lancaster , M. J. et al. Superconducting filters using slow-wave transmission lines. Advances in superconductivity. New materials, critical current and devices. Proceedings of the international symposium. New age int, New Delhi, India. Jan. 1, 1996.
Lancaster , M. J. et al. Miniature superconducting filters. Microwave Theory and Techniques, IEEE Transactions on. Jul. 1, 1996.
Larson , J. A BAW Antenna Duplexer for the 1900 MHz PCS Band. IEEE Ultrasonics Symposium. Oct. 17, 1999.
Lauwerier , H. Fractals. Endlessly repeated geometrical figures. Princeton University Press. Jan. 1, 1991.
Le , H. Office action for the U.S. Appl. No. 10/797,732 dated Aug. 9, 2007. USPTO. dated Aug. 9, 2007.
Lee , B. T. Office action for the U.S. Appl. No. 10/181,790 dated Aug. 27, 2004. USPTO. dated Aug. 27, 2004.
Lee , B. T. Office action for the U.S. Appl. No. 10/181,790 dated Jun. 2, 2005. USPTO. dated Jun. 2, 2005.
Lee , B. T. Response to office action for the U.S. Appl. No. 10/181,790 dated Aug. 27, 2004. USPTO. dated Dec. 8, 2004.
Lee , B.T. Office action for the U.S. Appl. No. 10/181,790 dated Mar. 2, 2005. USPTO. dated Mar. 2, 2005.
Lee , Benny T. Office action for the U.S. Appl. No. 10/181,790 dated Aug. 4, 2005. USPTO. dated Aug. 4, 2005.
Lee, J. C. Analysis of differential line lenght diplexers and long-stub filters. Symposium on the USAF Antenna Research and Development, 23th. Oct. 12, 1971.
Liu , D. A multi-branch monopole antenna for dual-band cellular applications. IEEE Antennas and Propagation Society International Symposium. Sep. 3, 1999.
Liu , Zi Dong ; Hall , Peter S. ; Wake , David. Dual-frequency planar inverted-f antenna. Antennas and Propagation, IEEE Transactions on. Oct. 1, 1997.
Lo , Y. T. ; Solomon , D. ; Richards , W. F. Theory and experiment on microstrip antennas. Antenna Applications Symposium. Sep. 20, 1978.
Locus , Stanley S. Antenna design for high performance missile environment. Symposium on the USAF Antenna Research and Development Program, 5th. Oct. 16, 1955.
Long , S. A. Rebuttal expert report of Dr. Stuart A. Long (redacted version). Fractus. Feb. 16, 2011.
Love , J. D. Memorandum opinion and order—Document 582. Court. Jan. 20, 2011.
Love , J. D. Memorandum order and opinion—Document 526. Court. Dec. 17, 2010.
Love , John D. Court Order. Provisional claim construction and motion for summary judgement. Provisional markman order—Document 475. Court. Nov. 9, 2010.
Lu , J. H. ; Wong , K. L. Dual-frequency rectangular microstrip antenna with embedded spur lines and integrated reactive loading. Microwave and Optical Technology Letters. May 20, 1999.
Lu , J.H. ; Tang , C. L. ; Wong , K. L. Novel dual-frequency and broad-band designs of slot-loaded equilateral triangular microstrip antennas. IEEE Transactions on Antennas and Propagation. Jul. 1, 2000.
Lu , Jui-Han. Single-feed dual-frequency rectangular microstrip antenna. Antennas and Propagation Society International Symposium, 2000. IEEE. Jul. 1, 2000.
Lu , Jui-Han ; Tang , Chia-Luan ; Wong , Kin-Lu. Single-feed slotted equilateral triangular microstrip antenna for circular polarization. Antennas and Propagation, IEEE Transactions on. Jul. 1, 1999.
Lu , Jui-Han et al. Slot-loaded, Meandered Rectangular Microstrip Antenna With Compact Dualfrequency Operation. IEEE Electronics Letters. May 28, 1998.
Lyon , J. ; Rassweiler , G. ; Chen , C. Ferrite-loading effects on helical and spiral antennas. 15th Annual Symposium on the USAF antenna reserach and development program. Oct. 12, 1965.
Maci , S. et al. Dual-band Slot-loaded patch antenna. IEE Proceedings Microwave Antennas Propagation. Jun. 1, 1995.
Maci , S. et al. Dual-frequency patch antennas. Antennas and Propagation Magazine, IEEE. Dec. 1, 1997.
Maiorana , D. Amendment and response to the Office Action dated Jan. 23, 2004 of U.S. Appl. No. 10/102,568. Jones Day. dated May 26, 2004.
Mandelbrot , B. B. Opinions (Benoit B. Mandelbrot). World Scientific Publishing Company—Case 6:09-cv-00203-LED-JDL. Jan. 1, 1993.
Mandelbrot, B. The fractal geometry of nature. Freeman and Company. Jan. 1, 1982.
Manteuffel , Dirk et al. Design considerations for integrated mobile phone antennas. IEEE Antennas and Propagation, 2001. Eleventh International Conference on (IEE Conf. Publ. No. 480). Apr. 17, 2001.
Martin , R. W. ; Stangel , J. J. An unfurlable, high-gain log-periodic antenna for space use. Symposium on the USAF Antenna Research and Development Program. Nov. 14, 1967.
Martin, W. R. Flush vor antenna for c-121 aircraft. Symposium on the USAF Antenna Research and Development Program, 2nd. Oct. 19, 1952.
Martinez Vicioso , José Luis. Improving the multiband behaviour of the Sierpinski patch. Univeristat Politécnica de Catalunya. Dec. 1, 2000.
Matthaei , George L. Microwave filters impedance-matching networks and coupling structures. Artech House. Jan. 1, 1980.
Matthaei , George L. et al. Hairpin-comb filters for HTS and other narrow-band applications. Microwave Theory and Techniques, IEEE Transactions on. Aug. 1, 1997.
May , M. Aerial magic. New Scientist. Jan. 31, 1998.
Mayes , P. Some broadband , low-profile antennas. Antenna Applications Symposium. Sep. 18, 1985.
Mayes , P. E. High gain log-periodic antennas. Symposium on the USAF antenna research and development program, 10th. Oct. 3, 1960.
Mayes , P.E. Multi-arm logarithmic spiral antennas. Symposium on the USAF Antenna Research and Development Program, 10th. Oct. 3, 1960.
McCormick , J. A Low-profile electrically small VHF antenna. 15th Annual Symposium on the USAF antenna reserach and development program. Oct. 12, 1965.
McDowell , E. P. Flush mounted X-band beacon antennas for aircraft. Symposium on USAF antenna Research and Development, 3th. Oct. 18, 1953.
McDowell , E. P. High speed aircraft antenna problems and some specific solutions for MX-1554. Symposium on the USAF Antenna Research and Development Program, 2nd. Oct. 19, 1952.
McSpadden , J. O. Design and experiments of a high-conversion-efficiency 5.8-GHz rectenna. IEEE Transactions on Microwave Theory and Techniques. Dec. 1, 1998.
Mehaute, A. Fractal Geometrics. CRC Press—Case 6:09-cv-00203-LED-JDL. Jan. 1, 1990.
Meier , K. ; Burkhard , M. ; Schmid , T. et al. Broadband calibration of E-field probes in Lossy Media. IEEE Transactions on Microwave Theory and Techniques. Oct. 1, 1996.
Meinke , H. ; Gundlah , F. V. Radio engineering reference book—vol. 1—Radio components. Circuits with lumped parameters . . . State energy publishing house. Jan. 1, 1961.
Menefee , J. Office Action for the U.S. patent reexamination 95/001390 dated Aug. 12, 2010. USPTO. dated Aug. 12, 2010.
Menefee , J. Office Action of U.S. Appl. No. 95/001,461 dated Nov. 19, 2010. USPTO. dated Nov. 19, 2010.

(56) References Cited

OTHER PUBLICATIONS

Menefee , James. Office Action for the U.S. Appl. No. 95/001,389 dated Aug. 12, 2010. USPTO. dated Aug. 12, 2010.
Misra , S. Experimental investigations on the impedance and radiation properties of a three-element concentric microstrip square-ring antenna. Microwave and Optical TEchnology Letters. Feb. 5, 1996.
Misra , S. ; Chowdhury , S. K. Study of impedance and radiation properties of a concentric microstrip triangular-ring antenna and Its modeling techniques using FDTD method. IEEE Transactions on Antennas and Propagation. Apr. 1, 1998.
Mithani , S. Response to the Office Action dated Mar. 12, 2007 of U.S. Appl. No. 11/021,597. Winstead. dated Aug. 9, 2007.
Moheb , H. Design and development of co-polarized ku-band ground terminal system for very small aperture terminal (VSAT) application. IEEE International Symposium on Antennas and Propagation Digest. Jul. 11, 1999.
Moore , S. Response to Office Action dated Feb. 7, 2006 of U.S. Appl. No. 11/033,788. Jenkens & Gilchrist. dated Jun. 1, 2006.
Munson , R. Antenna Engineering Handbook—Chapter 7—Microstrip Antennas Johnson , R. C.—McGraw-Hill—Third Edition. Jan. 1, 1993.
Munson , R. Conformal microstrip array for a parabolic dish. Symposium on the USAF Antenna Research and Development Program. Oct. 1, 1973.
Munson , R. Microstrip phased array antennas. Symposium on the USAF Antenna Research and Development Program, 22th. Oct. 11, 1972.
Munson , R. E. Conformal microstrip communication antenna. Symposium on USAF antenna Research and Development, 23th. Oct. 10, 1973.
Mushiake, Yasuto. Self-Complementary Antennas : Principle of Self Complementarity for Constant Impedance. Springer-Verlag. Jan. 1, 1996.
Myrskog , M. Letter to FCC—Letter that will authorize the appointment of MORTON FLOM Eng and/or FLOMAssociates Inc to act as their Agent in all FCC matters. Nokia Mobile Phones. Sep. 14, 2000.
NA. Amended answer of the Sharp defendants to plaintiff's second amended complaint. Defendants. Feb. 24, 2010.
NA. Amended complaint for patent infringement—Case 6:09-cv-00203. Fractus. May 6, 2009.
NA. American Heritage College Dictionary (1997). pp. 340 and 1016. Mifflin Comp. Case 6:09-cv-00203-LED-JDL. Jan. 1, 1997.
NA. American Heritage Dictionary of the English Language. Houghton Mifflin Company. Jan. 1, 2000.
NA. Answer of the Sharp Defendants to plaintiff's second amended complaint. Defendants. Dec. 29, 2009.
NA. Answer, affirmative defenses and counterclaims to the amended complaint for patent infringement on behalf of Defendant Personal Communications Devices Holdings, LLC. Defendants. Jul. 20, 2009.
NA. Answer, affirmative defenses and counterclaims to the second amended complaint for patent infringement on behalf of Defendant Personal Communications Devices Holdings, LLC. Defendants. Dec. 17, 2009.
NA. Civil cover sheet—Case 6:09-cv-00203. Fractus. May 5, 2009.
NA. Claims for the EP patent 00909089. Herrero y Asociados. dated Jan. 28, 2005.
NA. Collins Dictionary. Collins. Jan. 1, 1979.
NA. Complaint for patent infringement—Case 6:09-cv-00203. Fractus. May 5, 2009.
NA. Declaration of Jeffery Baxter including exhibits WW, BBB, EEE, GGG, HHH, III, KKK, MMM, NNN, OOO, PPP, QQQ, RRR, TTT, UUU, VVV, WWW, YYY, ZZZ, AAAA, BBBB. Defendants. Aug. 30, 2010.
NA. Declaration of Jeffery D. Baxter including exhibits J, L, M, N, O, P, Q, R, S, T, U, Z, AA, KK, LL. Defendants. Jul. 30, 2010.
NA. Declaration of Thomas E. Nelson—Exhibit A—Antenna photos. Defendants. Feb. 3, 2011.
NA. Defendant's notice of compliance regarding second amended invalidity contentions. Defendants. Jan. 21, 2011.
NA. Defendant's reply in support of their motion for summary judgment of invalidity based on indefiniteness and lack of written description for certain terms. Defendants. Aug. 30, 2010.
NA. Defendant HTC America Inc's answer and counterclaim to plaintiff's amended complaint—Document 176. Defendants. Sep. 25, 2009.
NA. Defendant HTC America, Inc's first amended answer and counterclaims to plaintiff's amended complaint—Document 191. Defendants. Oct. 2, 2009.
NA. Defendant HTC America, Inc's answer and counterclaims to plaintiff's second amended complaint—Documents 238. Defendants. Dec. 21, 2009.
NA. Defendant HTC America, Inc.'s amended answer and counterclaim to plaintiff's second amended complaint—Document 290. Defendants. Feb. 24, 2010.
NA. Defendant HTC America, Inc.'s amended answer and counterclaim to plaintiff's second amended complaint—Document 298. Defendants. Feb. 25, 2010.
NA. Defendant HTC Corporation's amended answer and counterclaim to plaintiff's second amended complaint—Document 175. Defendants. Sep. 25, 2009.
NA. Defendant HTC Corporation's amended answer and counterclaim to plaintiff's second amended complaint—Document 291. Defendants. Feb. 24, 2010.
NA. Defendant HTC Corporation's amended answer and counterclaim to plaintiff's second amended complaint—Document 297. Defendants. Feb. 25, 2010.
NA. Defendant HTC Corporation's answer and counterclaims to plaintiff's second amended complaint—Document 239. Defendants. Dec. 21, 2009.
NA. Defendant HTC Corporation's First amended answer and counterclaim to plaintiff's amended complaint. Defendants. Oct. 2, 2009.
NA. Defendant Pantech Wireless Inc amended answer, affirmative defenses, and counterclaims to Fractus' second amended complaint. Defendants. Feb. 28, 2011.
NA. Defendant Pantech Wireless, Inc's answer, affirmative defenses and counterclaims to Fractus SA's second amended complaint—Document 242. Defendants. Dec. 21, 2009.
NA. Defendant Pantech Wireless, Inc.'s answer, affirmative defenses and counterclaims to Fractus SA's Amended complaint—Document 64. Defendants. Jun. 4, 2009.
NA. Defendant Research in Motion LTD and Research in Motion Corporation's second answer, defenses and counterclaims to plaintiff's second amended complaint—Document 241. Defendants. Dec. 21, 2009.
NA. Defendant Sanyo Electric Co. LTD's answer to second amended complaint for patent infringement. Defendants. Dec. 22, 2009.
NA. Defendant Sanyo North America Corporation's answer to second amended complaint for patent infringement. Defendants. Dec. 22, 2009.
NA. Defendant Sanyo North America Corporation's partial answer to amended complaint for patent infringement. Defendants Jul. 20, 2009.
NA. Defendant UTStarcom, Inc's answer affirmative defenses and counterclaims to plaintiff's amended complaint. Defendants. Jun. 8, 2009.
NA. Defendant UTStarcom, Inc's answer, affirmative defenses and counterclaims to Fractus SA's second amended complaint. Defendants. Dec. 22, 2009.
NA. Defendants' invalidity contentions including appendix C and exhibits 8, 10, 11 referenced Loaded Antenna patent. Defendants. Feb. 24, 2010.
NA. Defendants' LG Electronics Inc, LG Electronics USA, and LG Electronics Mobilecomm USA Inc's second amended answer and counterclaim to second amended complaint. Defendants. Feb. 28, 2011.
NA. Defendants LG Electronics Inc., LG Electronics USA, Inc., and LG Electronics Mobilecomm USA Inc. answer and counterclaim to amended complaint. Defendants. Oct. 1, 2009.

(56) References Cited

OTHER PUBLICATIONS

NA. Defendants LG Electronics Inc., LG Electronics USA, Inc., and LG Electronics Mobilecomm USA Inc. answer and counterclaim to second amended complaint. Defendants. Dec. 28, 2009.
NA. Defendants LG Electronics Inc., LG Electronics USA, Inc., and LG Electronics Mobilecomm USA Inc. First amended answer and counterclaim to second amended complaint. Defendants. Feb. 24, 2010.
NA. Defendants LG Electronics Mobilecomm USA., Inc.'s answer and counterclaim to complaint. Defendants. Oct. 1, 2009.
NA. Defendants Research in Motion LTD, and Research in Motion Corporation's amended answer, defenses and counterclaims to plaintiff's amended complaint. Defendants. Nov. 24, 2009.
NA. Defendants Research in Motion LTD, and Research in Motion Corporation's answers, defenses and counterclaims to plaintiff's amended complaint. Defendants. Oct. 1, 2009.
NA. Defendants RIM, Samsung, HTC, LG and Pantech's response to plaintiff Fractus SA's opening claim construction brief in Case 6:09-cv-00203-LED-JDL. Defendants. Jul. 30, 2010.
NA. Defendants RIM, Samsung, HTC, LG and Pantech's response to plaintiff Fractus SA's opening claim construction brief in Case 6:09-cv-00203-LED-JDL—Exhibit 33—Excerpt from Plaintiff's '868 pat. inf. cont. for Samsung SPH M540. Defendants. Jul. 30, 2010.
NA. Defendants RIM, Samsung, HTC, LG and Pantech's response to plaintiff Fractus SA's opening claim construction brief in Case 6:09-cv-00203-LED-JDL—Exhibit 34—Excerpts from Plaintiff's '431 patent Infringement Contentions of HTC Diamond. Defendants. Jul. 30, 2010.
NA. Defendants RIM, Samsung, HTC, LG and Pantech's response to plaintiff Fractus SA's opening claim construction brief in Case 6:09-cv-00203-LED-JDL—Exhibit 41—Demonstrative re: counting segments. Defendants. Jul. 30, 2010.
NA. Defendants RIM, Samsung, HTC, LG and Pantech's response to plaintiff Fractus SA's opening claim construction brief in Case 6:09-cv-00203-LED-JDL—Exhibit 42—Demonstrative showing how straight segments can be fitted over a curved surface. Defendants. Jul. 30, 2010.
NA. Defendants RIM, Samsung, HTC, LG and Pantech's response to plaintiff Fractus SA's opening claim construction brief in Case 6:09-cv-00203-LED-JDL—Exhibit 57—Excerpts from Plaintiff's '868 and '762 Pat. Infr. cont. for RIM 8310. Defendants. Jul. 30, 2010.
NA. Defendants RIM, Samsung, HTC, LG and Pantech's response to plaintiff Fractus SA's opening claim construction brief in "Case 6:09-cv-00203-LED-JDL"—Exhibit 1—Chart of Agreed Terms and Disputed Terms. Defendants. Jul. 30, 2010.
NA. Defendants RIM, Samsung, HTC, LG and Pantech's response to plaintiff Fractus SA's opening claim construction brief in "Case 6:09-cv-00203-LED-JDL"—Exhibit 2—Family Tree of Asserted Patents. Defendants. Jul. 30, 2010.
NA. Defendants Samsung Electronics Co LTD (et al) second amended answer and counterclaims to the second amended complaint of plaintiff Fractus SA. Defendants. Feb. 28, 2011.
NA. Defendants Samsung Electronics Co., Ltd.'s; Samsung Electronics Research Institute's and Samsung Semiconductor Europe GMBH's answer; and Samsung Telecommunications America LLC's answer and counterclaim to the amended complaint of plaintif. Defendants. Oct. 1, 2009.
NA. Defendants Samsung Electronics Co., Ltd.'s; Samsung Electronics Research Institute's and Samsung Semiconductor Europe GMBH's first amended answer; and Samsung Telecommunications America LLC's first amended answer—Document 287. Defendants. Feb. 24, 2010.
NA. Defendants Samsung Electronics Co., Ltd.'s; Samsung Electronics Research Institute's and Samsung Semiconductor Europe GMBH's first amended answer; and Samsung Telecommunications America LLC's first amended answer and—Document 250. Defendants. Dec. 23, 2009.
NA. Digital cellular telecommunications system (Phase 2) : Types of Mobile Stations (MX) (GSM 02.06). ETSI. May 9, 1996.
NA. Digital cellular telecommunications system (Phase 2+) ; Radio transmission and reception (GSM 05.05). ETSI. Jul. 1, 1996.
NA. Digital cellular telecommunications system (Phase2) : Abbreviations and acronyms (GSM01.04) GSM Technical Specification vs. 5.0.0. ETSI. Mar. 1, 1996.
NA. Digital cellular telecommunications system (Phase2). Mobile Station MS Conformance specifiaction Part 1 Conformance Specification GSM11.10-1). ETSI. Mar. 1, 1996.
NA. Digital cellular telecommunications system (Phase2); Mobile Station (MS) conformance specification; Part 1: Conformance specification (GSM 11.10-1 version 4.21.1). ETSI. Aug. 1, 1998.
NA. European Patent Convention—Article 123—Declaration of Jeffery D. Baxter—Exhibit JJJ. European Patent Office. Jan. 1, 2000.
NA. Expert declaration by Dr. D. Jaggard including exhibits (curriculum and datasheets from Cushcraft, Antenova, Ethertronics and Taoglas). Fractus. Aug. 16, 2010.
NA. FractalComs web—www.tsc.upc.es/fractalcoms/. Univeritat Politecnica de Catalunya.
NA. Fractus' Claim Construction Presentation—Markman Hearing—*Fractus* v. *Samsung et al.* 609-cv-00203 Sep. 2, 2010. Fractus. Sep. 2, 2010.
NA. Fractus' reply to defendant's motion for reconsideration of, and objections to, magistrate Judge Love's markman order—Document 609. Fractus. Feb. 4, 2011.
NA. Fractus's opposition to defendants' motion for summary judgement of invalidity based on indefiniteness and lack of written description for certain terms. Fractus. Aug. 16, 2010.
NA. Fractus's Objections to claim construction memorandum and order. Document 575. Fractus. Jan. 14, 2011.
NA. Fractus SA's opening claim construction brief—Exhibit 2—Parties' Agreed Constructions. Fractus. Jul. 16, 2010.
NA. Fractus SA's opening claim construction brief—Letter. Fractus—Case 6:09-cv-00203-LED-JDL. Jul. 16, 2010.
NA. Fractus SA's opening claim construction brief,—Exhibit 1—Parties' Proposed Constructions—Case 6:09-cv-00203-LED-JDL. Fractus. Jul. 16, 2010.
NA. *Fractus* vs. *Samsung et al.* Claim construction and motion for summary judgement—Markman Hearing—[Defendants]. Defendants. Sep. 2, 2010.
NA. Fractus web—www.fractus.com/main/fractus/corporate/. Fractus SA. Oct. 7, 2010.
NA. GSM Technical specification and related materials. ETSI. Mar. 1, 1996.
NA. Hagenuk mobile phone—Antenna photo—Technical specs—User manual. Hagenuk Telecom GmbH. Jan. 1, 1996.
NA. IEEE Standard definitions of terms for antennas, IEEE Std. 145-1983. Antenna Standards Committee of the IEEE Antennas and Propagation Group, USA; Jun. 22, 1983.
NA. IEEE Standard Definitions of Terms for Antennas, IEEE Std. 145-1993 (1993). The Institute of Electrical and Electronics Engineers—Case 6:09-cv-00203-LED-JDL. Mar. 18, 1993.
NA. IEEE Standard Dictionary of Electrical and Electronics Terms. IEEE Press (6th ed.). Jan. 1, 1996.
NA. IEEE Standard dictionary of electrical and electronics terms. IEEE Standard (6th ed.). Jan. 1, 1996.
NA. Infringement Chart—Blackberry 8100. U.S. Pat. No. 7,312,762. Fractus. Nov. 5, 2009.
NA Infringement Chart—Blackberry 8110. U.S. Pat. No. 7,312,762 Fractus Nov. 5, 2009.
NA Infringement Chart—Blackberry 8120. U.S. Pat. No. 7,312,762 Fractus Nov. 5, 2009.
NA Infringement Chart—Blackberry 8130. U.S. Pat. No. 7,312,762 Fractus Nov. 5, 2009.
NA Infringement Chart—Blackberry 8310. U.S. Pat. No. 7,312,762 Fractus Nov. 5, 2009.
NA Infringement Chart—Blackberry 8320. U.S. Pat. No. 7,312,762 Fractus Nov. 5, 2009.
NA Infringement Chart—Blackberry 8330. U.S. Pat. No. 7,312,762 Fractus Nov. 5, 2009.

(56) References Cited

OTHER PUBLICATIONS

NA Infringement Chart—Blackberry 8820. U.S. Pat. No. 7,312,762 Fractus Nov. 5, 2009.
NA Infringement Chart—Blackberry 8830. U.S. Pat. No. 7,312,762 Fractus Nov. 5, 2009.
NA Infringement Chart—Blackberry Bold 9000. U.S. Pat. No. 7,312,762 Fractus Nov. 5, 2009.
NA Infringement Chart—Blackberry Storm 9530. U.S. Pat. No. 7,312,762 Fractus Nov. 5, 2009.
NA Infringement Chart—HTC My Touch, Fractus Nov. 5, 2009.
NA Infringement Chart—HTC MyTouch. U.S. Pat. No. 7,312,762 Fractus Nov. 6, 2009.
NA Infringement Chart—HTC Ozone Fractus Nov. 5, 2009.
NA Infringement Chart—HTC Ozone. U.S. Pat. No. 7,312,762 Fractus Nov. 6, 2009.
NA Infringement Chart—HTC Pure Fractus Nov. 5, 2009.
NA Infringement Chart—HTC Pure. U.S. Pat. No. 7,312,762 Fractus Nov. 6, 2009.
NA Infringement Chart—HTC Touch Pro 2 Fractus Nov. 5, 2009.
NA Infringement Chart—HTC Touch Pro 2. U.S. Pat. No. 7,312,762 Fractus Nov. 6, 2009.
NA Infringement Chart—HTC Touch Pro Fuze Fractus Nov. 5, 2009.
NA Infringement Chart—HTC Touch Pro Fuze. U.S. Pat. No. 7,312,762 Fractus Nov. 6, 2009.
NA Infringement Chart—HTC Touch Pro. Fractus Nov. 5, 2009.
NA Infringement Chart—HTC Touch Pro. U.S. Pat. No. 7,312,762 Fractus Nov. 5, 2009.
NA Infringement Chart—Kyocera Jax Fractus Nov. 5, 2009.
NA Infringement Chart—Kyocera Jax. U.S. Pat. No. 7,312,762 Fractus Nov. 5, 2009.
NA Infringement Chart—Kyocera MARBL Fractus Nov. 5, 2009.
NA Infringement Chart—Kyocera MARBL. U.S. Pat. No. 7,312,762 Fractus Nov. 5, 2009.
NA Infringement Chart—Kyocera S2400 Fractus Nov. 5, 2009.
NA Infringement Chart—Kyocera S2400. U.S. Pat. No. 7,312,762 Fractus Nov. 5, 2009.
NA Infringement Chart—Kyocera Wildcard M1000 Fractus Nov. 5, 2009.
NA Infringement Chart—Kyocera Wildcard M1000. U.S. Pat. No. 7,312,762 Fractus Nov. 5, 2009.
NA Infringement Chart—LG 300G. Fractus Nov. 5, 2009.
NA Infringement Chart—LG 300G. U.S. Pat. No. 7,312,762 Fractus Nov. 5, 2009.
NA Infringement Chart—LG Aloha LX 140. U.S. Pat. No. 7,312,762 Fractus Nov. 5, 2009.
NA Infringement Chart—LG Aloha LX140. Fractus Nov. 5, 2009.
NA Infringement Chart—LG AX155. Fractus Nov. 5, 2009.
NA Infringement Chart—LG AX155. U.S. Pat. No. 7,312,762 Fractus Nov. 5, 2009.
NA Infringement Chart—LG AX585. Fractus Nov. 5, 2009.
NA Infringement Chart—LG AX585. U.S. Pat. No. 7,312,762 Fractus Nov. 5, 2009.
NA Infringement Chart—LG AX8600 Fractus Nov. 5, 2009.
NA Infringement Chart—LG AX8600. U.S. Pat. No. 7,312,762 Fractus Nov. 5, 2009.
NA Infringement Chart—LG CF360. Fractus Nov. 5, 2009.
NA Infringement Chart—LG CF360. U.S. Pat. No. 7,312,762 Fractus Nov. 5, 2009.
NA Infringement Chart—LG Chocolate VX8550 Fractus Nov. 5, 2009.
NA Infringement Chart—LG Chocolate VX8550. U.S. Pat. No. 7,312,762 Fractus Nov. 5, 2009.
NA Infringement Chart—LG enV Touch VX1100. Fractus Nov. 5, 2009.
NA Infringement Chart—LG enV Touch VX1100. U.S. Pat. No. 7,312,762 Fractus Nov. 5, 2009.
NA Infringement Chart—LG EnV2 VX9100 Fractus Nov. 5, 2009.
NA Infringement Chart—LG EnV2 VX9100. U.S. Pat. No. 7,312,762 Fractus Nov. 5, 2009.
NA Infringement Chart—LG EnV3 VX9200. Fractus Nov. 5, 2009.
NA Infringement Chart—LG EnV3 VX9200. U.S. Pat. No. 7,312,762 Fractus Nov. 5, 2009.
NA Infringement Chart—LG Flare LX165 Fractus Nov. 5, 2009.
NA Infringement Chart—LG Flare LX165. U.S. Pat. No. 7,312,762 Fractus Nov. 5, 2009.
NA Infringement Chart—LG GT365 NEON. Fractus Nov. 5, 2009.
NA Infringement Chart—LG GT365 NEON. U.S. Pat. No. 7,312,762 Fractus Nov. 5, 2009.
NA Infringement Chart—LG Lotus Fractus Nov. 5, 2009.
NA Infringement Chart—LG Lotus. U.S. Pat. No. 7,312,762 Fractus Nov. 5, 2009.
NA Infringement Chart—LG Rumor Fractus Nov. 5, 2009.
NA Infringement Chart—LG Rumor 2. Fractus Nov. 5, 2009.
NA Infringement Chart—LG Rumor 2. U.S. Pat. No. 7,312,762 Fractus Nov. 5, 2009.
NA Infringement Chart—LG Rumor. U.S. Pat. No. 7,312,762 Fractus Nov. 5, 2009.
NA Infringement Chart—LG UX280 Fractus Nov. 5, 2009.
NA Infringement Chart—LG UX280. U.S. Pat. No. 7,312,762 Fractus Nov. 5, 2009.
NA Infringement Chart—LG Versa VX9600 Fractus Nov. 5, 2009.
NA Infringement Chart—LG Versa VX9600. U.S. Pat. No. 7,312,762 Fractus Nov. 5, 2009.
NA Infringement Chart—LG VX5400 Fractus Nov. 5, 2009.
NA Infringement Chart—LG VX5400. U.S. Pat. No. 7,312,762 Fractus Nov. 5, 2009.
NA Infringement Chart—LG VX5500 Fractus Nov. 5, 2009.
NA Infringement Chart—LG VX5500. U.S. Pat. No. 7,312,762 Fractus Nov. 5, 2009.
NA Infringement Chart—LG VX8350 Fractus Nov. 5, 2009.
NA Infringement Chart—LG VX8350. U.S. Pat. No. 7,312,762 Fractus Nov. 5, 2009.
NA Infringement Chart—LG VX8360. Fractus Nov. 5, 2009.
NA Infringement Chart—LG VX8360. U.S. Pat. No. 7,312,762 Fractus Nov. 5, 2009.
NA Infringement Chart—LG VX8560 Chocolate 3 Fractus Nov. 5, 2009.
NA Infringement Chart—LG VX8560 Chocolate 3. U.S. Pat. No. 7,312,762 Fractus Nov. 5, 2009.
Yang , Kai-Ping. Compact dual-frequency operation of rectangular microstrip antennas—Antennas and Propagation Society International Symposium, 1999. IEEE. Jul. 1, 1999.
Zhang , Dawei ; Liang , G.C. ; Shih , C.F. Narrowband lumped element microstrip filters using capacitively loaded inductors Microwave Symposium Digest, 1995., IEEE MTT-S International. May 16, 1995.
NA Infringement Chart—LG VX9400 Fractus Nov. 5, 2009.
NA Infringement Chart—LG VX9400. U.S. Pat. No. 7,312,762 Fractus Nov. 5, 2009.
NA Infringement Chart—Palm Centro 685 Fractus Nov. 5, 2009.
NA Infringement Chart—Palm Centro 685. U.S. Pat. No. 7,312,762 Fractus Nov. 5, 2009.
NA Infringement Chart—Palm Centro 690 Fractus Nov. 5, 2009.
NA Infringement Chart—Palm Centro 690. U.S. Pat. No. 7,312,762 Fractus Nov. 5, 2009.
NA Infringement Chart—Palm Pre Fractus Nov. 5, 2009.
NA Infringement Chart—Palm Pre. U.S. Pat. No. 7,312,762 Fractus Nov. 5, 2009.
NA Infringement Chart—Pantech Breeze C520. Fractus Nov. 5, 2009.
NA Infringement Chart—Pantech Breeze C520. U.S. Pat. No. 7,312,762 Fractus Nov. 5, 2009.
NA Infringement Chart—Pantech C740 Fractus Nov. 5, 2009.
NA Infringement Chart—Pantech C740. U.S. Pat. No. 7,312,762 Fractus Nov. 5, 2009.
NA Infringement Chart—Pantech DUO C810. Fractus Nov. 5, 2009.
NA Infringement Chart—Pantech DUO C810. U.S. Pat. No. 7,312,762 Fractus Nov. 5, 2009.
NA Infringement Chart—RIM Blackberry 8110 Fractus Nov. 5, 2009.

(56) References Cited

OTHER PUBLICATIONS

NA Infringement Chart—RIM Blackberry 8120 Fractus Nov. 5, 2009.
NA Infringement Chart—RIM Blackberry 8130 Fractus Nov. 5, 2009.
NA Infringement Chart—RIM Blackberry 8310 Fractus Nov. 5, 2009.
NA Infringement Chart—RIM Blackberry 8320 Fractus Nov. 5, 2009.
NA Infringement Chart—RIM Blackberry 8330 Fractus Nov. 5, 2009.
NA Infringement Chart—RIM Blackberry 8820 Fractus Nov. 5, 2009.
NA Infringement Chart—RIM Blackberry 8830 Fractus Nov. 5, 2009.
NA Infringement Chart—RIM Blackberry Bold 9000. Fractus Nov. 5, 2009.
NA Infringement Chart—RIM Blackberry Pearl 8100 Fractus Nov. 5, 2009.
NA Infringement Chart—RIM Blackberry Storm 9530. Fractus Nov. 5, 2009.
NA Infringement Chart—Samsung Blast SGH-T729. U.S. Pat. No. 7,312,762 Fractus Nov. 5, 2009.
NA Infringement Chart—Samsung Blast SGH T729 Fractus Nov. 5, 2009.
NA Infringement Chart—Samsung Instinct M800 Fractus Nov. 5, 2009.
NA Infringement Chart—Samsung Instinct M800. U.S. Pat. No. 7,312,762 Fractus Nov. 5, 2009.
NA Infringement Chart—Samsung M320 Fractus Nov. 5, 2009.
NA Infringement Chart—Samsung M320. U.S. Pat. No. 7,312,762 Fractus Nov. 5, 2009.
NA Infringement Chart—Samsung Messager Fractus Nov. 5, 2009.
NA Infringement Chart—Samsung Messager. U.S. Pat. No. 7,312,762 Fractus Nov. 5, 2009.
NA Infringement Chart—Samsung SCH-A630 Fractus Nov. 5, 2009.
NA Infringement Chart—Samsung SCH-A630. U.S. Pat. No. 7,312,762 Fractus Nov. 5, 2009.
NA Infringement Chart—Samsung SCH-A645 Fractus Nov. 5, 2009.
NA Infringement Chart—Samsung SCH-A645. U.S. Pat. No. 7,312,762 Fractus Nov. 5, 2009.
NA Infringement Chart—Samsung SCH-A870 Fractus Nov. 5, 2009.
NA Infringement Chart—Samsung SCH-A870. U.S. Pat. No. 7,312,762 Fractus Nov. 5, 2009.
NA Infringement Chart—Samsung SCH-R430 Fractus Nov. 5, 2009.
NA Infringement Chart—Samsung SCH-R430. U.S. Pat. No. 7,312,762 Fractus Nov. 5, 2009.
NA Infringement Chart—Samsung SCH-R500. Fractus Nov. 5, 2009.
NA Infringement Chart—Samsung SCH-R500. U.S. Pat. No. 7,312,762 Fractus Nov. 5, 2009.
NA Infringement Chart—Samsung SCH-R600 Fractus Nov. 5, 2009.
NA Infringement Chart—Samsung SCH-R600. U.S. Pat. No. 7,312,762 Fractus Nov. 5, 2009.
NA Infringement Chart—Samsung SCH-R800 Fractus Nov. 5, 2009.
NA Infringement Chart—Samsung SCH-R800. U.S. Pat. No. 7,312,762 Fractus Nov. 5, 2009.
NA Infringement Chart—Samsung SCH-T929. U.S. Pat. No. 7,312,762 Fractus Nov. 5, 2009.
NA Infringement Chart—Samsung SCH-U310 Fractus Nov. 5, 2009.
NA Infringement Chart—Samsung SCH-U310. U.S. Pat. No. 7,312,762 Fractus Nov. 5, 2009.
NA Infringement Chart—Samsung SCH-U410. U.S. Pat. No. 7,312,762 Fractus Nov. 5, 2009.
NA Infringement Chart—Samsung SCH-U430 Fractus Nov. 5, 2009.
NA Infringement Chart—Samsung SCH-U430. U.S. Pat. No. 7,312,762 Fractus Nov. 5, 2009.
NA Infringement Chart—Samsung SCH-U470 Fractus Nov. 5, 2009.
NA Infringement Chart—Samsung SCH-U470. U.S. Pat. No. 7,312,762 Fractus Nov. 5, 2009.
NA Infringement Chart—Samsung SCH-U520 Fractus Nov. 5, 2009.
NA Infringement Chart—Samsung SCH-U520. U.S. Pat. No. 7,312,762 Fractus Nov. 5, 2009.
NA Infringement Chart—Samsung SCH-U740 Fractus Nov. 5, 2009.
NA Infringement Chart—Samsung SCH-U750 Fractus Nov. 5, 2009.
NA Infringement Chart—Samsung SCH-U750. U.S. Pat. No. 7,312,762 Fractus Nov. 5, 2009.
NA Infringement Chart—Samsung SCH-U940 Fractus Nov. 5, 2009.
NA Infringement Chart—Samsung SCH U340. Fractus Nov. 5, 2009.
NA Infringement Chart—Samsung SCH U410. Fractus Nov. 5, 2009.
NA Infringement Chart—Samsung SCH U700 Fractus Nov. 5, 2009.
NA Infringement Chart—Samsung SCH U700. U.S. Pat. No. 7,312,762 Fractus Nov. 5, 2009.
NA Infringement Chart—Samsung SCH U740. U.S. Pat. No. 7,312,762 Fractus Nov. 5, 2009.
NA Infringement Chart—Samsung SCH U940. U.S. Pat. No. 7,312,762 Fractus Nov. 5, 2009.
NA Infringement Chart—Samsung SGH-A237 Fractus Nov. 5, 2009.
NA Infringement Chart—Samsung SGH-A237. U.S. Pat. No. 7,312,762 Fractus Nov. 5, 2009.
NA Infringement Chart—Samsung SGH-A257 Fractus Nov. 5, 2009.
NA Infringement Chart—Samsung SGH-A257. U.S. Pat. No. 7,312,762 Fractus Nov. 5, 2009.
NA Infringement Chart—Samsung SGH-A867. U.S. Pat. No. 7,312,762 Fractus Nov. 5, 2009.
NA Infringement Chart—Samsung SGH-I907. U.S. Pat. No. 7,312,762 Fractus Nov. 5, 2009.
NA Infringement Chart—Samsung SGH-T239 Fractus Nov. 5, 2009.
NA Infringement Chart—Samsung SGH-T239. U.S. Pat. No. 7,312,762 Fractus Nov. 5, 2009.
NA Infringement Chart—Samsung SGH-T559 Fractus Nov. 5, 2009.
NA Infringement Chart—Samsung SGH-T559. U.S. Pat. No. 7,312,762 Fractus Nov. 5, 2009.
NA Infringement Chart—Samsung SGH-T819 Fractus Nov. 5, 2009.
NA Infringement Chart—Samsung SGH-T819. U.S. Pat. No. 7,312,762 Fractus Nov. 5, 2009.
NA Infringement Chart—Samsung SGH-T929 Fractus Nov. 5, 2009.
NA Infringement Chart—Samsung SGH A117 Fractus Nov. 5, 2009.
NA Infringement Chart—Samsung SGH A117. U.S. Pat. No. 7,312,762 Fractus Nov. 5, 2009.
NA Infringement Chart—Samsung SGH A867 Fractus Nov. 5, 2009.
NA Infringement Chart—Samsung SGH T229 Fractus Nov. 5, 2009.
NA Infringement Chart—Samsung SGH T229. U.S. Pat. No. 7,312,762 Fractus Nov. 5, 2009.
NA Infringement Chart—Samsung SGH T439 Fractus Nov. 5, 2009.

(56) References Cited

OTHER PUBLICATIONS

NA Infringement Chart—Samsung SGH T439. U.S. Pat. No. 7,312,762 Fractus Nov. 5, 2009.
NA Infringement Chart—Samsung SGH T919 Fractus Nov. 5, 2009.
NA Infringement Chart—Samsung SGH T919. U.S. Pat. No. 7,312,762 Fractus Nov. 5, 2009.
NA Infringement Chart—Samsung SGH U340. U.S. Pat. No. 7,312,762 Fractus Nov. 5, 2009.
NA Infringement Chart—Samsung Spex R210a Fractus Nov. 5, 2009.
NA Infringement Chart—Samsung Spex R210a. U.S. Pat. No. 7,312,762 Fractus Nov. 5, 2009.
NA Infringement Chart—Samsung SPH-A523 Fractus Nov. 5, 2009.
NA Infringement Chart—Samsung SPH-A523. U.S. Pat. No. 7,312,762 Fractus Nov. 5, 2009.
NA Infringement Chart—Samsung Sway SCH-U650 Fractus Nov. 5, 2009.
NA Infringement Chart—Samsung Sway SCH-U650. U.S. Pat. No. 7,312,762 Fractus Nov. 5, 2009.
NA Infringement Chart—Sanyo Katana II. U.S. Pat. No. 7,312,762 Fractus Nov. 5, 2009.
NA Infringement Chart—Sanyo Katana LX. U.S. Pat. No. 7,312,762 Fractus Nov. 5, 2009.
NA Infringement Chart—Sanyo S1. Patent: 7312762 Fractus Nov. 5, 2009.
NA Infringement Chart—Sharp Sidekick 3. U.S. Pat. No. 7,312,762 Fractus Nov. 5, 2009.
NA Infringement Chart—UTStarcom CDM7126. U.S. Pat. No. 7,312,762 Fractus Nov. 5, 2009.
NA Infringement Chart—UTStarcom Quickfire GTX75. U.S. Pat. No. 7,312,762 Fractus Nov. 5, 2009.
NA. Int'l Electro-Technical Commission IEV No. 712-01-04—Electropedia : the world's online electrotechnical vocabulary Electropedia—Commission. Electrotechnique Internationale—http://www.electropedia.org. Apr. 1, 1998.
NA. Kyocera Communications Inc's answer, affirmative defenses and counterclaims to plaintiff's amended complaint. Defendants. Jul. 21, 2009.
NA. Kyocera Communications, Inc's answer, affirmative defenses and counterclaims to plaintiff's second amended complaint. Defendants. Dec. 22, 2009.
NA. Kyocera Wireless Corp's answer, affirmative defenses and counterclaims to plaintiff's amended complaint. Defendants. Jul. 21, 2009.
NA. Kyocera Wireless Corp's answer, affirmative defenses and counterclaims to plaintiff's second amended complaint. Defendants. Dec. 22, 2009.
NA. Letter from Baker Botts to Kenyon & Kenyon LLP, Winstead PC and Howison & Arnott LLP including exhibits. Baker Botts. Oct. 28, 2009.
NA. Letter to FCC—Application form 731 and Engineering Test Report by Nokia Mobile Phones for FCC ID: LJPNSW-6NX. M. Flom Associates. Apr. 1, 1999.
NA. Merriam-Webster's Collegiate Dictionary (1993)—Declaration of J. Baxter—Exhibit CC. Merriam-Webster's. Case 6:09-cv-00203-LED-JDL. Jan. 1, 1993.
NA. Motorola 2000x pager. Motorola. Jun. 13, 1997.
NA. Motorola Advisor Elite mobile phone—Antenna photos—User manual. Motorola. Jan. 1, 1997.
NA. Motorola Advisor Gold FLX pager. Motorola , Inc. Aug. 1, 1996.
NA. Motorola Bravo Plus pager. Motorola. Mar. 3, 1995.
NA. Motorola P935. Motorola. Aug. 13, 1997.
NA. Nokia 3210. Nokia. Jan. 1, 1999.
NA. Nokia 3360. Nokia. May 3, 2001.
NA. Nokia 8210. Nokia. Jan. 1, 1999.
NA. Nokia 8260. Nokia. Sep. 8, 2000.
NA. Nokia 8260—FCC ID GMLNSW-4DX. Nokia. Apr. 1, 1999.
NA. Nokia 8265. Nokia. Mar. 4, 2002.
NA. Nokia 8290. Nokia. Jun. 1, 2010.
NA. Nokia 8810. Nokia. Jan. 1, 1998.
NA. Nokia 8850. Nokia. Jan. 1, 1999.
NA. Nokia 8860. Nokia and Federal Communications Commission ( FCC ). Jun. 24, 1999.
NA. Notice of compliance with motion practice orders. Fractus. Feb. 14, 2011.
NA. OET Exhibits List for FCC ID: GMLNSW-4DX. Office of Engineering and Technology—FCC. Sep. 8, 2000.
NA. OET Exhibits list for FCC ID: LJPNPW-1NB. Federal Communications Commission—FCC. May 3, 2001.
NA. OET Exhibits list for FCC ID: LJPNSW-6NX. Federal Communications Commission—FCC. Jul. 8, 1999.
NA. Office action for the Chinese patent application 01823716 dated Feb. 16, 2007. CCPIT Patent and Trademark Law Office—Chinese Patent Office. Feb. 16, 2007.
NA. Office action for the Chinese patent application 01823716 dated Sep. 21, 2007. CCPIT Patent and Trademark Law Office—Chinese Patent Office. Sep. 21, 2007.
NA. Order adopting report and recommendation of magistrate judge—Document 622. Court .Feb. 11, 2011.
NA. Palm Inc.'s answer, affirmative defenses and counterclaims to plaintiff's amended complaint. Defendants. Jul. 21, 2009.
NA. Palm, Inc's answer, affirmative defenses and counterclaims to plaintiff's second amended complaint. Defendants. Dec. 22, 2009.
NA. Plaintiff Fractus SA's answer to defendant Pantech Wireless, Inc's counterclaims—Document 73. Defendants. Jun. 24, 2009.
NA. Plaintiff Fractus SA's answer to defendant UTStarcom, Inc's counterclaims—Document 79. Fractus. Jun. 29, 2009.
NA. Plaintiff Fractus, S. A.'s answer to amended counterclaims of defendant HTC America, Inc. to Fractus's Second Amended Complaint—Document 353. Fractus. Apr. 1, 2010.
NA. Plaintiff Fractus, S. A.'s answer to amended counterclaims of defendant HTC Corporation to Fractus's Second Amended Complaint—Document 352. Fractus. Apr. 1, 2010.
NA. Plaintiff Fractus, S. A.'s answer to amended counterclaims of defendant LG Electronics Inc., LG Electronics USA, Inc., and LG Electronics Mobilecomm USA Inc's to Fractus's Second Amended Complaint—Document 354. Fractus. Apr. 1, 2010.
NA. Plaintiff Fractus, S. A.'s answer to amended counterclaims of defendant Samsung Telecommunications America LLC's to Fractus's Second Amended Complaint—Document 351. Fractus. Apr. 1, 2010.
NA. Plaintiff Fractus, S. A.'s answer to counterclaims of defendants HTC America, Inc to the Second Amended Complaint—Document 273. Fractus. Jan. 14, 2010.
NA. Plaintiff Fractus, S. A.'s answer to defendant Kyocera Communications, Inc's Counterclaims to the Second Amended Complaint—Document 258. Fractus. Jan. 4, 2010.
NA. Plaintiff Fractus, S. A.'s answer to defendant UTStarcom, Inc's Counterclaims to the Second Amended Complaint—Document 261. Fractus. Jan. 4, 2010.
NA. Plaintiff Fractus, S. A.'s answer to the counterclaims of defendants Research in Motion LTD. and Research in Motion Corporation to the Second Amended Complaint—Document 256. Fractus. Jan. 4, 2010.
NA. Reply brief in support of Defendant's motion for reconsideration of the court's ruling on the term "at least a portion" in the court's Dec. 17, 2010 claim construction order based on newly-available evidence—Document 645. Defendants. Feb. 25, 2011.
NA. Report and recommendation of United States magistrate judge. Court. Feb. 8, 2011.
NA. Request for inter partes reexamination form for U.S. Pat. No. 7,312,762 / U.S. Appl. No. 95/001,461 by Samsung including exhibits CC-A, CC-B, CC-C, CC-D, CC-E. Defendants. Oct. 1, 2010.
NA. Request for Inter Partes reexamination of U.S. Appl. No. 70/115,868—OTH-A—Civil Action Case 6:09cv-0203—Second Amended Complaint for patent infringement. Fractus. Dec. 8, 2009.

(56) References Cited

OTHER PUBLICATIONS

NA. Request for inter partes reexamination transmittal form for U.S. Pat. No. 7,312,762 / U.S. Appl. No. 95/000,587 by Kyocera including exhibits CC-1, CC-2, CC-3, CC-4. Defendants. Nov. 12, 2010.
NA. Response of defendants Kyocera Communications, Inc; Palm Inc. and UTStarcom, Inc. to plaintiff Fractus SA's opening claim construction brief in "Case 6:09-cv-00203-LED-JDL". Defendants. Jul. 30, 2010.
NA. Response to the office action dated Feb. 16, 2007 for the Chinese patent application 01823716. CCPIT Patent and Trademark Law Office—Chinese Patent Office. Aug. 21, 2007.
NA. Response to the office action dated Sep. 21, 2007 for the Chinese patent application 01823716. CCPIT Patent and Trademark Law Office—Chinese Patent Office. Dec. 3, 2007.
NA. RIM 857 pager. RIM. Oct. 1, 2000.
NA. RIM 950 product—Photos of. RIM. Jun. 30, 1998.
NA. RIM 957 page maker. RIM. Nov. 15, 2000.
NA. Rockwell B-1B Lancer . <http://home.att.net/~jbaugher2/newb1_2.html>. Oct. 12, 2001.
NA. SAR—Evaluation—DASY3 Dipole ValidationKit—Type: D835V2—Serial: 405. Schmid and Partner Engineering AG. Feb. 13, 2001.
NA. SAR—Evaluation—DASY3 Dipole ValidationKit—Type: D1900V2—Serial: 511. Schimd and Partner Engineering AG. Feb. 13, 2001.
NA. Second amended complaint for patent infringement—Case 6:09-cv-00203—Document 222. Fractus. Dec. 2, 2009.
NA. Software—Box counting dimension [electronic]. http://www.sewanee.edu/Physics/PHYSICS123/BOX%20COUNTING%20DIMENSION.html. Apr. 1, 2002.
NA. Summons to attend oral proceedings pursant to rule 71 (1) EPC for EP application 00909089. EPO. dated Oct. 28, 2004.
NA. The American Century Dictionary. Oxford University Press. Jan. 1, 1995.
NA. The American Heritage College Dictionary. Houghton Mifflin Comp.—3d ed.—Case 6:09-cv-00203-LED-JDL. Jan. 1, 1997.
NA. The American Heritage Dictionary. New College ed. (2nd ed. ). Jan. 1, 1982.
NA. The American Heritage Dictionary. Morris—William—(Second College edition)—Case 6:09-cv-00203-LED-JDL. Jan. 1, 1982.
NA. The handbook of antenna design—Index. Rudge, A. W. et al.—Peter Peregrinus—Institution of Electrical Engineers. Jan. 1, 1986.
NA. The Random House Dictionary. Random House. Jan. 1, 1984.
NA. Webster's New Collegiate Dictionary. G & C Merriam Co. Jan. 1, 1981.
Nadan , T. ; coupez , J. P. Integration of an antenna filter device, using a multi-layer, multi-technology process. European Microwave Conference, 28th. Oct. 1, 1988.
Nagai , K. ; Mikuni , Y. ; Iwasaki , H. A mobile radio antenna system having a self-diplexing function. IEEE Transactions on Vehicular Technology. Nov. 1, 1979.
Nagy , L. L Antenna engineering handbook—Chapter 39—Automobile antennas. Volakis , J.—McGraw-Hill; 4th edition. Jan. 1, 2007.
Naik , A. ; Bathnagar , P. S. Experimental study on stacked ring coupled triangular microstrip antenna. Antenna Applications Symposium, 1994. Sep. 21, 1994.
Nakano ; Vichien Dual-frequency square patch antenna with rectangular notch. Electronic Letters. Aug. 3, 1989.
Navarro , M. Aplicació de diverses modificacions sobre l'antena Sierpinski, antena fractal multibanda. Universitat Politécnica de Catalunya. Oct. 1, 1997.
Neary , D. Fractal methods in image analysis and coding. Dublin City University. Jan. 22, 2001.
Nelson , Thomas R. ; Jaggard , Dwight L. Fractals in the Imaging Sciences. J. Optical Society AM. Jan. 1, 1999.
Ng , V. Diagnosis of melanoma with fractal dimesions. IEEE Tencon. Jan. 1, 1993.
Nguyen , H. Notice of Allowance of U.S. Appl. No. 10/182,635 dated Apr. 11, 2005. USPTO. dated Apr. 11, 2005.
Nguyen , H. Notice of Allowance of U.S. Appl. No. 12/347,462 dated May 18, 2009. USPTO. dated May 18, 2009.
Nguyen , H. Office Action of U.S. Appl. No. 12/347,462 dated Oct. 28, 2009. USPTO. dated Oct. 28, 2009.
Nguyen , H. Office Action of U.S. Appl. No. 10/182,635 dated Dec. 13, 2004. USPTO. dated Dec. 13, 2004.
Nguyen, H. Notice of Allowance of U.S. Appl. No. 11/110,052 dated May 30, 2006. USPTO. dated May 30, 2006.
Nishikawa , T., Ishikawa , Y., Hattori , J. and Wakino , K. Dielectric receiving filter with Sharp stopband using an active feedback resonator method for cellular base stations. IEEE Transactions on Microwave Theory and Techniques. Dec. 1, 1989.
Omar, Amjad A. ; Antar , Y. M. M. A new broad band dual frequency coplanar waveguide fed slot antenna. Antennas and Propagation Society International Symposium, 1999. IEEE. Jul. 11, 1999.
Ou , J. D. An analysis of annular, annular sector, and circular sector microstrip antennas. Antenna Applications Symposium. Sep. 23, 1981.
Pan, S. et al. Single-feed dual-frequency microstrip antenna with two patches. Antennas and Propagation Society International Symposium, 1999. IEEE. Aug. 1, 1999.
Parker , E. A. ; A. N. A. El Sheikh Convoluted array elements and reduced size unit cells for frequency selective surfaces. IEE Proceedings H. Feb. 1, 1991.
Parker , S. McGraw-Hill Dictionary of Scientific and Technical Terms (5th ed. 1994). McGraw-Hill—Case 6:09-cv-00203-LED-JDL. Jan. 1, 1994.
Parker, E. A. ; A. N. A. El Sheikh Convoluted dipole array elements. Electronic Letters. Feb. 14, 1991.
Paschen , D. A. Broadband microstrip matching techniques. Antenna Applications Symposium. Sep. 21, 1983.
Paschen , D. A. Structural stopband elimination with the monopole-slot antenna. Antenna Applications Symposium. Sep. 22, 1982.
Paschen , D. A. ; Olson , S. A crossed-slot antenna with an infinite balun feed. Antenna Applications Symposium, 1995. Sep. 20, 1995.
Peitgen & D. Saupe, H. The science of fractal images. Springer-Verlag. Jan. 1, 1988.
Peitgen et al, H O. Chaos and fractals : new frontiers of science. Springer-Verlag. Jan. 1, 1992.
Peitgen, Heinz-Otto; Jürgens, Hartmut; Saupe, Dietmar. Chaos and fractals. New frontiers of science. Springer-Verlag. Feb. 12, 1993.
Penn , A. Fractal dimension of low-resolution medical images Engineering in Medicine and Biology Society, 1996. Proceedings of the 18th Annual International Conference of the IEEE. Jan. 1, 1996.
Petko , Joshua S. ; Werner , D. H. Reconfigurable miniature three dimensional fractal tree antenna. Antennas and Propagation Society International Symposium, 2003. IEEE. Jun. 22, 2003.
Phan , T. Notice of allowance of U.S. Appl. No. 10/963,080 dated Sep. 1, 2005. USPTO. dated Sep. 1, 2005.
Phan , T. Notice of allowance of U.S. Appl. No. 11/102,390 dated Jul. 6, 2006. USPTO. dated Jul. 6, 2006.
Phan , T. Notice of allowance of U.S. Appl. No. 11/179,257 dated Oct. 19, 2006. USPTO. dated Oct. 19, 2006.
Phan , T. Office Action for U.S. Appl. No. 10/102,568 dated Jan. 23, 2004—Declaration of J. Baxter—Exhibit EEEE—USPTO. dated Jan. 23, 2004.
Phan , T. Office Action for U.S. Appl. No. 11/550,256 dated Jan. 15, 2008. USPTO. dated Jan. 15, 2008.
Phelan , R. A wide-band parallel-connected balun. Microwave Theory and Techniques, IEEE Transactions on. May 1, 1970.
Posio , E. Letter to FCC—About GMLNSW-3 complies with ANSI/IEEE C95.1-1992 Standard for Safety Levels. Nokia Mobile Phones. Dec. 7, 2001.
Posio , E. Letter to FCC—Electronic Serial Number for FCC ID: GMLNSW-4DX. Nokia Mobile Phones. Feb. 7, 2000.
Posio , E. Letter to FCC—Request for confidentiality on the information accompanying the application of FCC ID: GMLNSW-4DX. Nokia Mobile Phones. Feb. 7, 2000.
Pozar , D. ; Newman , E. Analysis of a Monopole Mounted near or at the Edge of a Half-Plane. IEEE Transactions on Antennas and Propagation. May 1, 1981.

(56) References Cited

OTHER PUBLICATIONS

Pozar , David M. Microwave Engineering—Chapter 12: Introduction to Microwave Systems. Addison-Wesley. Jan. 1, 1990.
Pozar , David M. ; Schaubert , Daniel H. Microstrip antennas. The analysis and design of microstrip antennas and arrays. IEEE Press; Pozar, Schaubert . Jan. 1, 1995.
Pregla , R. The analysis of general axially symmetric antennas with a coaxial feed line by the method of lines. Transactions on Antennas and Propagation, IEEE. Oct. 10, 1998.
Pressley, A Elementary Differential Geometry. Springer. Jan. 1, 2000.
Pribetich , P. ; Combet , Y. et al Quasifractal planar microstrip resonators for microwave circuits. Microwave and Optical Technology Letters. Jun. 20, 1999.
Puente , C. Fractal antennas. Universitat Politecnica de Catalunya. May 1, 1997.
Puente , C. Fractal multiband antenna based on the Sierpinski gasket. Electronic letters. Jan. 4, 1996.
Puente , C. ; Anguera , J. ; Romeu , J.; Borja , C. ; Navarro , M. ; Soler , J. Fractal-shaped antennas and their application to gsm 900 1800. Antennas and Propagation Society International Symposium, 2000. IEEE. Apr. 1, 2000.
Puente , C. ; Claret , J. ; Sagues , F. et al Multiband properties of a fractal tree antenna generated by electrochemical deposition. Electronic Letters. Dec. 5, 1996.
Puente , C. ; Pous , R. Fractal design of multiband and low side-lobe arrays. Antennas and Propagation, IEEE Transactions on. May 1, 1996.
Puente , C. ; Romeu , J. ; Bartolome , R. ; Pous , R. Perturbation of the Sierpinski antenna to allocate operating bands. Electronic Letters. Nov. 21, 1996.
Puente , C. ; Romeu , J. ; Cardama , A. Fractal-shaped antennas. Frontiers in electromagnetics—IEEE Press. Jan. 1, 2000.
Puente , C. ; Romeu , J. ; Cardama , A. ; Pous , R. On the behavior of the Sierpinski multiband fractal antenna. Antennas and Propagation, IEEE Transactions on. Apr. 1, 1998.
Puente , C. ; Romeu , J. ; Cardama, A. The Koch monopole—a small fractal antenna. Antennas and Propagation, IEEE Transactions on. Nov. 1, 2000.
Puente , C. et al. Small but long Koch fractal monopole. Electronic Letters. Jan. 8, 1998.
Rademacher , H. ; Toeplitz , O. The Enjoyment of Math. Princeton Science Library. Jan. 1, 1957.
Reed , S. Antenna patch reduction by inductive and capacitive loading. Antennas and Propagation Society International Symposium, 2000. IEEE. Jun. 1, 2000.
Reed , S. Patch antenna size reduction by means of inductive slots. Microwave and Optical Technology Letters. Apr. 20, 2001.
Rensh , Y. A. Broadband microstrip antenna. Proceedings of the Moscow International Conference on Antenna Theory and Tech. Sep. 22, 1998.
Rich , Barnett. Review of Elementary Mathematics 2d ed.1997. McGraw—Hill—Case 6:09-cv-00203-LED-JDL. Jan. 1, 1997.
Robinson R. Response to Office Action dated Oct. 15, 2008 of U.S. Appl. No. 11/824,823. Winstead. dated Jan. 27, 2009.
Robinson, R. T. Response to Office Action for U.S. Appl. No. 10/822,933 dated Oct. 5, 2006. Jenkens & Gilchrist. dated Jan. 4, 2007.
Rolan Cisneros, E. International Search Report for the PCT patent application ES99/00296. OEPM. dated Mar. 29, 2001.
Romeu , J. ; Blanch , S. A three dimensional hilbert antenna. Antennas and Propagation Society International Symposium, 2002. IEEE. Jun. 16, 2002.
Romeu , J. et al. Fractal FSS—A novel dual-band frequency selective surface. Antennas and Propagation, IEEE Transactions on. Jul. 1, 2000.
Rosa , J. ; Case E. W. A wide angle circularly polarized omnidirectional array antenna. Symposium on the USAF antenna Research and Development Program , 18th. Oct. 15, 1968.
Rotman , W. Problems encountered in the design of flush-mounted antennas for high speed aircraft .Symposium on the USAF Antenna Research and Development Program, 2nd. Oct. 19, 1952.
Rouvier , R. et al. Fractal analysis of bidimensional profiles and application to electromagnetic scattering from soils. IEEE. Jan. 1, 1996.
Rowell , C. R. ; Murch , R.D. A capacitively loaded PIFA for compact mobile telephone handsets. Antennas and Propagation, IEEE Transactions on. May 1, 1997.
Rowell , Corbett R. ; Murch , R. D. A compact PIFA suitable for dual-frequency 900-1800-MHz operation. Antennas and Propagation, IEEE Transactions on. Apr. 1, 1998.
Rumsey , V. Frequency independent antennas. Academic Press. Jan. 1, 1996.
Russell , D. A. et al. Dimension of strange attractors. Physical Review Letters. Oct. 6, 1980.
Salow , S. Letter to FCC—About LJPNPW-1 NB complies with ANSI/IEEE C95.1-1992 Standard for Safety Levels. Nokia Mobile Phones. Oct. 26, 2001.
Salow , S. Letter to FCC—FCC ID LJPNPW-1NB complies with OET Bulletin No. 53 as referenced in Section 22.915 of the Commissions rules and with EIA/TIA/IS-54-B. Nokia Mobile Phones. Feb. 26, 2001.
Salow , S. Request for confidentiality of the information accompanyinh the application of FCC ID: LJPNPW-1NB. M. Flom Associates—MFA. Feb. 26, 2001.
Samavati , Hirad ; Hajimiri , Ali et al. Fractal capacitors.IEEE Journal of solid state circuits. Dec. 1, 1998.
Sanad , Mohamed. A compact dual broadband microstrip antenna having both stacked and planar parasitic elements. Antennas and Propagation Society International Symposium, 1996. AP-S. Digest. Jul. 21, 1996.
Sanchez Hernandez , David et al. Analysis and design of a dual-band circularly polarized microstrip patch antenna. Antennas and Propagation, IEEE Transactions on. Feb. 1, 1995.
Sandlin , B. ; Terzouli , A. J. A genetic antenna desig for improved radiation over earth. Antenna Applications Symposium , Program for 1997—Allerton Conference Proceedings. Sep. 17, 1997.
Sarkar , N. An efficient differential box-counting approach to compute fractal dimension of image. IEEEn Transactions on System, Man and Cybernetics. Jan. 3, 1994.
Sauer , J. M. Preliminary amendment for the U.S. Appl. No. 10/963,080—Declaration of J. Baxter—Exhibit W Jones Day. Case 6:09-cv-00203-LED-JDL. Dec. 10, 2004.
Sauer , J. Amendment and response to office action dated Dec. 13, 2004 of U.S. Appl. No. 10/182,635. Jones Day. dated Mar. 17, 2005.
Sauer , J. Amendment and response to office action dated Oct. 4, 2004 of U.S. Appl. No. 10/182,635. Jones Day. dated Nov. 12, 2004.
Sauer , J. M. Response to the office action from U.S. Appl. No. 10/181,790 dated Mar. 2, 2005. Jones Day. dated Mar. 14, 2005.
Sauer , Joseph M. Request for Continued Examination for U.S. Appl. No. 10/422,578 with response to the office action dated Apr. 7, 2005 and the advisory action dated Jun. 23, 2005. Jones Day, dated Aug. 8, 2005.
Sauer , Joseph M. Response to the Office Action dated Apr. 7, 2005 for the U.S. Appl. No. 10/422,578. Jones Day. dated May 31, 2005.
Sauer , Joseph M. Response to the Office Action dated Oct. 4, 2004 for the U.S. Appl. No. 10/422,578. Jones Day. dated Jan. 6, 2005.
Sauer, J.M. Response to the office action from U.S. Appl. No. 10/181,790 dated Jun. 2, 2005. Jones Day. dated Jul. 20, 2005.
Saunders , S. R. Antennas and Propagation for Wireless Communication Systems—Chapter 4. John Wiley & Sons. Jan. 1, 1999.
Sawaya , K. ; Ishizone , T. ; Mushiake , Y. A simplified Expression of Dyadic Green's Function for a Conduction Half Sheet vol. AP-29, No. 5 (Sep. 1981). IEEE Transactions on Antennas & Propagation. Sep. 1, 1981.
Scharfman , W. Telemetry antennas for high altitude missiles. Symposium on the USAF antenna research and development program, 8th. Oct. 20, 1958.
Schaubert , D. H. ; Chang , W. C. ; Wunsch , G. J. Measurement of phased array performance at arbitrary scan angles. Antenna Applications Symposium. Sep. 21, 1994.

(56) References Cited

OTHER PUBLICATIONS

Sclater , N. ; Markus , J. McGraw-Hill Electronics Dictionary. Mc-Graw Hill. Jan. 1, 1997.
Seavey , John. C-band paste-on and floating ring reflector antennas. Symposium on the USAF Antenna Research and Development Program, 23th. Oct. 10, 1973.
Shenoy , A. et al. Notebook satcom terminal technology development. International Conference on Digital Satellite Communications, 10th. May 15, 1995.
Shibagaki , N. Saw antennas duplexer module using saw-resonator-coupled filter for PCN system. IEEE Ultrasonics symposium. Oct. 5, 1998.
Shibagaki , N. ; Sakiyama , K. ; Nikita , M. Miniature saw antenna duplexer module for 1.9GHz PCN systems using saw-resonator-coupled filters. IEEE Ultrasonics Symposium. Oct. 5, 1998.
Shimoda , R. Y. A variable impedance ratio printed circuit balun. Antenna Applications Symposium. Sep. 26, 1979.
Shnitkin , H. Analysis of log-periodic folded dipole array. Antenna Applications Symposium. Sep. 10, 1992.
Sinclair, G. Theory of models of electromagnetic systems. Proceedings of the IRE. Nov. 1, 1948.
Skrivervik , A. K. et al PCS antenna design—The challenge of miniaturization. Antennas and Propagation Magazine, IEEE. Aug. 1, 2001.
Snow , W. L. Ku-band planar spiral antenna. Symposium on the USAF Antenna Research and Development Program, 19th. Oct. 14, 1969.
Snow , W. L. UHF crossed-slot antenna and applications. Symsposium on the USAF Antenna Research and Development program, 19th. Sep. 1, 1963.
So , P. et al. Box-counting dimension without boxes—Computing D0 from average expansion rates. Physical Review E. Jul. 1, 1999.
Soler , J. Novel multifrequency and small monopole antenna techniques for wireless and mobile applications. Universitat Politecnica de Catalunya. Dec. 1, 2004.
Soler , J. ; Romeu , J. Dual-band sierpinski fractal monopole antenna. Antennas and Propagation Society International Symposium, 2000. IEEE. Jul. 1, 2000.
Soler , J. ; Romeu , J. ; Puente , C. Mod-P Sierpinski fractal multiband antenna. Antennas and Propagation Society International Symposium, 2000. IEEE. Apr. 4, 2000.
Song , C. T. P. et al. Multi-circular loop monopole antenna. Electronic Letters. Mar. 2, 2000.
Song, C. T. P. Fractal stacked monopole with very wide bandwidth. Electronic Letters. Jun. 1, 1999.
Stang , P. F. Balanced flush mounted log-periodic antenna for aerospace vehicles—in Abstracts of the Twelfth Annual Symposium USAF antenna research. Symposium on USAF antenna Research and Development, 12th. Oct. 16, 1962.
Strugatsky , A. et al. Multimode multiband antenna. Tactical communications: Technology in transition. Proceedings of the tactical communications conference. Apr. 28, 1992.
Stutzman , W. ; Thiele , G. Antenna theory and design. John Wiley and Sons. Jan. 1, 1981.
Stutzman , L. W. ; Thiele , G. A. Antenna Theory and Design—Preface and Contents. Wiley. Jan. 1, 1998.
Stutzman , W. L. Rebuttal expert report of Dr. Warren L. Stutzman (redacted version). Fractus. Feb. 16, 2011.
Stutzman , W. L. ; Thiele , G. A. Antenna theory and design. John Wiley and Sons. Jan. 1, 1998.
Stutzman , W. L. ; Thiele , G. A. Antenna theory and design—Chapter 5—Resonant Antennas: Wires and Patches. Wiley. Jan. 1, 1998.
Taga , T. Performance analysis of a built-in planar inverted F antenna for 800 MHz band portable radio units. IEEE Journal on Selected Areas in Communications. Jan. 1, 1987.
Tai , Chen to ; Long , Stuart. Antenna engineering handbook—Chapter 4—Dipoles and Monopoles. Johnson , R. Mc Graw Hill—(3rd Ed.). Jan. 1, 1993.
Tang , Y. The application of fractal analysis to feature extraction. IEEE. Jan. 1, 1999.
Tanner , R. L. ; O'Reilly , G. A. Electronic counter measure antennas for a modern electronic reconnaissance aircraft. Symposium on the USAF antenna research and development program, 4th. Oct. 17, 1954.
Teeter , W. L. ; Bushore , K. R. A variable-ratio microwave power divider and multiplexer. IRE Transactions on microwave theory and techniques. Oct. 1, 1957.
Teng , P. L. ; Wong , K. L. Planar monopole folded into a compact structure for very-low-profile multiband mobile-phone antenna. Microwave and optical technology letters. Apr. 5, 2002.
Terman , F. E. Radio engineering. McGraw-Hill Book Company, Inc. Jan. 1, 1947.
The Glenn L. Martin Company. Antennas for USAF B-57 series bombers. Symposium on the USAF antenna research and development program, 2nd. Oct. 19, 1952.
Theiler , J. Estimating fractal dimension. J. Opt. Soc. Am. A. Case 6:09-cv-00203-LED-JDL. Jun. 1, 1990.
Tinker J. A. Response to the office action dated Oct. 30, 2007 of U.S. Appl. No. 11/021,597. Winstead. dated Dec. 28, 2007.
Turner , E. M. Broadband passive electrically small antennas for TV application. Proceedings of the 1977 Antenna Applications Symposium. Apr. 27, 1977.
Turner , E. M. ; Richard , D. J. Development of an electrically small broadband antenna. Symposium on the USAF antenna research and development program, 18th. Oct. 15, 1968.
Verdura, O. Fractal miniature antenna. Universitat Politècnica de Catalunya. Sep. 1, 1997.
Virga , K. L. Low-profile enhanced-bandwidth PIFA antennas for wireless communications packaging. Microwave Theory and Techniques, IEEE Transactions on. Oct. 10, 1997.
Volgov , V. A. Parts and units of radio electronic equipment. Energiya. Jan. 1, 1967.
Walker , B. Preliminary amendment for the U.S. Appl. No. 11/780,932 dated Jul. 20, 2007. Howison & Arnott.—Case 6:09-cv-00203-LED-JDL. dated Jul. 20, 2007.
Walker , B. Preliminary amendment for the U.S. Appl. No. 11/110,052 dated Apr. 18, 2005. Howison & Arnott. dated Apr. 18, 2005.
Walker , B. D. Response office action for the U.S. Appl. No. 11/179,250. Howison & Arnott—Case 6:09-cv-00203-LED-JDL. dated Jul. 12, 2005.
Walker , G. J. et al. Fractal volume antennas. Electronic Letters. Aug. 6, 1998.
Wall , H. ; Davies , H. W. Communications antennas for mercury space capsule. Symposium on the USAF antenna research and development program, 11th. Oct. 16, 1961.
Watanabe , T. ; Furutani , K. ; Nakajima , N. et al. Antenna switch duplexer for dualband phone (GSM / DCS) using LTCC multilayer technology. IEEE MTT-S International Microwave Symposium Digest. Jun. 19, 1999.
Watson , T. ; Friesser , J. A phase shift direction finding technique. Annual Symposium on the USAF antenna research and development program. Oct. 21, 1957.
Weeks , W. L. Antenna engineering. McGraw-Hill Book Company. Jan. 1, 1968.
Weeks , W. L. Eletromagnetic theory for engineering applications. John Wiley & Sons. Jan. 1, 1964.
Wegner , D. E. B-70 antenna system. Symposium on the USAF antenna research and development program, 13th. Oct. 14, 1963.
Weman , E. Minutes from Oral Proceedings in accordance with rule 76(4) EPC for EP Application 00909089.5. EPO. dated Jan. 28, 2005.
Werner , D. H and Mittra , R. Frontiers in electromagnetics. IEEE Press. Jan. 1, 2000.
Werner , D. H. Frequency independent features of self-similar fractal antennas. Radio Science. Nov. 1, 1996.
West , B.H. et al. The Prentice-Hall Encyclopedia of Mathematics (1982). Prentice-Hall—Case 6:09-cv-00203-LED-JDL. Jan. 1, 1982.
Wheeler , H. A. Fundamental limitations of small antennas. Proceedings of the I.R.E. Jan. 1, 1947.

(56) References Cited

OTHER PUBLICATIONS

Wheeler , H. A. Small antennas. Symposium on the USAF antenna research and development program, 23rd. Oct. 10, 1973.
Wheeler , H. A. The radiansphere around a small antenna. Proceedings of the IRE. Aug. 1, 1959.
Wikka , K. Letter to FCC that will authorize the appointment of MORTON FLOM Eng and/or FLOMAssociates Inc to act as their Agent in all FCC matters. Nokia Mobile Phones. Aug. 5, 1999.
Williams , B. Request for inter partes reexamination of U.S. Pat. No. 7,312,762 / U.S. Appl. No. 95/000,599 by HTC including exhibits C-1 to C-10. Dec. 3, 2010. Central Reexamination Unit Commissioner for Patents. Dec. 3, 2010.
Wimer , M. Notice of Allowance of U.S. Appl. No. 10/822,933 dated Apr. 4, 2007. USPTO. dated Apr. 4, 2007.
Wimer , M. Notice of allowance of U.S. Appl. No. 10/822,933 dated Oct. 18, 2007. USPTO. dated Oct. 18, 2007.
Wimer , M. Notice of Allowance of U.S. Appl. No. 11/824,823 dated Apr. 2, 2009. USPTO. dated Apr. 2, 2009.
Wimer , M. Office action of U.S. Appl. No. 11/021,597 dated Oct. 30, 2007. USPTO. dated Oct. 30, 2007.
Wimer , M. Office Action of U.S. Appl. No. 11/824,823 dated Oct. 15, 2008. USPTO. dated Oct. 15, 2008.
Wimer , M. C. Office Action for the U.S. Appl. No. 10/422,578 dated Aug. 23, 2007. USPTO. dated Aug. 23, 2007.
Wimer , M. C. Office Action for the U.S. Appl. No. 10/422,578 dated Aug. 24, 2005. USPTO. dated Aug. 24, 2005.
Wimer , M. C. Office Action for the U.S. Appl. No. 10/422,578 dated Jan. 26, 2006. USPTO. dated Jan. 26, 2006.
Wimer , M. C. Office Action for the U.S. Appl. No. 10/422,578 dated Mar. 12, 2007. USPTO. dated Mar. 12, 2007.
Wimer , M. C. Office action for the U.S. Appl. No. 10/422,578 dated Mar. 26, 2008. USPTO. dated Mar. 26, 2008.
Wimer , M. C. Office Action for the U.S. Appl. No. 11/021,597 dated Mar. 12, 2007. USPTO. dated Mar. 12, 2007.
Wimer , M. C. Office Action for U.S. Appl. No. 10/822,933 dated Oct. 5, 2006. USPTO. dated Oct. 5, 2006.
Wimer , Michael Office Action for U.S. Appl. No. 10/422,578 dated Apr. 7, 2005. USPTO. dated Apr. 7, 2005.
Wimer , Michael C. Advisory Action before the filing of an Appeal Brief for U.S. Appl. No. 10/422,578. USPTO. dated Jun. 23, 2005.
Wimer , Michael C. Office Action for U.S. Appl. No. 10/422,578 dated Oct. 4, 2004. USPTO. dated Oct. 4, 2004.
Wolin , H. A. Preliminary Amendment of U.S. Appl. No. 10/102,568—Exhibit CCCC. Rosenman & Colin LLP. dated Mar. 18, 2002.
Wong , K. L. ; Kuo , J. S. ; Fang , S. T. et al. Broadband microstrip antennas with integrated reactive loading. Asia Pacific Microwave Conference. Dec. 3, 1999.
Wong , K. L. ; Sze , J. Y. Dual-frequency slotted rectangular microstrip antenna. Electronic Letters. Jul. 9, 1998.
Wong , Kin-Lu. Modified planar inverted F antenna. Electronic Letters. Jan. 8, 1998.
NA. Letter from Baker Botts to Howison & Arnott LLP including exhibits. Baker Botts. Aug. 5, 2010.
Wimer , M. C. Office Action of U.S. Appl. No. 12/429,360 dated Sep. 30, 2010. USPTO. dated Sep. 30, 2010.
Wimer , M. C. Office Action of U.S. Appl. No. 12/429,360 dated May 3, 2011. USPTO. dated May 3, 2011.
Shoaib , A. M. Response to the Office Action dated Sep. 30, 2010 of U.S. Appl. No. 12/429,360. Winstead. dated Feb. 16, 2011.
Falconer , K. Fractal geometry. Mathematical foundations and applications Wiley Jan. 1, 2003.
NA Amendments and Review of CN patent application No. 01823716.9 of OA dated Feb. 16, 2007 Patent and Trademanrk Office, China Council for the Promotion of International Trade dated Aug. 21, 2007.
NA FCC—United States table of frequency allocations Federal Communications Commission Oct. 1, 19991.
Shafer , G Probability and Finance John Wiley & Sons Jan. 1, 2001.
FEng , Liu Office Action of CN patent application 018237169 dated Feb. 16, 2007 The State Intelletual Property Office of the People's Republic of China dated Feb. 16, 2007.
Feng , Liu Second Office Action of CN patent application 018237169 dated Sep. 21, 2007 The State Intellectual Property Office of the People's Republic of China dated Sep. 21, 2007.
NA Response to Second OA of CN patent application No. 01823716.9 dated Sep. 21, 2007 CCPIT Patent and Trademark Law Office dated Dec. 3, 2007.
NA United States Table of Frequency allocations—The Radio Spectrum United States Department of Commerce Mar. 1, 1996.
Barnsley , M. Fractals Everywhere Academic Press Professional Jan. 1, 1993.
Vinoy , K. J. et al Hilbert curve fractal antenna: a small resonant antenna for VHF/UHF applications Microwave and Optical Technology Letters. p. 215-219 May 1, 2001.
NA Docket 666—Fractus's sur-reply to defendants' motion for reconsideration of the court's Dec. 17, 2010 claim construction order based on newly-available evidence Fractus Mar. 8, 2011.
NA Docket 670—Order Court Mar. 9, 2011.
NA Docket 678—Plaintiff Fractus SA's answer to second amended counterclaims of defendant HTC Corporation to Fractus's second amended complaint Fractus Mar. 14, 2011.
NA Docket 680—Plaintiff Fractus SA's answer to second amended counterclaims of defendant HTC to Fractus's second amended complaint Fractus Mar. 14, 2011.
NA Docket 694—Plaintiff Fractus SA's answer to second amended counterclaims of defendant LG Electronics to Fractus's second amended complaint Fractus Mar. 15, 2011.
NA Docket 695—Plaintiff Fractus SA's answer to second amended counterclaims of defendant Samsung to Fractus's second amended complaint Fractus Mar. 15, 2011.
NA Docket 696—Plaintiff Fractus SA's answer to amended counterclaims of defendant Pantech Wireless Inc to Fractus's second amended complaint Fractus Mar. 15, 2011.
NA Docket 783—Order Court Apr. 1, 2011.
Tribble, M. L. Letter to John D. Love—Document 715—Permission to file a summary judgment motion of no indefiniteness on the issues wher the Court's Report and Recommendation already has held that the claim term is not indefinite Susman Godfrey , LLP Mar. 17, 2011.
Tribble , M. L. Letter to John D. Love—Document 716—Permission to file a partial summary judgement motion on infringement. Susman Godfrey , LLP Mar. 18, 2011.
Sirola, Neil P. Letter to John D. Love—Document 721—Permission to file a motion for summary judgment of invalidity of the following 7 asserted claims from the MLV, patent family . . . Baker Botts, LLP Mar. 18, 2011.
Howe , Micah J. Fractus, S.A.'s objections to the Court's Mar. 9, 2011, Order—Document 768 Susman Godfrey LLP Mar. 25, 2011.
Jones, Michael E. Defendants' opposition to Fractus SA objections to the Court's Mar. 9, 2011 Order—Document 780 Baker Botts, LLP Mar. 31, 2011.
NA Fractus Docket 841—Stipulation of dismissal claims and counterclaims re '850 and '822 Defendants Apr. 15, 2011.
NA Fractus Docket 843—Join motion to dimiss claims and counterclaims re '850 and '822 Defendants Apr. 15, 2011.
NA Fractus Docket 854 Defendant's Motion to clarify claim construction Defendants Apr. 18, 2011.
Love , J. D. Fractus Docket 868 Order re motion to clarify claim construction Court Apr. 19, 2011.
Behncke , M. Fractus Docket 876 Fractus's Surreply to Defendants' Motion for Summary Judgment re Publication Dates Susman Godfrey LLP Apr. 20, 2011.
Howe , Micah J. Fractus Docket 887 Fractus's Response to Defendants' Motion to Clarify Claim Construction Susman Godfrey LLP Apr. 25, 2011.
Love , J. D. Fractus Docket 890 Fractus Docket 890 Minute Entry re Hearing on Apr. 21, 2011 Court Apr. 27, 2011.
NA Report and recommendation of United States magistrate judge Court Feb. 8, 2011.

(56) References Cited

OTHER PUBLICATIONS

Sterne , R. G. Response to the Office Action for the U.S. Appl. No. 95/001,390 dated Aug. 19, 2010 Sterne, Kessler, Goldstein & Fox PLLC dated Nov. 19, 2010.
Jaggard , D. L. Expert report of Dwight L. Jaggard (redacted)—expert witness retained by Fractus Fractus Feb. 23, 2011.
Long , S. Expert report of Stuart Long (redacted)—expert witness retained by Fractus Fractus Feb. 23, 2011.
Stutzman , W. L. Expert report of Dr. Warren L. Stutzman (redacted)—expert witness retained by Fractus Fractus Feb. 23, 2011.
Document 415—P.R. 4-3 joint claim construction statement, dated on Jun. 14, 2010.
Document 255—Plaintiff Fractus, S. A.'s answer to defendant Personal Communications Devices Holdings, LLC's counterclaims to the Second Amended Complaint, dated on Jan. 4, 2010.
Document 257—Plaintiff Fractus, S. A.'s answer to counterclaims of defendant Pantech Wireless, Inc. to the Second Amended Complaint, dated on Jan. 4, 2010.
Document 259—Plaintiff Fractus, S. A.'s answer to defendant Kyocera Wireless Corp's Counterclaims to the Second Amended Complaint, dated on Jan. 4, 2010.
Document 260—Plaintiff Fractus, S. A.'s answer to defendant Palm, Inc's Counterclaims to the Second Amended Complaint, dated on Jan. 4, 2010.
Document 262—Plaintiff Fractus, S. A.'s answer to counterclaims of defendant Samsung Telecommunications America LLC to the Second Amended Complaint, dated on Jan. 4, 2010.
Document 263—Plaintiff Fractus, S. A.'s answer to counterclaims of defendants LG Electronics Inc., Electronics USA, Inc., and LG Electronics Mobilecomm USA, Inc. to the Second Amended Complaint, dated on Jan. 4, 2010.
Document 423—Fractus SA's Opening Claim Construction Brief with Parties' Proposed and Agreed Constructions in the case of *Fractus SA* v. *Samsung Electornics Co. Ltd. et al.*, dated on Jul. 16, 2010.
Document 889—Reply in support of defendants' motion to clarify claim construction, dated on Apr. 27, 2011.
Document 902—Fractus SA's objections to defendants' prior art notice, dated on May 2, 2011.
Document 933—Defendants' motion for reconsideration of, and objections to, the May 2, 2011 report and recommendation clarifying claim construction, dated on May 9, 2011.
Document 893—Fractus SA's surreply to defendant's motion to clarify claim construction, dated on Apr. 29, 2011.
Document 900—Order, dated on Apr. 29, 2011.
Document 939—Fractus's response to defendants' motion for reconsideration of and objections to the May 2, 2011, report and recommendations clarifying claim construction, dated on May 10, 2011.
Document 915—Defendants' response to plaintiff's objections to defendants notice of prior art, dated on May 5, 2011.
Document 642—Defendant HTC Corporation's second amended answer and counterclaim to plaintiff's second amended complaint, dated on Feb. 25, 2011.
Document 641—Defendant HTC America, Inc's second amended answer and counterclaim to plaintiff's second amended complaint, dated on Feb. 25, 2011.
Document 971—Order, dated on May 13, 2011.
Document 968—Order, dated on May 13, 2011.
Document 429—Declaration of Jeffery D. Baxter—Including Exhibits: J, K, L, M ,N ,O, P, Q, R, S, T, U, Z, AA, KK, LL, dated on Jul. 30, 2010.
Document 452—Defendant's reply in support of their motion for summary judgment of invalidity based on indefiniteness and lack of written description for certain terms with exhibits WW, BBB, EEE, GGG, HHH, III, KKK, MMM, NNN, OOO, PPP, Q, dated on Aug. 30, 2010.
Document 901—Report and recommendation of United States Magistrate Judge, dated on May 2, 2011.
Preliminary amendment for the U.S. Appl. No. 10/822,933 dated Mar. 24, 2005.
Andersen, J. B. , The handbook of antenna design—Low- and medium-gain microwave antennas, Rudge , A. W. et al—IEE Eletromagnetic Waves Series; Peter Peregrinus Ltd. (2nd ed.), vols. 1 and 2, 1986, pp. 526-543.
Menefee , J. A., Office Action of U.S. Appl. Nos. 95/000,587-95/000,599-95/001,461 dated Jun. 7, 2011.
Soler Castany , J. Multi-band antennas for wireless communication systems : Antenes multibanda per sistemes de comunicaions inalàmbriques. Universitat Politècnica de Catalunya, 1999.
Laufer , P. M. Decision Sua Sponte to merge reexamination proceedings of U.S. Pat. No. 7,312,762 and reexamination Nos. 95/001,464-95/000,599-95/000,587. USPTO. Jun. 1, 2011.
Katsibas , K D. ; Balanis , C. A. ; Panayiotis , A. T. ; Birtcher , C. R., Folded loop antenna for mobile hand-held units, IEEE Transactions on antennas and propagation, vol. 46, No. 2, Feb. 1998.
The oral and videotaped deposition of Dwight Jaggard. vol. 1, dated on Mar. 8, 2011.
The oral and videotaped deposition of Dwight Jaggard. vol. 2, dated on Mar. 9, 2011.
Transcript of jury trial before the Honorable Leonard Davis US District Judge—May 17, 2011—8:00 AM.
Transcript of jury trial before the Honorable Leonard Davis—May 18, 2011—8:45 AM.
Transcript of jury trial before the Honorable Leonard Davis—May 18, 2011—1:00 PM.
Transcript of jury trial before the Honorable Leonard Davis—May 19, 2011—8:45 AM.
Transcript of jury trial before the Honorable Leonard Davis—May 19, 2011—1:00 PM.
Transcript of jury trial before the Honorable Leonard Davis—May 20, 2011—8:30 AM.
Transcript of jury trial before the Honorable Leonard Davis—May 20, 2011—12:30 PM.
Transcript of jury trial before the Honorable Leonard Davis—May 23, 2011—8:55 AM.
Demonstratives presented by Dr. Stuart Long during trial, dated on May 18, 2011.
Demonstratives presented by Dr. Steven Best during trial, dated on May 19, 2011.
Document 1082—Joint motion to dismiss HTC, dated on Sep. 13, 2011.
Document 1083—Order—Final consent judgement HTC, dated on Sep. 15, 2011.
Document 1088—Samsung's motion to determine intervening rights in view of new Federal Circuit case law or, in the alternative, to stay the case pending the outcome of reexamination, dated on Oct. 19, 2011.
Document 1091—Fractus's response to Samsung's motion to determine intervening rights or to stay the case pending the outcome of reexamination, dated on Nov. 2, 2011.
Document 1092—Samsung's reply in support of its motion to determine intervening rights in view of new Federal Circuit case law or, in the alternative, to stay the case pending the outcome of reexamination, dated on Nov. 14, 2011.
Response to the Office Action dated May 3, 2011 of U.S. Appl. No. 12/429,360, dated Oct. 3, 2011.
Lu , J.H. Single-feed dual-frequency equilateral-triangular microstrip antenna with pair of spur-lines. Electronic Letters, vol. 34 No. 12. Jun. 1998.
Nokia Mobile, exhibit 9: Internal Photographs FCC ID: LJPNPW-1NB. Federal Communication Commission—FCC, Feb. 15, 2001.
Borja, C. Antenas fractales Microstrip, Universitat Politécnica de Catalunya, 1997.
Campos, O. Estudi d'antenes fractals multibanda i en miniatura, Universitat Politecnica de Catalunya, 1998.
Munson , R. E. Conformal microstrip antennas and microstrip phased arrays. IEEE Transactions on Antennas and Propagation, Jan. 1974.
U.S. Appl. Nos. 95/001,461, 95/000,587—Reply to the action closing prosecution for the U.S. Pat. No. 7,312,762 dated on Apr. 3, 2012. Sterne Kessler Goldstein and Fox, Apr. 26, 2012.

(56) References Cited

OTHER PUBLICATIONS

U.S. Appl. Nos. 95/001,461, 95/000,587—Third party requester's comments to patent owner's Apr. 26, 2012 response and the action closing prosecution. Defendants, May 25, 2011.
U.S. Appl. Nos. 95/001,461, 95/000,587—Right of Appeal Notice, USPTO, dated Jun. 11, 2012.
U.S. Appl. Nos. 95/001,461 , 95/000,587—Third party requester's notice of appeal. Defendants , Jul. 11, 2012.
Infringement Chart—Sanyo Katana II. Fractus, Nov. 11, 2009.
Infringement Chart—Sanyo Katana LX. Fractus, Nov. 11, 2009.
Infringement Chart—Sanyo S1. Fractus, Nov. 11, 2009.
Infringement Chart—Sharp Sidekick 3. Fractus, Nov. 11, 2009.
Infringement Chart—UTStarcom CDM7126. Fractus, Nov. 11, 2009.
Infringement Chart—UTStarcom Quickfire GTX75. Fractus, Nov. 11, 2009.
Infringement Chart—Samsung EPIX SGH-I907. Fractus, Nov. 11, 2009.
U.S. Appl. No. 12/429,360—Office action dated Dec. 20, 2012. USPTO. dated Dec. 20, 2012.
U.S. Appl. Nos. 95/001,461-95/000,587—Reply to third party requester's notice of appeal filed for the U.S. Pat. No. 7,312,762 on Jul. 11, 2012, dated on Sep. 5, 2012.
U.S. Appl. Nos. 95/001,461-95/000,587—Third party requester's appeal brief mail for U.S. Pat. No. 7,312,762, dated on Sep. 11, 2012.
U.S. Appl. Nos. 95/001,461-95/000,587—Inter partes reexamination certificate issued for U.S. Pat. No. 7,312,762, dated on Nov. 9, 2012.
U.S. Appl. No. 12/429,360—Amendment in response to the office action dated Dec. 20, 2012. Edell, Shapiro and Finnan. dated May 30, 2013.
Katsibas , K. D. ; Balanis , C. A. ; Panayiotis , A. T. ; Birtcher , C. R., Folded loop antenna for mobile hand-held units, IEEE Transactions on antennas and propagation, vol. 46, No. 2, Feb. 1998.
The oral and videotaped deposition of Dwight Jaggard, vol. 1, dated on Mar. 8, 2011.
The oral and videotaped deposition of Dwight Jaggard, vol. 2, dated on Mar. 9, 2011.
The oral and videotaped deposition of Dwight Jaggard. vol. 3, dated on Mar. 10, 2011.
Oral and videotaped deposition of Dr. Stuart Long—vol. 1, dated on Mar. 11, 2011.
Oral and videotaped deposition of Dr. Stuart Long—vol. 2, dated on Mar. 13, 2011.
Oral and videotaped deposition of Dr. Stuart Long—vol. 3, dated on Mar. 14, 2011.
Oral and videotaped deposition of Dr. Warren L. Stutzman—vol. 1, dated on Mar. 3, 2011.
Oral and videotaped deposition of Dr. Warren L. Stutzman—vol. 2, dated on Mar. 4, 2011.
Transcript of pretrial hearing before the Honorable Leonard Davis, US District Judge—May 16, 2011—2:00 PM.
Transcript of jury trial before the Honorable Leonard Davis, US District Judge—May 17, 2011—1:10 PM.

* cited by examiner

LOADED ANTENNA

CROSS-REFERENCE TO RELATED APPLICATIONS

This patent application is a continuation of U.S. patent application Ser. No. 12/429,360, filed on Apr. 24, 2009. U.S. patent application Ser. No. 12/429,360 is a continuation of U.S. Pat. No. 7,541,997. U.S. Pat. No. 7,541,997 is a continuation of U.S. Pat. No. 7,312,762. U.S. Pat. No. 7,312,762 is a continuation of PCT/EP01/11914, filed on Oct. 16, 2001. U.S. patent application Ser. No. 12/429,360, U.S. Pat. No. 7,541,997, U.S. Pat. No. 7,312,762, and International Patent Application PCT/EP01/11914 are incorporated herein by reference.

OBJECT OF THE INVENTION

The present invention relates to a novel loaded antenna which operates simultaneously at several bands and featuring a smaller size with respect to prior art antennas.

The radiating element of the novel loaded antenna consists on two different parts: a conducting surface with a polygonal, space-filling or multilevel shape; and a loading structure consisting on a set of strips connected to said first conducting surface.

The invention refers to a new type of loaded antenna which is mainly suitable for mobile communications or in general to any other application where the integration of telecom systems or applications in a single small antenna is important.

BACKGROUND OF THE INVENTION

The growth of the telecommunication sector, and in particular, the expansion of personal mobile communication systems are driving the engineering efforts to develop multiservice (multifrequency) and compact systems which require multifrequency and small antennas. Therefore, the use of a multisystem small antenna with a multiband and/or wideband performance, which provides coverage of the maximum number of services, is nowadays of notable interest since it permits telecom operators to reduce their costs and to minimize the environmental impact.

Most of the multiband reported antenna solutions use one or more radiators or branches for each band or service. An example is found in U.S. patent Ser. No. 09/129,176 entitled "Multiple band, multiple branch antenna for mobile phone".

One of the alternatives which can be of special interest when looking for antennas with a multiband and/or small size performance are multilevel antennas, Patent publication WO01/22528 entitled "Multilevel Antennas", and miniature space-filling antennas, Patent publication WO01/54225 entitled "Space-filling miniature antennas". In particular in the publication WO 01/22528 a multilevel antennae was characterised by a geometry comprising polygons or polyhedrons of the same class (same number of sides of faces), which are electromagnetically coupled and grouped to form a larger structure. In a multilevel geometry most of these elements are clearly visible as their area of contact, intersection or interconnection (if these exists) with other elements is always less than 50% of their perimeter or area in at least 75% of the polygons or polyhedrons.

In the publication WO 01/54225 a space-filling miniature antenna was defined as an antenna having at least one part shaped as a space-filling-curve (SFC), being defined said SFC as a curve composed by at least ten connected straight segments, wherein said segments are smaller than a tenth of the operating free-space wave length and they are spacially arranged in such a way that none of said adjacent and connected segments from another longer straight segment.

The international publication WO 97/06578 entitled fractal antennas, resonators and loading elements, describe fractal-shaped elements which may be used to form an antenna.

A variety of techniques used to reduce the size of the antennas can be found in the prior art. In 1886, there was the first example of a loaded antenna; that was, the loaded dipole which Hertz built to validate Maxwell equations.

A. G. Kandoian (A. G. Kandoian, Three new antenna types and their applications, Proc. IRE, vol. 34, pp. 70W-75W, February 1946) introduced the concept of loaded antennas and demonstrated how the length of a quarter wavelength monopole can be reduced by adding a conductive disk at the top of the radiator. Subsequently, Goubau presented an antenna structure top-loaded with several capacitive disks interconnected by inductive elements which provided a smaller size with a broader bandwidth, as is illustrated in U.S. Pat. No. 3,967,276 entitled "Antenna structures having reactance at free end".

More recently, U.S. Pat. No. 5,847,682 entitled "Top loaded triangular printed antenna" discloses a triangular-shaped printed antenna with its top connected to a rectangular strip. The antenna features a low-profile and broadband performance. However, none of these antenna configurations provide a multiband behaviour. In Patent No. WO0122528 entitled "Multilevel Antennas", another patent of the present inventors, there is a particular case of a top-loaded antenna with an inductive loop, which was used to miniaturize an antenna for a dual frequency operation. Also, W. Dou and W. Y. M. Chia (W. Dou and W. Y. M. Chia, "Small broadband stacked planar monopole", Microwave and Optical Technology Letters, vol. 27, pp. 288-289, November 2000) presented another particular antecedent of a top-loaded antenna with a broadband behavior. The antenna was a rectangular monopole top-loaded with one rectangular arm connected at each of the tips of the rectangular shape. The width of each of the rectangular arms is on the order of the width of the fed element, which is not the case of the present invention.

SUMMARY OF THE INVENTION

The key point of the present invention is the shape of the radiating element of the antenna, which consists on two main parts: a conducting surface and a loading structure. Said conducting surface has a polygonal, space-filling or multilevel shape and the loading structure consists on a conducting strip or set of strips connected to said conducting surface. According to the present invention, at least one loading strip must be directly connected at least at one point on the perimeter of said conducting surface. Also, circular or elliptical shapes are included in the set of possible geometries of said conducting surfaces since they can be considered polygonal structures with a large number of sides.

Due to the addition of the loading structure, the antenna can feature a small and multiband, and sometimes a multiband and wideband, performance. Moreover, the multiband properties of the loaded antenna (number of bands, spacing between bands, matching levels, etc) can be adjusted by modifying the geometry of the load and/or the conducting surface.

This novel loaded antenna allows to obtain a multifrequency performance, obtaining similar radioelectric parameters at several bands.

The loading structure can consist for instance on a single conducting strip. In this particular case, said loading strip must have one of its two ends connected to a point on the perimeter of the conducting surface (i.e., the vertices or edges). The other tip of said strip is left free in some embodiments while, in other embodiments it is also connected at a point on the perimeter of said conducting surface.

The loading structure can include not only a single strip but also a plurality of loading strips located at different locations along its perimeter.

The geometries of the loads that can be connected to the conducting surface according to the present invention are:

a) A curve composed by a minimum of two segments and a maximum of nine segments which are connected in such a way that each segment forms an angle with their neighbours, i.e., no pair of adjacent segments define a larger straight segment.

b) A straight segment or strip c) A straight strip with a polygonal shape d) A space-filling curve, Patent No. PCT/EP00/00411 entitled "Space-filling miniature antennas".

In some embodiments, the loading structure described above is connected to the conducting surface while in other embodiments, the tips of a plurality of the loading strips are connected to other strips. In those embodiments where a new loading strip is added to the previous one, said additional load can either have one tip free of connection, or said tip connected to the previous loading strip, or both tips connected to previous strip or one tip connected to previous strip and the other tip connected to the conducting surface.

There are three types of geometries that can be used for the conducting surface according to the present invention:

a) A polygon (i.e., a triangle, square, trapezoid, pentagon, hexagon, etc. or even a circle or ellipse as a particular case of polygon with a very large number of edges).

b) A multilevel structure, Patent No. WO0122528 entitled "Multilevel Antennas".

c) A solid surface with an space-filling perimeter.

In some embodiments, a central portion of said conducting surface is even removed to further reduce the size of the antenna. Also, it is clear to those skilled in the art that the multilevel or space-filling designs in configurations b) and c) can be used to approximate, for instance, ideal fractal shapes.

FIG. 1 and FIG. 2 show some examples of the radiating element for a loaded antenna according to the present invention. In drawings 1 to 3 the conducting surface is a trapezoid while in drawings 4 to 7 said surface is a triangle. It can be seen that in these cases, the conducting surface is loaded using different strips with different lengths, orientations and locations around the perimeter of the trapezoid, FIG. 1. Besides, in these examples the load can have either one or both of its ends connected to the conducting surface, FIG. 2.

The main advantage of this novel loaded antenna is two-folded:

The antenna features a multiband or wideband performance, or a combination of both.

Given the physical size of radiating element, said antenna can be operated at a lower frequency than most of the prior art antennas.

DETAILED DESCRIPTION OF SOME PREFERRED EMBODIMENTS

Figure 1:
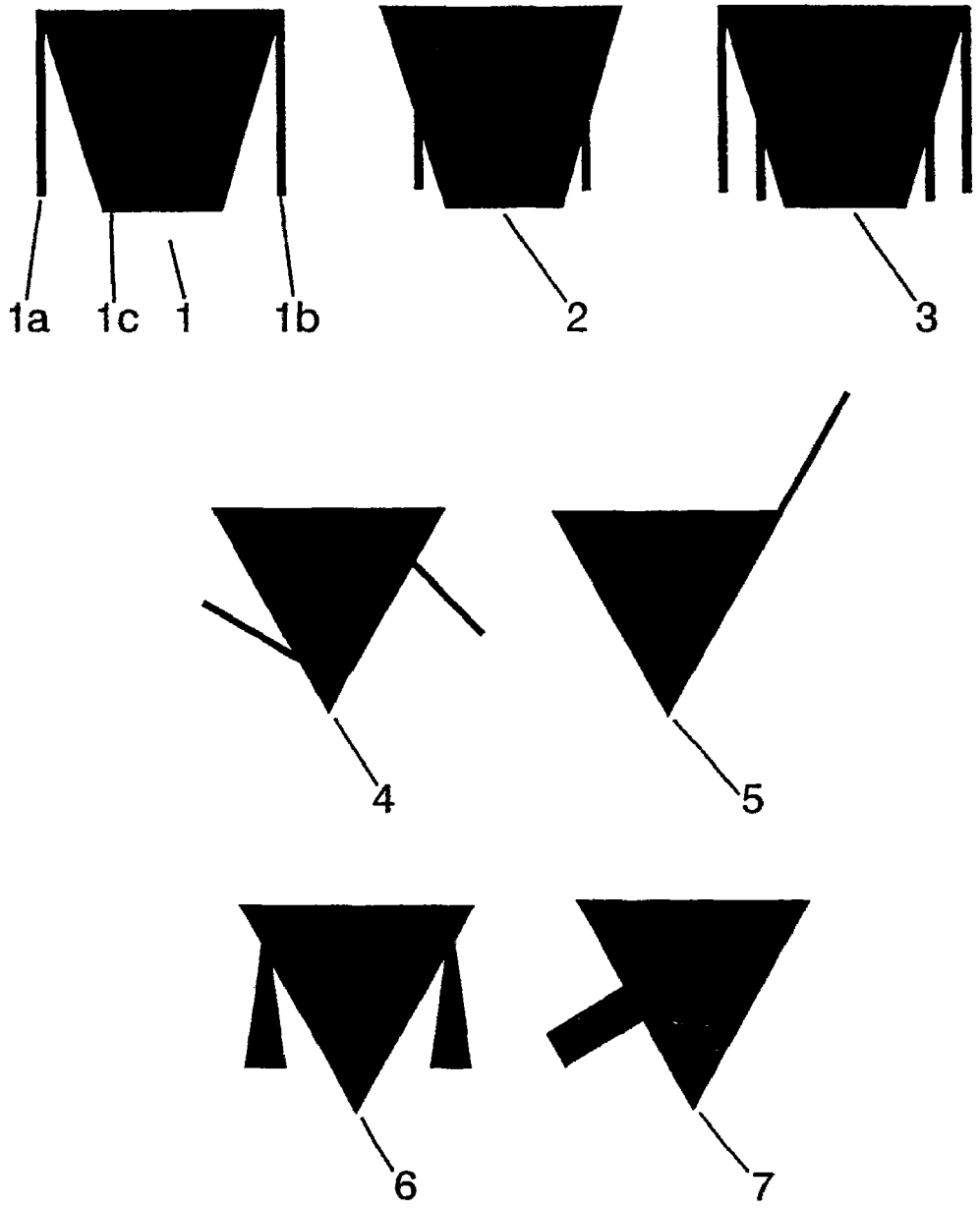
FIG. 1 shows a trapezoid antenna loaded in three different ways using the same structure; in particular, a straight strip. In case 1, one straight strip, the loading structure (1*a*) and (1*b*), is added at each of the tips of the trapezoid, the conducting surface (1*c*). Case 2 is the same as case 1, but using strips with a smaller length and located at a different position around the perimeter of the conducting surface. Case 3, is a more general case where several strips are added to two different locations on the conducting surface. Drawing 4 shows a example of a non-symmetric loaded structure and drawing 5 shows an element where just one slanted strip has been added at the top of the conducting surface. Finally, cases 6 and 7 are examples of geometries loaded with a strip with a triangular and rectangular shape and with different orientations. In these cases, the loads have only one of their ends connected to the conducting surface.
Figure 2:
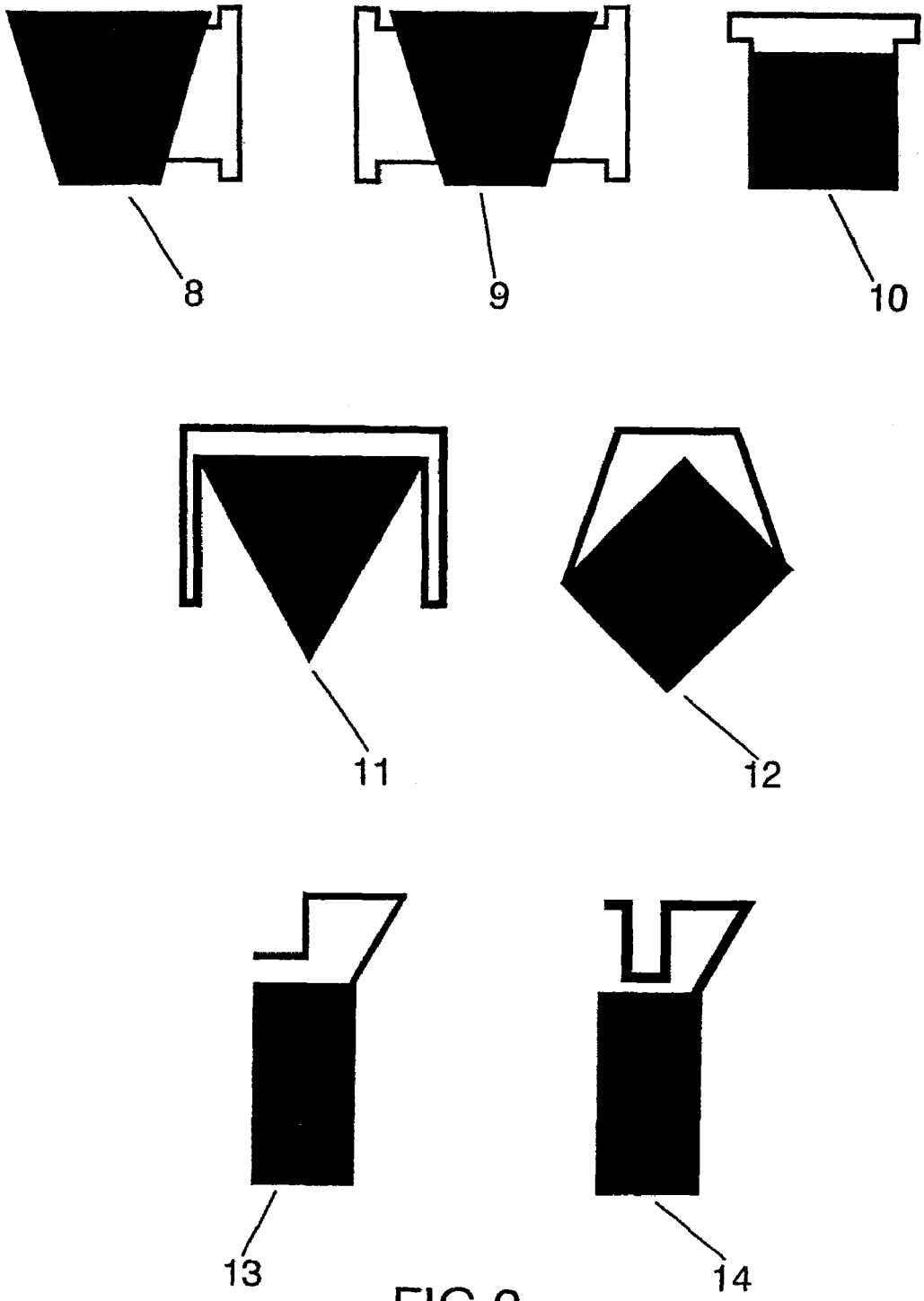
FIG. 2 shows a different particular configuration where the loads are curves which are composed by a maximum of nine segments in such a way that each segment forms an angle with their neighbours, as it has been mentioned before. Moreover, in drawings 8 to 12 the loads have both of their ends connected to the conducting surface. Drawings 8 and 9, are two examples where the conducting surface is side-loaded. Cases 13 and 14, are two cases where a rectangle is top-loaded with an open-ended curve, shaped as is mentioned before, with the connection made through one of the tips of the rectangle. The maximum width of the loading strips is smaller than a quarter of the longest edge of the conducting surface.
Figure 3:
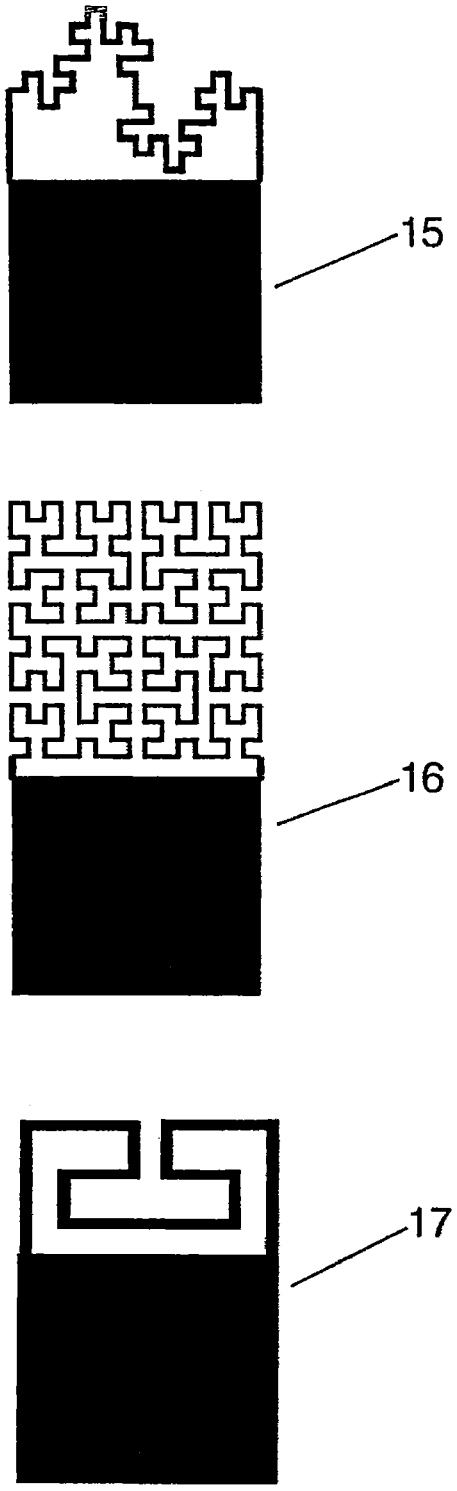
FIG. 3 shows a square structure top-loaded with three different space-filling curves. The curve used to load the square geometry, case 16, is the well-known Hilbert curve.
Figure 4:
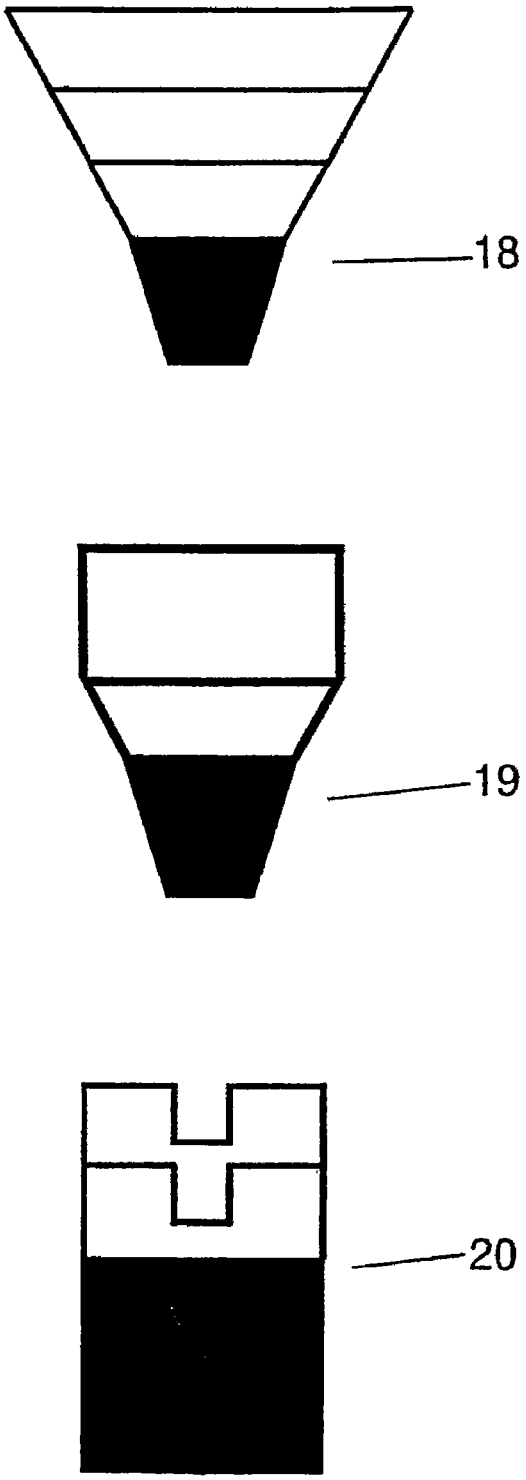
FIG. 4 shows three examples of the top-loaded antenna, where the load consist of two different loads that are added to the conducting surface. In drawing 19, a first load, built with three segments, is added to the trapezoid and then a second load is added to the first one.
Figure 5:
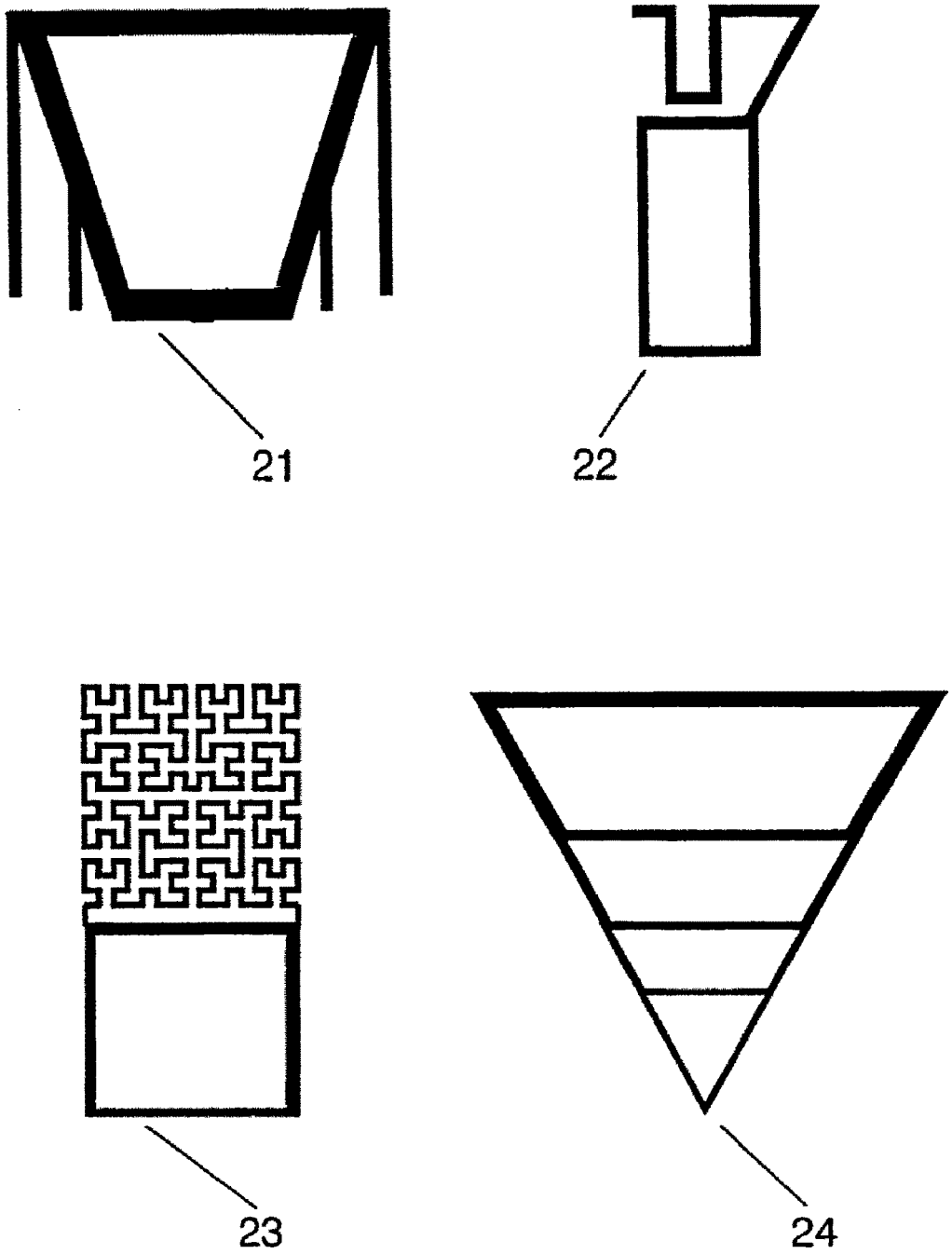
FIG. 5 includes some examples of the loaded antenna where a central portion of the conducting surface is even removed to further reduce the size of the antenna.
Figure 6:
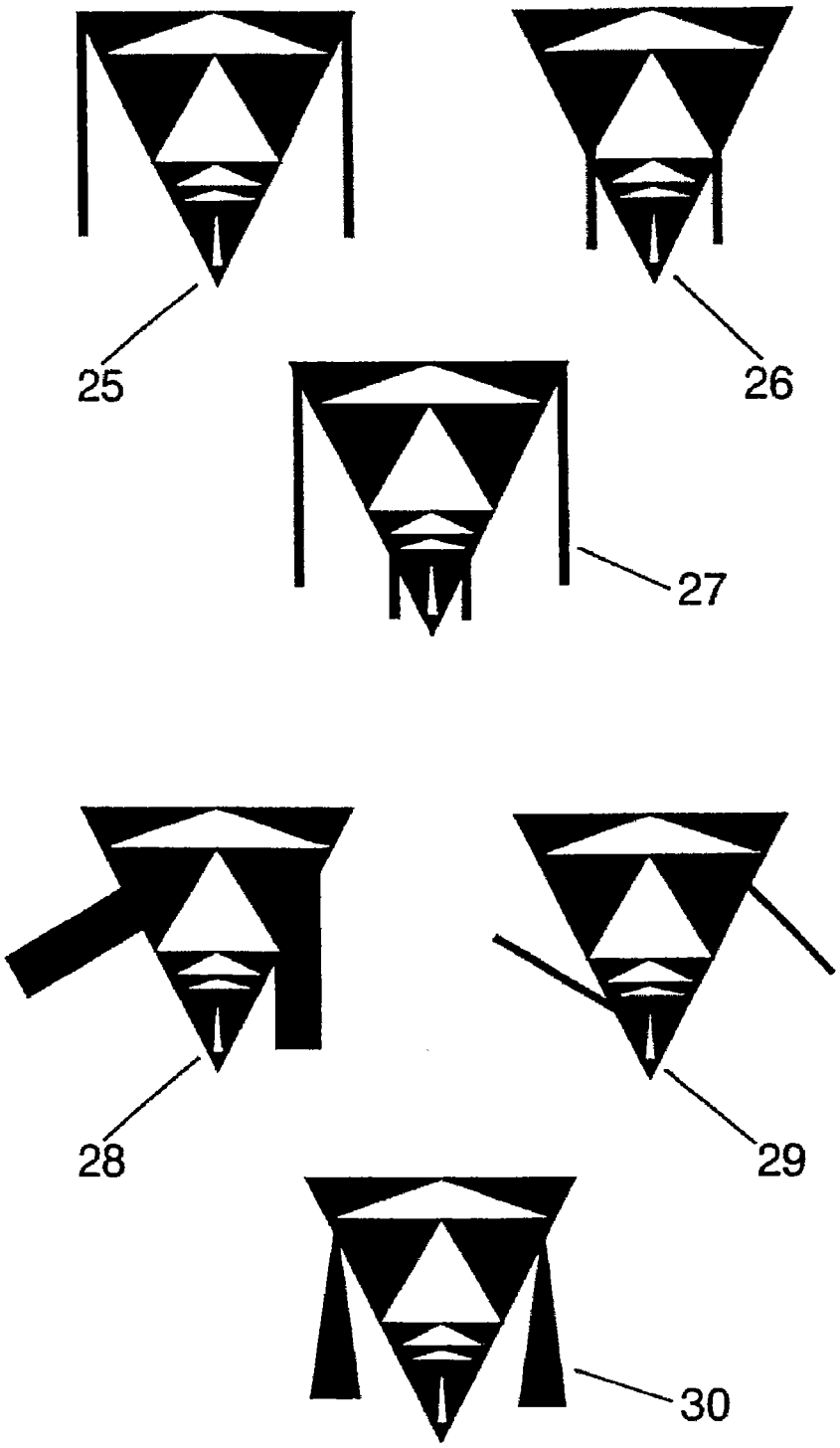
FIG. 6 shows the same loaded antenna described in FIG. 1, but in this case as the conducting surface a multilevel structure is used.
Figure 7:
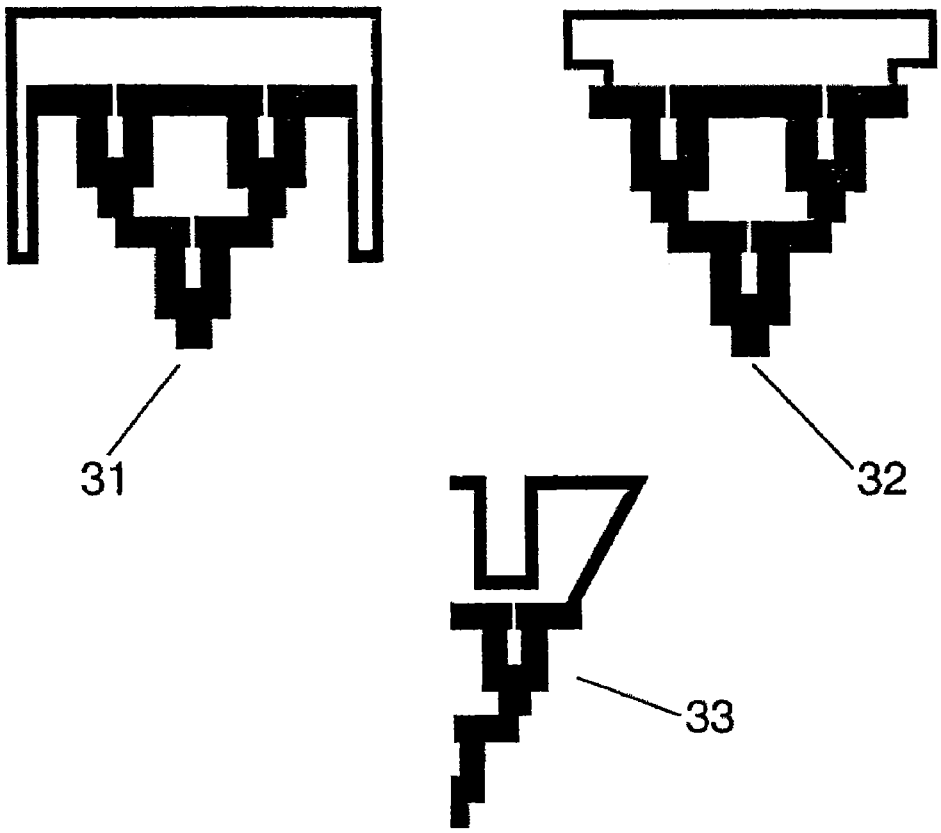
FIG. 7 shows another example of the loaded antenna, similar to those described in FIG. 2. In this case, the conducting surface consist of a multilevel structure. Drawings 31,32, 34 and 35 use different shapes for the loading but in all cases the load has both ends connected to the conducting surface. Case 33 is an example of an open-ended load added to a multilevel conducting surface.
Figure 7:
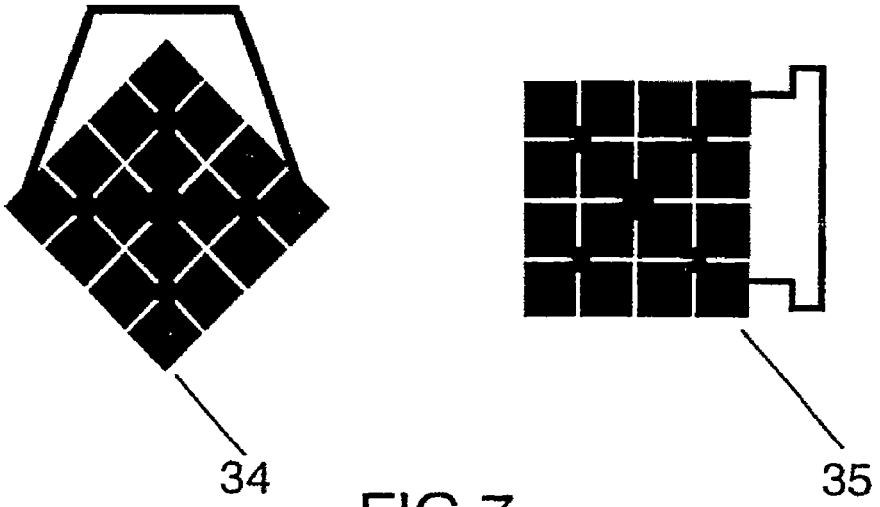
Figure 8:
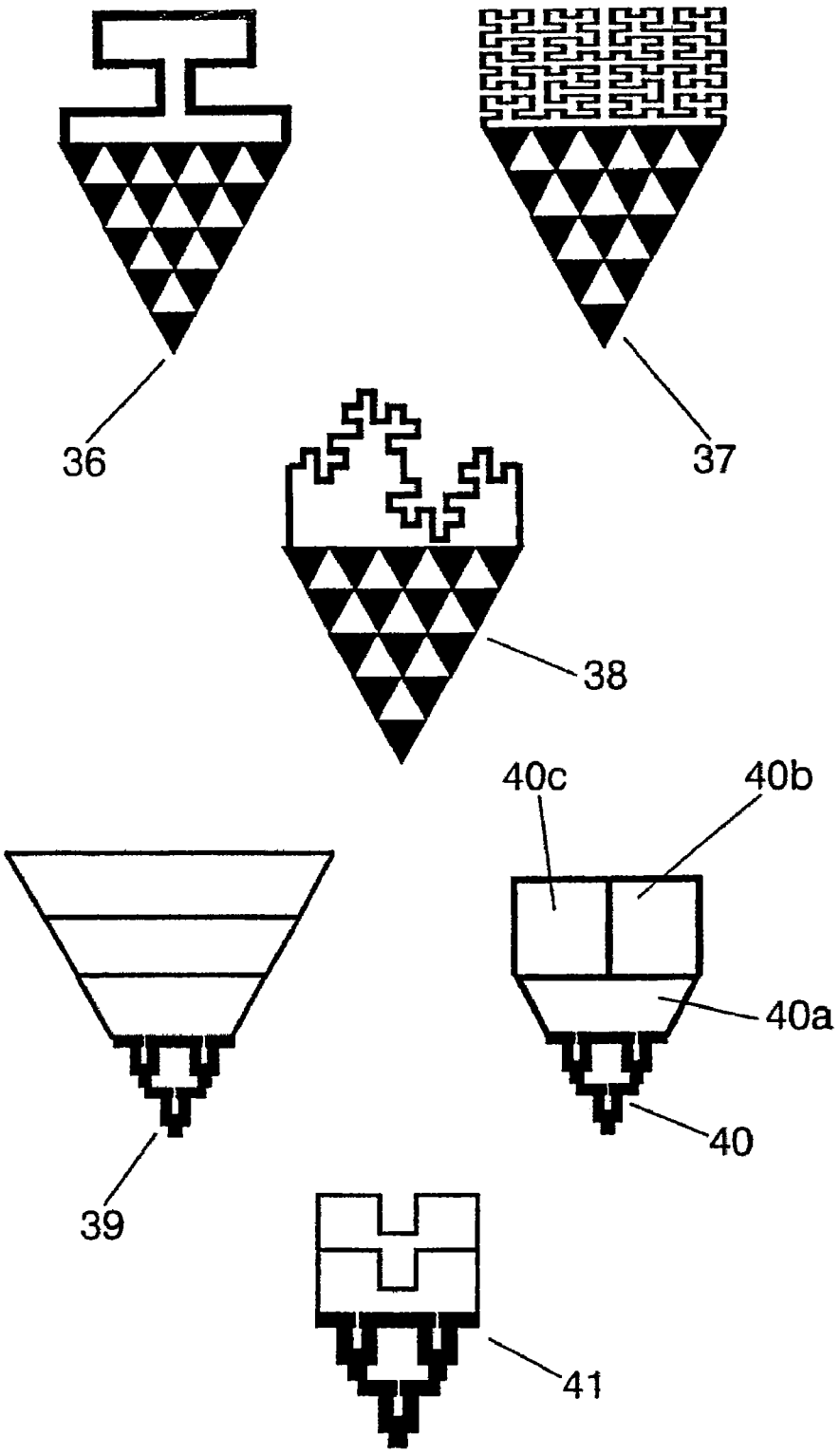
FIG. 8 presents some examples of the loaded antenna, similar to those depicted in FIGS. 3 and 4, but using a multilevel structure as the conducting surface. Illustrations 36, 37 and 38, include a space-filling top-loading curve, while the rest of the drawings show three examples of the top-loaded antenna with several levels of loadings. Drawing 40 is an example where three loads have been added to the multilevel structure. More precisely, the conducting surface is firstly loaded with curve (40*a*), next with curves (40*b*) and (40*c*). Curve (40*a*) has both ends connected to conducting surface, curve (40*b*) has both ends connected to the previous load (40*a*), and load (40*c*), formed with two segments, has one end connected to load (40*a*) and the other to the load (40*b*).
Figure 9:
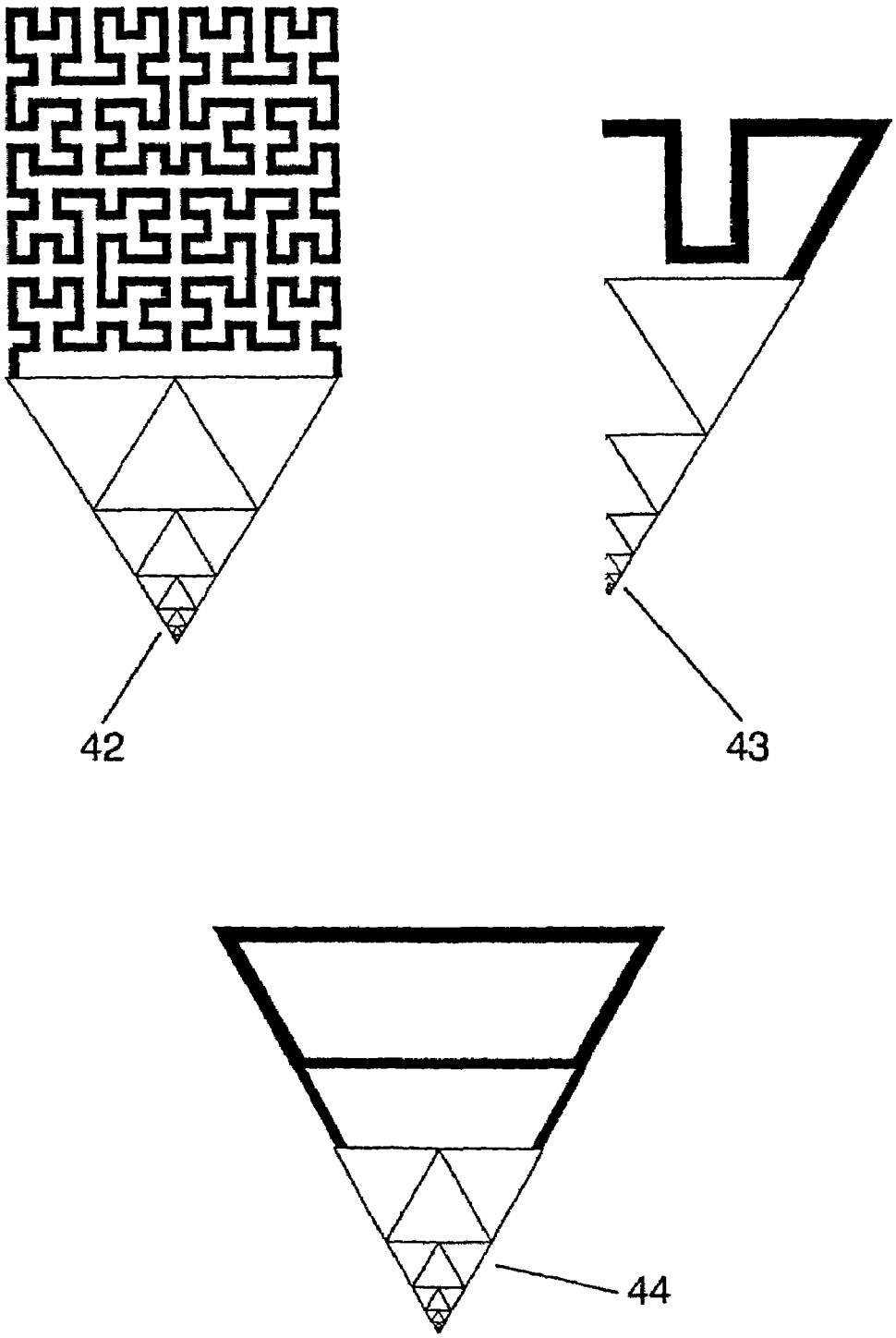
FIG. 9 shows three cases where the same multilevel structure, with the central portions of the conducting surface removed, which is loaded with three different type of loads; those are, a space-filling curve, a curve with a minimum of two segments and a maximum of nine segments connected in such a way mentioned just before, and finally a load with two similar levels.
Figure 10:
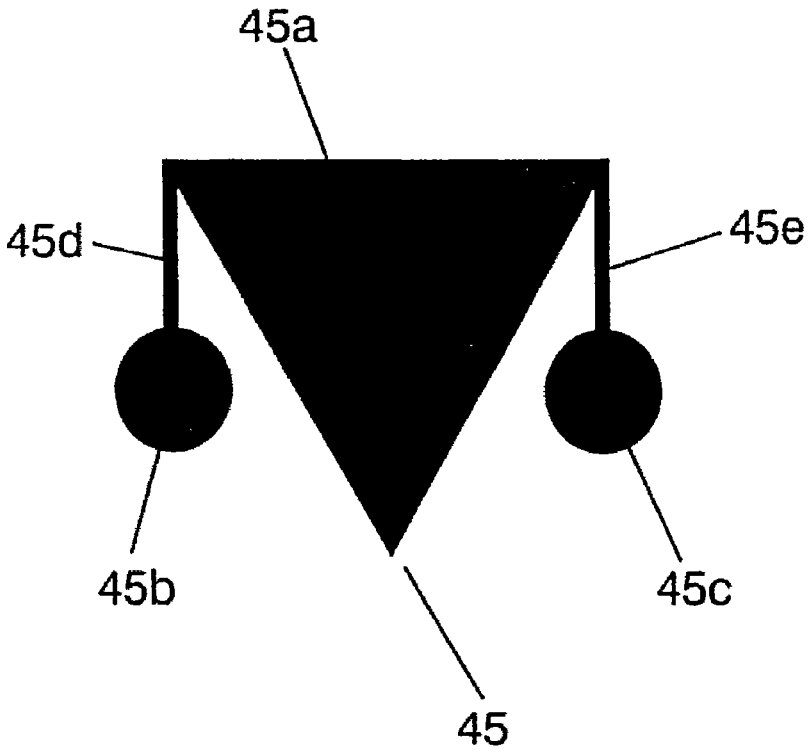
FIG. 10 shows two configurations of the loaded antenna which include three conducting surfaces, one of them bigger than the others. Drawing 45 shows a triangular conducting surface (45*a*) which is connected to two smaller circular conducting surfaces (45*b*) and (45*c*) through one conducting strip (45*d*) and (45*e*). Drawing 46 is a similar configuration to drawing 45 but the bigger conducting surface is a multilevel structure.
Figure 10:
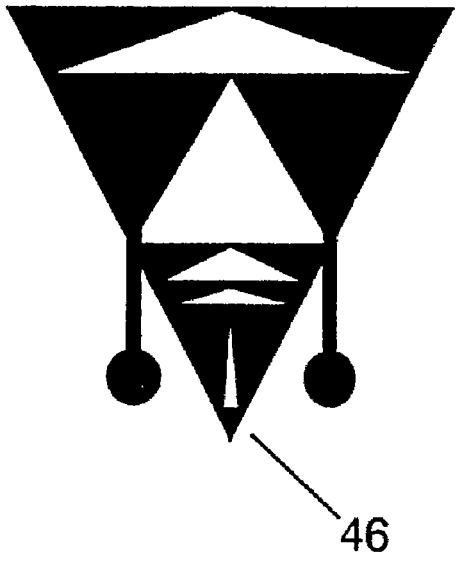
Figure 11:
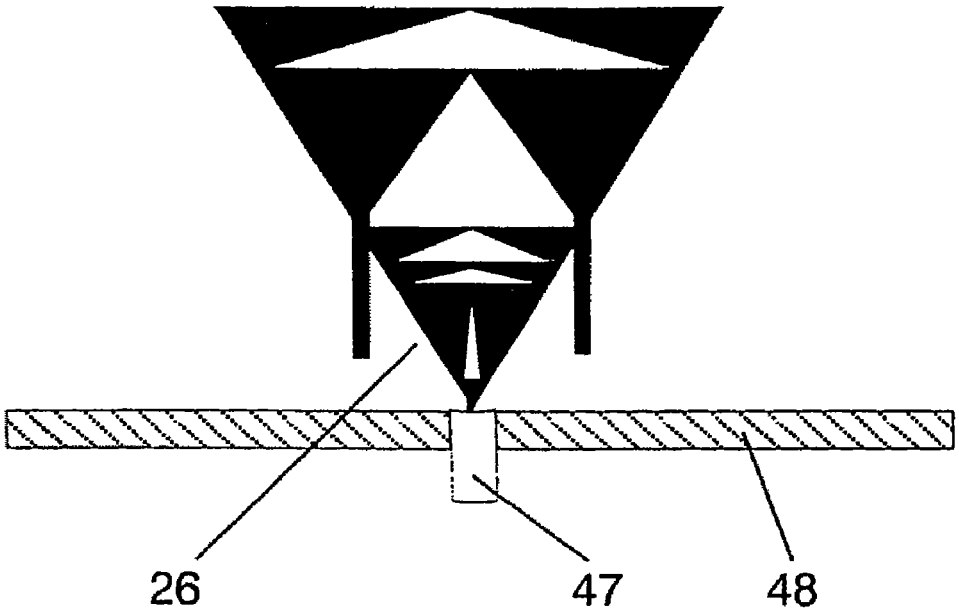
FIG. 11 shows other particular cases of the loaded antenna. They consist of a monopole antenna comprising a conducting or superconducting ground plane (48) with an opening to allocate a coaxial cable (47) with its outer conductor connected to said ground plane and the inner conductor connected to the loaded antenna. The loaded radiator can be optionally placed over a supporting dielectric (49).
Figure 11:
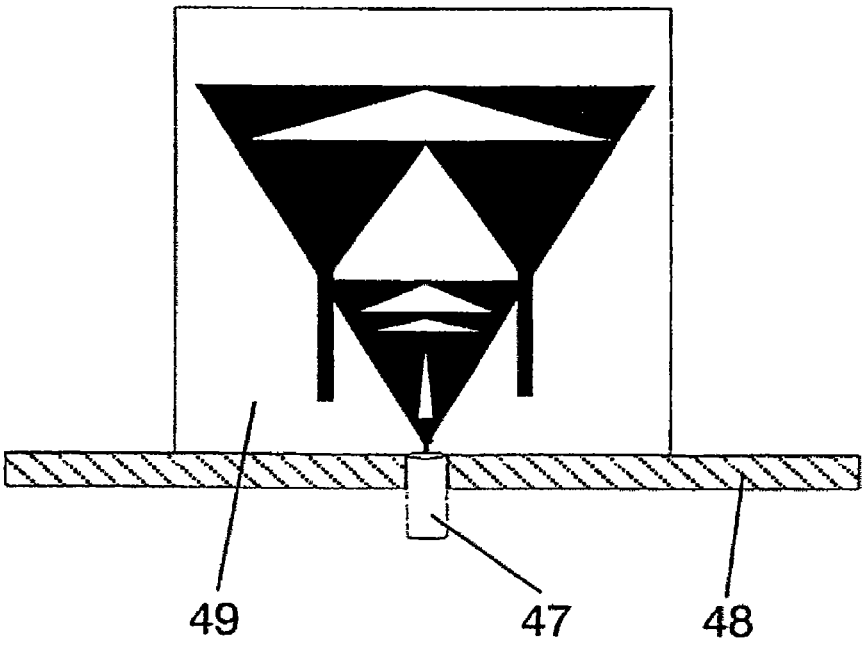

A preferred embodiment of the loaded antenna is a monopole configuration as shown in FIG. 11. The antenna includes a conducting or superconducting counterpoise or ground plane (48). A handheld telephone case, or even a part of the metallic structure of a car or train can act as such a ground conterpoise. The ground and the monopole arm (here the arm is represented with the loaded structure (26), but any of the mentioned loaded antenna structure could be taken instead) are excited as usual in prior art monopole by means of, for instance, a transmission line (47). Said transmission line is formed by two conductors, one of the conductors is connected to the ground counterpoise while the other is connected to a point of the conducting or superconducting loaded structure. In FIG. 11, a coaxial cable (47) has been taken as a particular case of transmission line, but it is clear to any skilled in the art that other transmission lines (such as for instance a microstrip arm) could be used to excite the monopole. Optionally, and following the scheme just described, the loaded monopole can be printed over a dielectric substrate (49).

Figure 12:
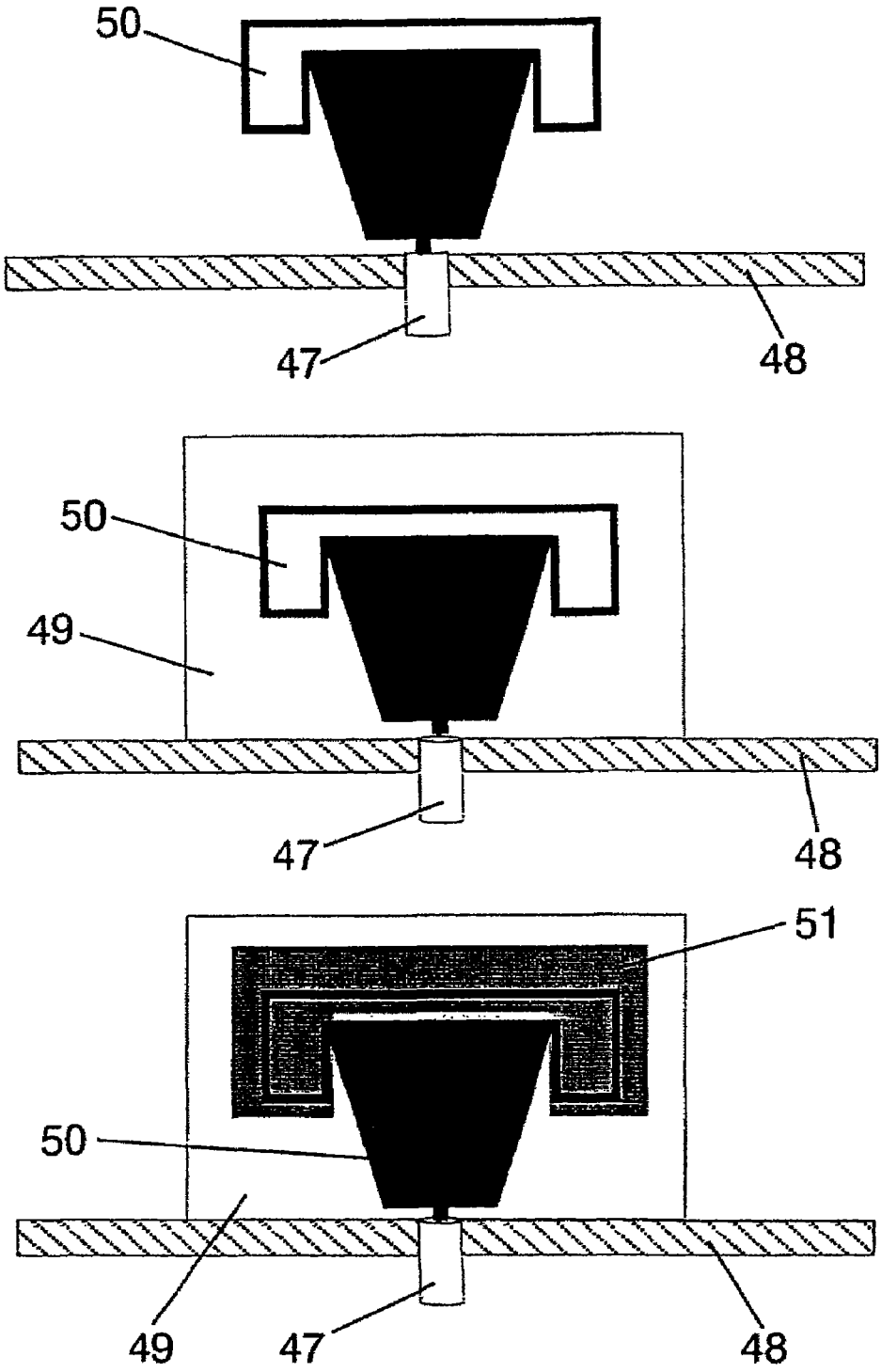
FIG. 12 shows a top-loaded polygonal radiating element (50) mounted with the same configuration as the antenna in FIG. 12. The radiating element radiator can be optionally placed over a supporting dielectric (49). The lower drawing shows a configuration wherein the radiating element is printed on one of the sides of a dielectric substrate (49) and also the load has a conducting surface on the other side of the substrate (51).

Another preferred embodiment of the loaded antenna is a monopole configuration as shown in FIG. 12. The assembly of the antenna (feeding scheme, ground plane, etc) is the same as the considered in the embodiment described in FIG. 11. In the present figure, there is another example of the loaded antenna. More precisely, it consists of a trapezoid element top-loaded with one of the mentioned curves. In this case, one of the main differences is that, being the antenna edged on dielectric substrate, it also includes a conducting surface on the other side of the dielectric (51) with the shape of the load. This preferred configuration allows to miniaturize the antenna and also to adjust the multiband parameters of the antenna, such as the spacing the between bands.

Figure 13:
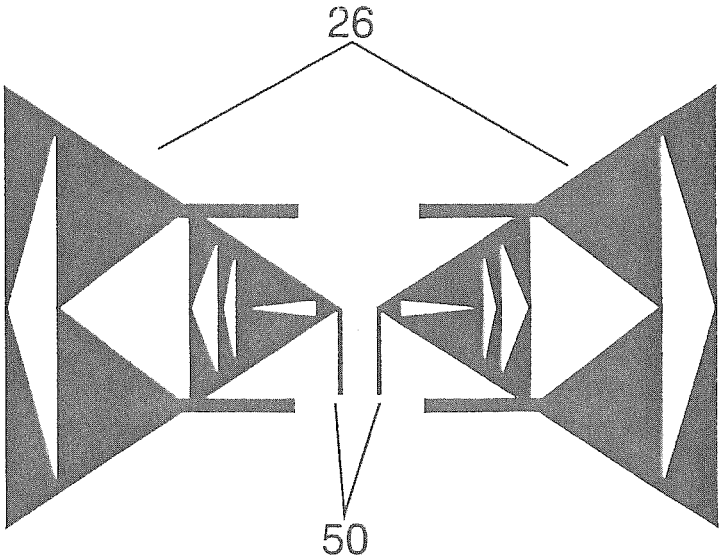
FIG. 13 shows a particular configuration of the loaded antenna. It consists of a dipole wherein each of the two arms includes two straight strip loads. The lines at the vertex of the small triangles (50) indicate the input terminal points. The two drawings display different configurations of the same basic dipole; in the lower drawing the radiating element is supported by a dielectric substrate (49).
Figure 13:
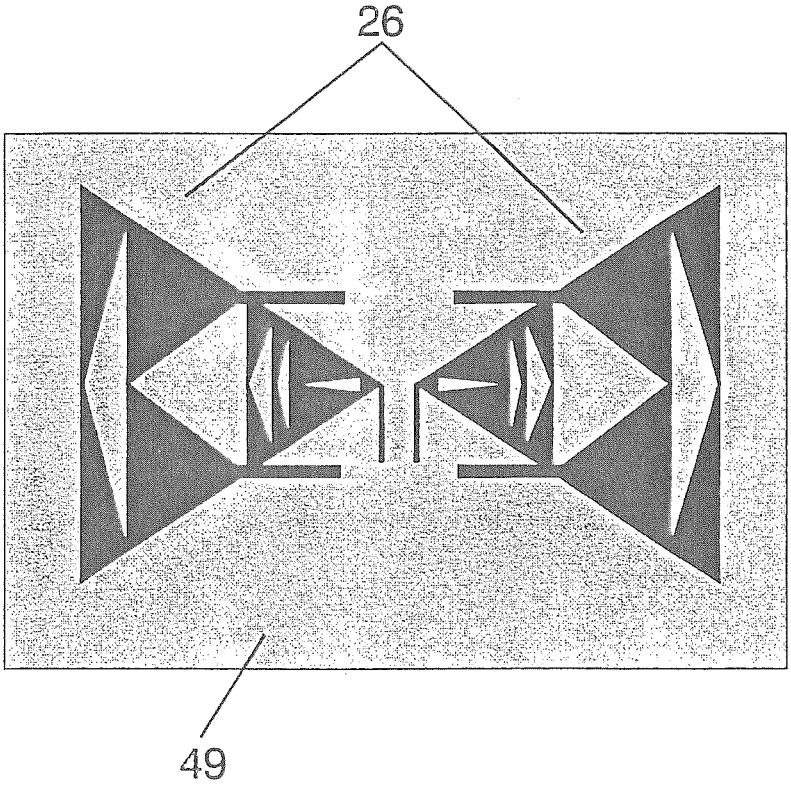

FIG. 13 describes a preferred embodiment of the invention. A two-arm antenna dipole is constructed comprising two conducting or superconducting parts, each part being a side-loaded multilevel structure. For the sake of clarity but without loss of generality, a particular case of the loaded antenna (26) has been chosen here; obviously, other structures, as for instance, those described in FIGS. 2,3,4,7 and 8, could be used instead. Both, the conducting surfaces and the loading structures are lying on the same surface. The two closest apexes of the two arms form the input terminals (50) of the dipole. The terminals (50) have been drawn as conducting or superconducting wires, but as it is clear to those skilled in the art, such terminals could be shaped following any other pattern as long as they are kept small in terms of the operating wavelength. The skilled in the art will notice that, the arms of the dipoles can be rotated and folded in different ways to finely modify the input impedance or the radiation properties of the antenna such as, for instance, polarization.

Another preferred embodiment of a loaded dipole is also shown in FIG. 13 where the conducting or superconducting loaded arms are printed over a dielectric substrate (49); this method is particularly convenient in terms of cost and mechanical robustness when the shape of the applied load packs a long length in a small area and when the conducting surface contains a high number of polygons, as happens with multilevel structures. Any of the well-known printed circuit fabrication techniques can be applied to pattern the loaded structure over the dielectric substrate. Said dielectric substrate can be, for instance, a glass-fibre board, a teflon based substrate (such as Cuclad®) or other standard radiofrequency and microwave substrates (as for instance Rogers 4003® or Kapton®). The dielectric substrate can be a portion of a window glass if the antenna is to be mounted in a motor vehicle such as a car, a train or an airplane, to transmit or receive radio, TV, cellular telephone (GSM900, GSM1800, UMTS) or other communication services electromagnetic waves. Of course, a balun network can be connected or integrated at the input terminals of the dipole to balance the current distribution among the two dipole arms.

Figure 14:
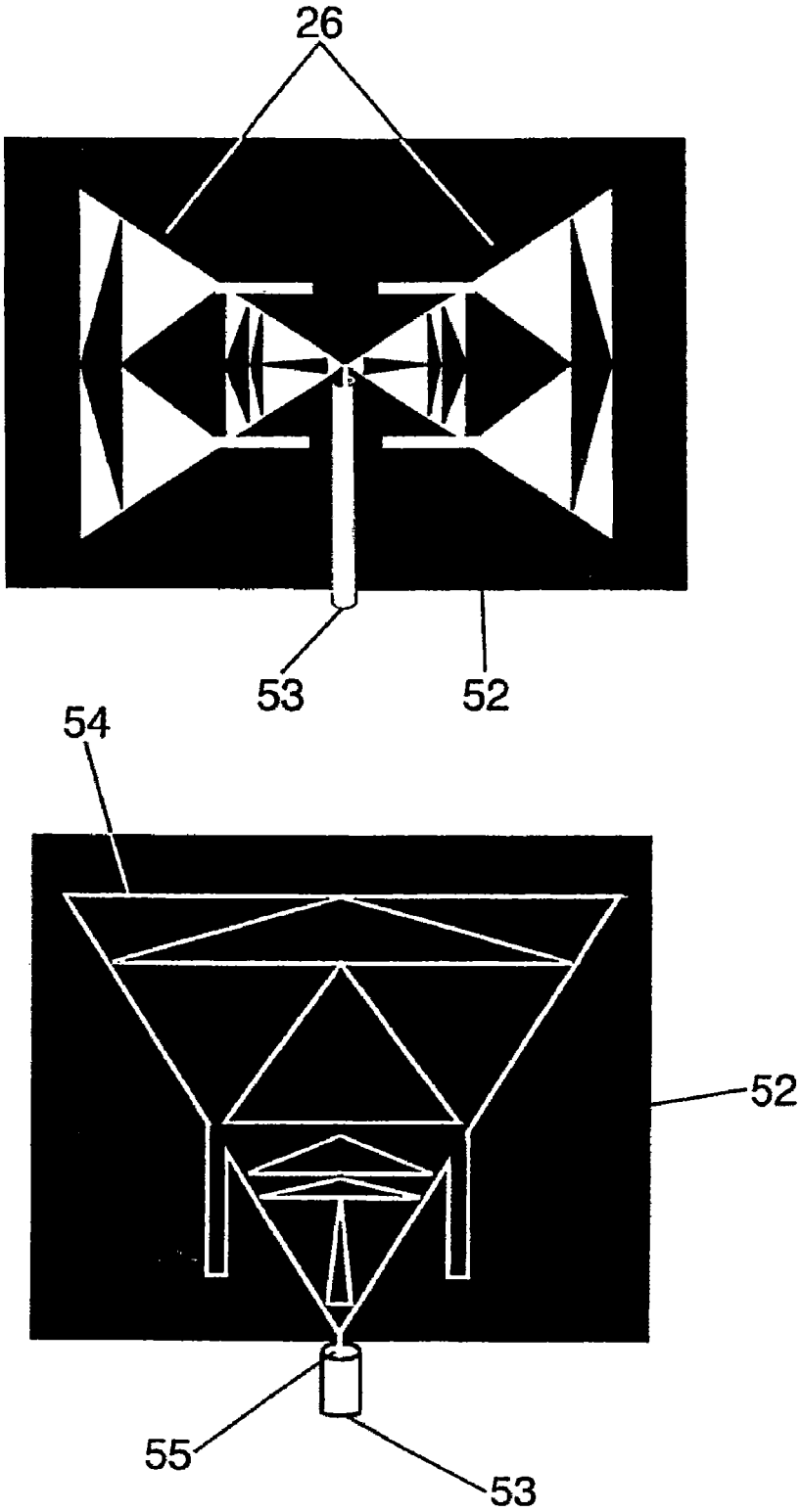
FIG. 14 shows, in the upper drawing, an example of the same dipole antenna side-loaded with two strips but fed as an aperture antenna. The lower drawing is the same loaded structure wherein the conductor defines the perimeter of the loaded geometry.

The embodiment (26) in FIG. 14 consist on an aperture configuration of a loaded antenna using a multilevel geometry as the conducting surface. The feeding techniques can be one of the techniques usually used in conventional aperture antennas. In the described figure, the inner conductor of the coaxial cable (53) is directly connected to the lower triangular element and the outer conductor to the rest of the conductive surface. Other feeding configurations are possible, such as for instance a capacitive coupling.

Another preferred embodiment of the loaded antenna is a slot loaded monopole antenna as shown in the lower drawing in FIG. 14. In this figure the loaded structure forms a slot or gap (54) impressed over a conducting or superconducting sheet (52). Such sheet can be, for instance, a sheet over a dielectric substrate in a printed circuit board configuration, a transparent conductive film such as those deposited over a glass window to protect the interior of a car from heating infrared radiation, or can even be a part of the metallic structure of a handheld telephone, a car, train, boat or airplane. The feeding scheme can be any of the well known in conventional slot antennas and it does not become an essential part of the present invention. In all said two illustrations in FIG. 14, a coaxial cable has been used to feed the antenna, with one of the conductors connected to one side of the conducting sheet and the other connected at the other side of the sheet across the slot. A microstrip transmission line could be used, for instance, instead of a coaxial cable.

Figure 15:
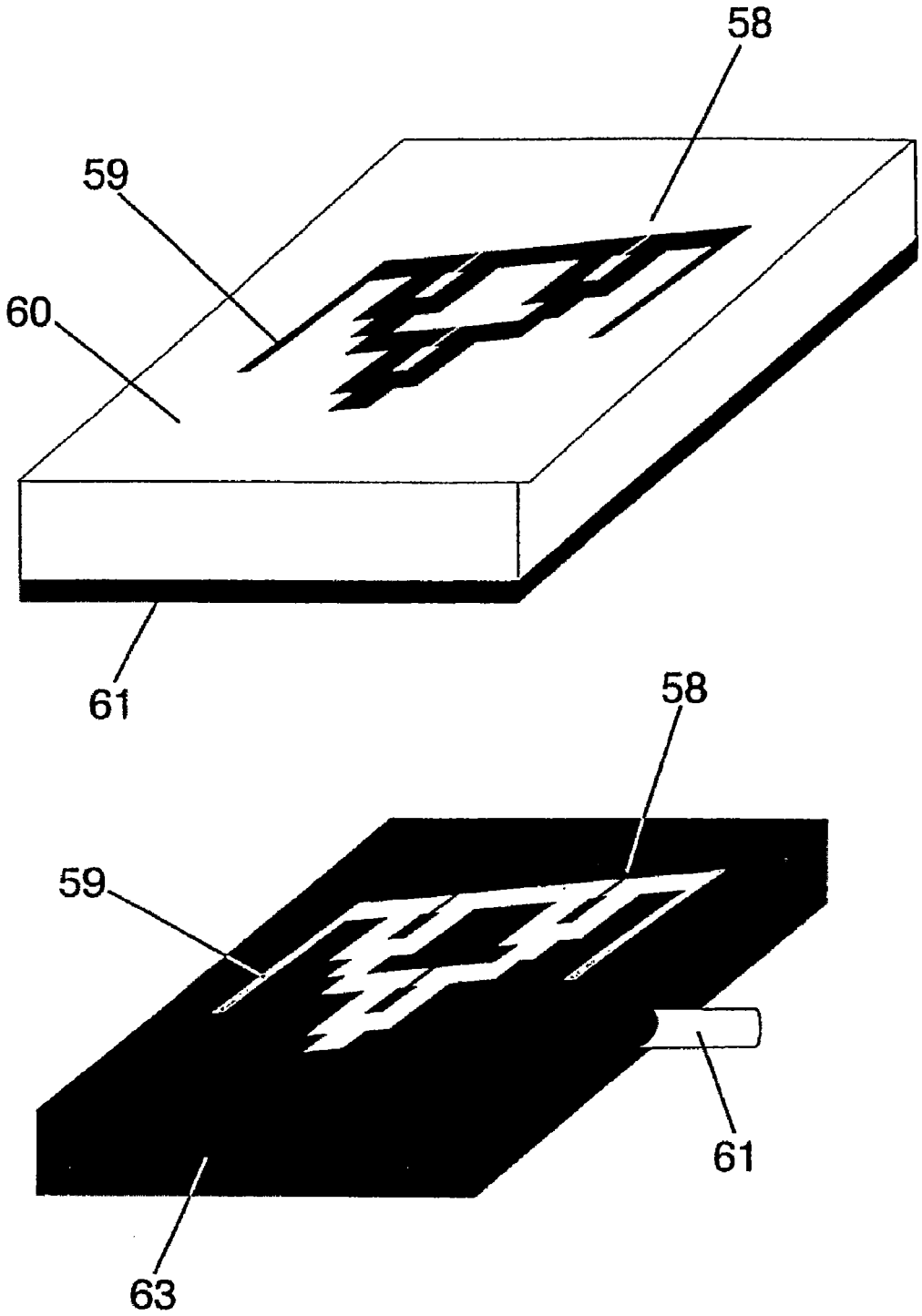
FIG. 15 shows a patch antenna wherein the radiating element is a multilevel structure top-loaded with two strip arms, upper drawing. Also, the figure shows an aperture antenna wherein the aperture (59) is practiced on a conducting or superconducting structure (63), said aperture being shaped as a loaded multilevel structure.

Another preferred embodiment is described in FIG. 15. It consists of a patch antenna, with the conducting or superconducting patch (58) featuring the loaded structure (the particular case of the loaded structure (59) has been used here but it is clear that any of the other mentioned structures could be used instead). The patch antenna comprises a conducting or superconducting ground plane (61) or ground counterpoise, and the conducting or superconducting patch which is parallel to said ground plane or ground counterpoise. The spacing between the patch and the ground is typically below (but not restricted to) a quarter wavelength. Optionally, a low-loss dielectric substrate (60) (such as glass-fibre, a teflon substrate such as Cuclad® or other commercial materials such as Rogers4003®) can be placed between said patch and ground counterpoise. The antenna feeding scheme can be taken to be any of the well-known schemes used in prior art patch antennas, for instance: a coaxial cable with the outer conductor connected to the ground plane and the inner conductor connected to the patch at the desired input resistance point (of course the typical modifications including a capacitive gap on the patch around the coaxial connecting point or a capacitive plate connected to the inner conductor of the coaxial placed at a distance parallel to the patch, and so on, can be used as well); a microstrip transmission line sharing the same ground plane as the antenna with the strip capacitively coupled to the patch and located at a distance below the patch, or in another embodiment with the strip placed below the ground plane and coupled to the patch through a slot, and even a microstrip line with the strip co-planar to the patch. All these mechanisms are well known from prior art and do not constitute an essential part of the present invention. The essential part of the invention is the loading shape of the antenna which contributes to enhance the behavior of the radiator to operate simultaneously at several bands with a small size performance.

The same FIG. 15 describes another preferred embodiment of the loaded antenna. It consist of an aperture antenna, said aperture being characterized by its loading added to a multilevel structure, said aperture being impressed over a conducting ground plane or ground counterpoise, said ground plane consisting, for example, of a wall of a waveguide or cavity resonator or a part of the structure of a motor vehicle (such as a car, a lorry, an airplane or a tank). The aperture can be fed by any of the conventional techniques such as a coaxial cable (61), or a planar microstrip or strip-line transmission line, to name a few.

Figure 16:
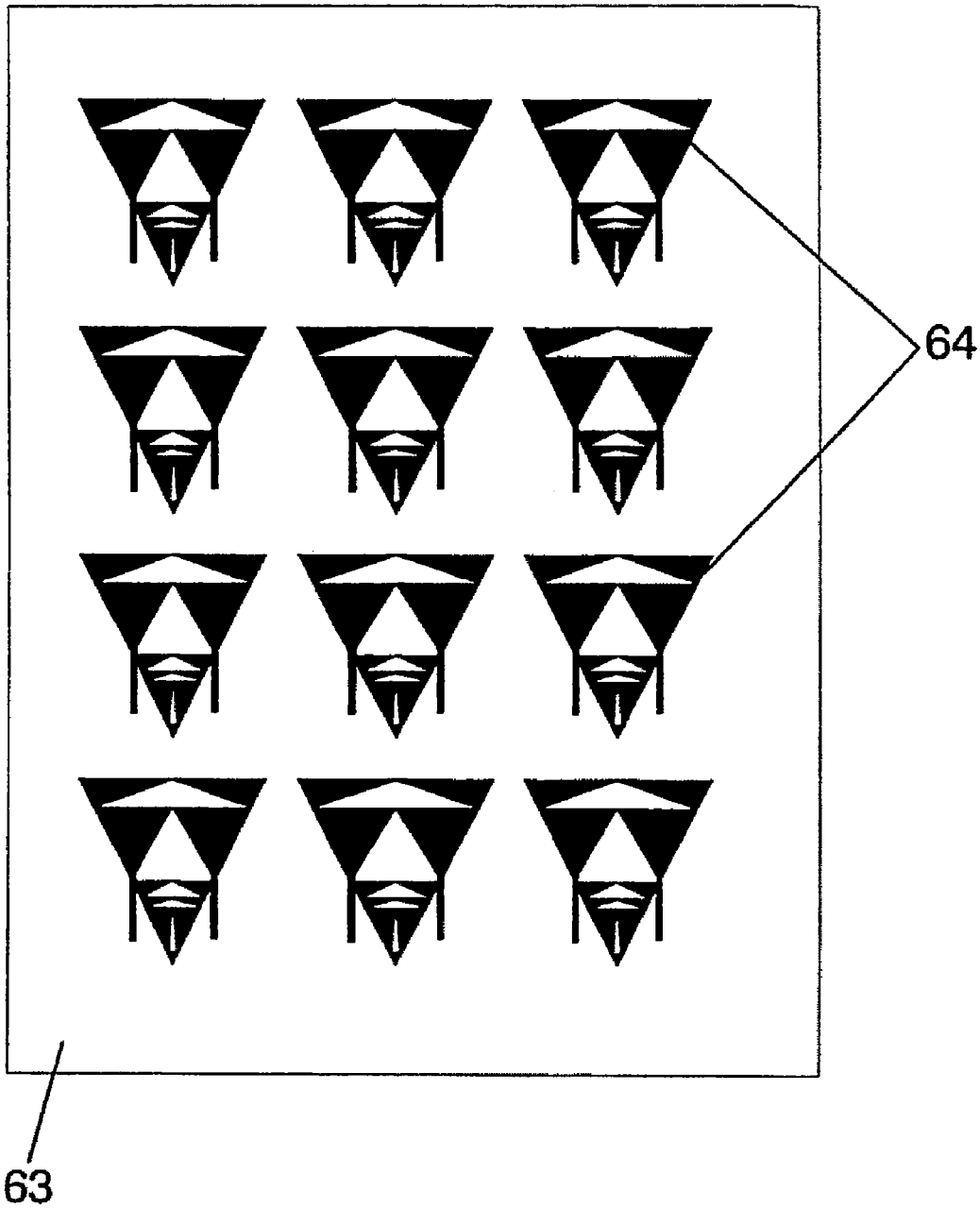
FIG. 16 shows a frequency selective surface wherein the elements that form the surface are shaped as a multilevel loaded structure.

Another preferred embodiment is described in FIG. 16. It consists of a frequency selective surface (63). Frequency selective surfaces are essentially electromagnetic filters, which at some frequencies they completely reflect energy while at other frequencies they are completely transparent. In this preferred embodiment the selective elements (64), which form the surface (63), use the loaded structure (26), but any other of the mentioned loaded antenna structures can be used instead. At least one of the selective elements (64) has the same shape of the mentioned loaded radiating elements. Besides this embodiment, another embodiment is preferred; this is, a loaded antenna where the conducting surface or the loading structure, or both, are shaped by means of one or a combination of the following mathematical algorithms: Iterated Function Systems, Multi Reduction Copy Machine, Networked Multi Reduction Copy Machine.

What is claimed:

1. A portable communications device comprising:

a case operable to be held in a user's hand;

a grounding element;

an antenna mounted entirely within the case and coupled to the grounding element, the antenna being configured to both radiate and receive electromagnetic waves corresponding to at least two non-overlapping frequency bands, wherein:

the antenna comprises a radiating element comprising a first part and a second part, the first part comprising at least one conducting surface, the at least one conducting surface being configured to radiate and receive electromagnetic waves corresponding to at least two non-overlapping frequency regions and comprising a surface whose entire perimeter is a space-filling perimeter, the space-filling perimeter including at least ten segments connected such that no pair of adjacent segments defines a longer straight segment, all of the segments of the space-filling perimeter being smaller than a tenth of an operating free-space wavelength of the antenna, and the second part comprising a loading structure extending along at least one path having a length between two tips, the length of the at least one path of the loading structure being smaller than an eighth of the longest operating free-space wavelength of the antenna;

at least one tip of the loading structure is connected along a width dimension of the loading structure to at least a portion of an edge of the at least one conducting surface; and a maximum width of the loading structure is smaller than a quarter of a longest edge of the perimeter of the at least one conducting surface.

2. The portable communications device of claim 1, wherein one of the at least two non-overlapping frequency bands is a frequency band that comprises 900 MHz.

3. The portable communications device of claim 2, wherein one of the at least two non-overlapping frequency bands is a frequency band that comprises 1800 MHz.

4. The portable communications device of claim 1, wherein the grounding element comprises a ground plane.

5. The portable communications device of claim 4, wherein one of the at least two non-overlapping frequency bands is a frequency band that comprises 900 MHz and one of the at least two non-overlapping frequency bands is a frequency band that comprises 1800 MHz.

6. The portable communications device of claim 4, wherein the antenna is configured to radiate and receive electromagnetic waves corresponding to at least three frequency bands, and wherein the loading structure is configured to cause a bandwidth of the radiating element to be greater than a bandwidth of the first part in a second frequency region.

7. The portable communications device of claim 6, wherein one of the at least three frequency bands is a frequency band that comprises 1800 MHz.

8. The portable communications device of claim 7, wherein one of the at least three frequency bands is a frequency band that comprises 900 MHz.

9. The portable communications device of claim 6, wherein the at least one conducting surface and the loading structure lie on a common curved surface.

10. The portable communications device of claim 6, wherein the perimeter of the loading structure is shaped as a space-filling curve, the space-filling curve including at least ten segments connected such that no pair of adjacent segments defines a longer straight segment, the segments being smaller than a tenth of an operating free-space wavelength of the antenna.

11. The portable communications device of claim 1, wherein the loading structure is configured to adjust a spacing between the at least two non-overlapping frequency bands.

12. The portable communications device of claim 11, wherein the width of the loading structure is non-uniform.

13. The portable communications device of claim 11, wherein a distance between the at least one point and a feeding point is smaller than a quarter of a longest operating wavelength, and wherein the distance is measured as a shortest distance through the perimeter of the at least one conducting surface.

14. The portable communications device of claim 11, wherein a tip of the at least one conducting strip is open ended.

15. The portable communications device of claim 11, wherein one of the at least two non-overlapping frequency bands comprises UMTS.

16. The portable communications device of claim 1, wherein the antenna is configured to radiate and receive electromagnetic waves corresponding to at least three frequency bands.

17. The portable communications device of claim 16, wherein a minimum operating frequency of the first part is substantially similar to a minimum operating frequency of the radiating element.

18. The portable communications device of claim 16, wherein the loading structure is not an inductive loading element or a capacitive loading element.

19. The portable communications device of claim 16, wherein the antenna maintains similar radio-electric parameters at the at least two non-overlapping frequency bands.

20. A portable communications device comprising:

a case operable to be held in a user's hand;

a grounding element;

an antenna mounted entirely within the case in operative relation to the grounding element, the antenna being configured to both radiate and receive electromagnetic waves corresponding to at least two non-overlapping frequency bands, wherein:

the antenna comprises a radiating element comprising a first part and a second part, the first part comprising at least one conducting surface, the at least one conducting surface being configured to radiate and receive electromagnetic waves corresponding to at least two non-overlapping frequency regions and comprising a surface whose entire perimeter is a space-filling perimeter, the space-filling perimeter including at least ten segments connected such that no pair of adjacent segments defines a longer straight segment, all of the segments of the space-filling perimeter being smaller than a tenth of an operating free-space wavelength of the antenna, and the second part comprising a loading structure, a perimeter of the loading structure comprising a minimum of two segments and a maximum of nine segments, the segments being connected such that no pair of adjacent segments defines a longer straight segment;

the loading structure is connected at least at one point to an edge of the at least one conducting surface;

a maximum width of the loading structure is smaller than a quarter of a longest edge of the perimeter of the at least one conducting surface; and a portion of the edge of the at least one conducting surface to which at least one tip of the loading structure is connected is smaller than half of the edge of the at least one conducting surface to which the at least one tip of the loading structure is connected.

21. The portable communications device of claim 20, wherein the grounding element comprises a ground plane.

22. The portable communications device of claim 21, wherein the loading structure is placed over a supporting dielectric.

23. The portable communications device of claim 22, wherein a tip of the loading structure is open ended.

24. The portable communications device of claim 22, wherein the loading structure is a non-symmetric loading structure at least one conducting strip comprises a polygonal shape.

25. The portable communications device of claim 22, wherein a distance between the at least one point and a feeding point is smaller than a quarter of a shortest operating wavelength, and wherein the distance is measured as a shortest distance through the perimeter of the at least one conducting surface.

26. The portable communications device of claim 21, wherein the antenna is configured to radiate and receive electromagnetic waves corresponding to at least three frequency bands, and wherein the loading structure is configured to cause a bandwidth of the radiating element to be greater than a bandwidth of the first part in a second frequency region.

27. The portable communications device of claim 26, wherein the width of the loading structure is non-uniform.

28. The portable communications device of claim 26, wherein the at least one conducting surface and the loading structure lie on a common curved surface.

29. The portable communications device of claim 26, wherein the antenna maintains similar radio-electric parameters at the at least three frequency bands.

30. The portable communications device of claim 20, wherein the loading structure is configured to adjust a spacing between the at least two non-overlapping frequency bands.

31. The portable communications device of claim 30, wherein one of the at least two non-overlapping frequency bands is a frequency band that comprises 900 MHz.

32. The portable communications device of claim 30, wherein the antenna is shorter than a quarter of a central operating wavelength of a first of the at least two non-overlapping frequency bands.

33. The portable communications device of claim 32, wherein the antenna maintains similar radio-electric parameters at the at least two non-overlapping frequency bands.

34. The portable communications device of claim 33, wherein a distance between the at least one point and a feeding point is smaller than a quarter of a shortest operating wavelength, wherein the distance is measured as a shortest distance through the perimeter of the at least one conducting surface.

35. The portable communications device of claim 33, wherein a tip of the loading structure is open ended.

36. The portable communications device of claim 31, wherein one of the at least two non-overlapping frequency bands comprises UMTS.

37. The portable communications device of claim 36, wherein the width of the loading structure is non-uniform.

38. The portable communications device of claim 36, wherein the antenna is configured to radiate and receive electromagnetic waves corresponding to at least three frequency bands, and wherein a minimum operating frequency of the first part is substantially similar to a minimum operating frequency of the radiating element.

39. A portable communications device comprising:

a case operable to be held in a user's hand;

a grounding element;

an antenna mounted entirely within the case and coupled to the grounding element, the antenna being configured to both radiate and receive electromagnetic waves corresponding to at least two non-overlapping frequency bands, wherein:

the antenna comprises a radiating element comprising a first part and a second part, the first part comprising at least one conducting surface, and the second part comprising a loading structure, the loading structure having a space-filling perimeter, the space-filling perimeter including at least ten segments connected such that no pair of adjacent segments defines a longer straight segment, the segments being smaller than a tenth of an operating free-space wavelength of the antenna;

the loading structure is connected at least at one point to an edge of the at least one conducting surface;

the loading structure extends along at least one path having a length between two tips;

a maximum width of the loading structure is smaller than a quarter of a longest edge of the perimeter of the at least one conducting surface; and a length of the at least one path of the loading structure is greater than the width of the loading structure.

40. The portable communications device of claim 39, wherein the grounding element comprises a ground plane.

41. The portable communications device of claim 40, wherein at least a part of a perimeter of the at least one conducting surface is shaped as a multi-segment curve comprising a plurality of segments, wherein each segment of the plurality of segments is smaller than a tenth of a longest operating free-space wavelength, and wherein the segments of the plurality of segments are arranged in such a way that no pair of adjacent and connected segments form another longer straight segment.

42. The portable communications device of claim 41, wherein the at least two non-overlapping frequency bands comprise multiple cellular telephone electromagnetic waves.

43. The portable communications device of claim 41, wherein a tip of the loading structure is open ended.

44. The portable communications device of claim 43, wherein the width of the loading structure is non-uniform.

45. The portable communications device of claim 39, wherein the antenna is configured to radiate and receive electromagnetic waves corresponding to at least three frequency bands, and wherein the loading structure is configured to cause a bandwidth of the radiating element to be greater than a bandwidth of the first part in a second frequency region.

46. The portable communications device of claim 45, wherein a distance between the at least one point and a feeding point is smaller than a quarter of a shortest operating wavelength, and wherein the distance is measured as a shortest distance through a perimeter of the at least one conducting surface.

47. The portable communications device of claim 45, wherein the at least one conducting surface and the loading structure lie on a common curved surface.

48. The portable communications device of claim 47, wherein the loading structure is placed over a supporting dielectric.

49. The portable communications device of claim 45, wherein one of the at least three frequency bands comprises UMTS.

50. The portable communications device of claim 39, wherein the loading structure is configured to adjust a spacing between the at least two non-overlapping frequency bands.

51. The portable communications device of claim 50, wherein the loading structure is placed over a supporting dielectric.

52. The portable communications device of claim 51, wherein the width of the loading structure is non-uniform.

53. The portable communications device of claim 52, wherein a tip of the loading structure is open ended.

54. The portable communications device of claim 39, wherein the at least two non-overlapping frequency bands comprise 900 MHz and 1800 MHz.

55. The portable communications device of claim 54, wherein the antenna is shorter than a quarter of a central operating wavelength of a first of the at least two non-overlapping frequency bands.

56. The portable communications device of claim 55, wherein the antenna maintains similar radio-electric parameters at the at least two non-overlapping frequency bands.

57. The portable communications device of claim 56, wherein a distance between the at least one point and a feeding point is smaller than a quarter of a shortest operating wavelength, and wherein the distance is measured as a shortest distance through a perimeter of the at least one conducting surface.

58. The portable communications device of claim 57, wherein a tip of the loading structure is open ended.

59. The portable communications device of claim 40, wherein the antenna is configured to radiate and receive electromagnetic waves corresponding to at least three frequency bands, and wherein a minimum operating frequency of the first part is substantially similar to a minimum operating frequency of the radiating element.

60. The portable communications device of claim 59, wherein the at least one of the three frequency bands comprises UMTS.

61. The portable communications device of claim 59, wherein the width of the loading structure is non-uniform.

62. The portable communications device of claim 59, wherein the loading structure is a non-symmetric loading structure.

* * * * *